US009338551B2

(12) United States Patent
Thyssen et al.

(10) Patent No.: US 9,338,551 B2
(45) Date of Patent: May 10, 2016

(54) MULTI-MICROPHONE SOURCE TRACKING AND NOISE SUPPRESSION

(71) Applicant: Broadcom Corporation, Irvine, CA (US)

(72) Inventors: Jes Thyssen, San Juan Capistrano, CA (US); Ashutosh Pandey, Irvine, CA (US); Bengt J. Borgstrom, Santa Monica, CA (US); Daniele Giacobello, Los Angeles, CA (US); Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 72 days.

(21) Appl. No.: 14/216,769

(22) Filed: Mar. 17, 2014

(65) Prior Publication Data

US 2014/0286497 A1 Sep. 25, 2014

Related U.S. Application Data

(60) Provisional application No. 61/799,154, filed on Mar. 15, 2013, provisional application No. 61/799,976, filed on Mar. 15, 2013.

(51) Int. Cl.

| | |
|---|---|
| ***H04R 3/00*** | (2006.01) |
| ***G10K 11/16*** | (2006.01) |
| *H04R 29/00* | (2006.01) |

(52) U.S. Cl.

CPC ..... *H04R 3/005* (2013.01); *H04R 29/006* (2013.01); *H04R 2430/23* (2013.01); *H04R 2430/25* (2013.01)

(58) Field of Classification Search

CPC .... G10K 11/16; H04R 3/005; H04R 2430/23; H04R 2430/25; H04R 29/006

USPC ..... 375/240.25; 379/102.06, 406.01, 379/406.06; 381/58, 66, 92, 94.1, 94.2, 98, 381/94.03; 455/450; 600/450, 529

See application file for complete search history.

(56) References Cited

U.S. PATENT DOCUMENTS

| | | | | |
|---|---|---|---|---|
| 6,041,106 | A * | 3/2000 | Parsadayan et al. | 379/102.06 |
| 8,005,238 | B2 * | 8/2011 | Tashev et al. | 381/94.2 |
| 8,009,840 | B2 * | 8/2011 | Kellermann et al. | 381/92 |
| 8,229,135 | B2 * | 7/2012 | Sun et al. | 381/98 |
| 8,503,669 | B2 * | 8/2013 | Mao | 379/406.06 |
| 8,565,446 | B1 * | 10/2013 | Ebenezer | 381/94.1 |
| 8,824,692 | B2 * | 9/2014 | Sheerin et al. | 381/58 |

(Continued)

*Primary Examiner* — Gerald Gauthier

(74) *Attorney, Agent, or Firm* — Fiala & Weaver P.L.L.C.

(57) ABSTRACT

Methods, systems, and apparatuses are described for improved multi-microphone source tracking and noise suppression. In multi-microphone devices and systems, frequency domain acoustic echo cancellation is performed on each microphone input, and microphone levels and sensitivity are normalized. Methods, systems, and apparatuses are also described for improved acoustic scene analysis and source tracking using steered null error transforms, on-line adaptive acoustic scene modeling, and speaker-dependent information. Switched super-directive beamforming reinforces desired audio sources and closed-form blocking matrices suppress desired audio sources based on spatial information derived from microphone pairings. Underlying statistics are tracked and used to updated filters and models. Automatic detection of single-user and multi-user scenarios, and single-channel suppression using spatial information, non-spatial information, and residual echo are also described.

20 Claims, 12 Drawing Sheets

(56) References Cited

U.S. PATENT DOCUMENTS

| | | | | |
|---|---|---|---|---|
| 8,989,755 | B2 * | 3/2015 | Muruganathan et al. | 455/450 |
| 9,002,027 | B2 * | 4/2015 | Turnbull et al. | 381/92 |
| 9,036,826 | B2 * | 5/2015 | Thyssen | H04M 9/082 379/406.01 |
| 9,065,895 | B2 * | 6/2015 | Thyssen | H04M 9/082 |
| 2002/0041679 | A1 * | 4/2002 | Beaucoup | 379/406.01 |
| 2009/0024046 | A1 * | 1/2009 | Gurman et al. | 600/529 |
| 2009/0316924 | A1 * | 12/2009 | Prakash et al. | 381/66 |
| 2011/0096942 | A1 * | 4/2011 | Thyssen | G10L 21/0208 381/94.1 |
| 2013/0163781 | A1 * | 6/2013 | Thyssen | H04R 3/007 381/94.3 |
| 2013/0216056 | A1 * | 8/2013 | Thyssen | H04M 9/082 381/66 |
| 2013/0216057 | A1 * | 8/2013 | Thyssen | H04M 9/082 381/66 |
| 2013/0266078 | A1 * | 10/2013 | Deligiannis et al. | 375/240.25 |
| 2014/0286497 | A1 * | 9/2014 | Thyssen et al. | 381/66 |
| 2015/0071461 | A1 * | 3/2015 | Thyssen et al. | 381/94.1 |

* cited by examiner

300

700

MULTI-MICROPHONE SOURCE TRACKING AND NOISE SUPPRESSION

CROSS-REFERENCE TO RELATED APPLICATION(S)

This application claims priority to the following provisional applications, each of which is incorporated in its entirety by reference herein and made part of this application for all purposes: U.S. Provisional Patent Application No. 61/799,976, entitled "Use of Speaker Identification for Noise Suppression," filed Mar. 15, 2013, and U.S. Provisional Patent Application No. 61/799,154, entitled "Multi-Microphone Speakerphone Mode Algorithm," filed Mar. 15, 2013.

This application is related to the following applications, each of which is incorporated in its entirety by reference herein and made part of this application for all purposes: U.S. patent application Ser. No. 13/295,818, entitled "System and Method for Multi-Channel Noise Suppression Based on Closed-Form Solutions and Estimation of Time-Varying Complex Statistics," filed on Nov. 14, 2011, U.S. patent application Ser. No. 13/623,468, entitled "Non-Linear Echo Cancellation," filed on Sep. 20, 2012, and U.S. patent application Ser. No. 13/720,672, entitled "Acoustic Echo Cancellation Using Closed Form Solutions," filed on Dec. 19, 2012.

BACKGROUND

I. Technical Field

The present invention relates to multi-microphone source tracking and noise suppression in acoustic environments.

II. Background Art

A number of different speech and audio signal processing algorithms are currently used in cellular communication systems. For example, conventional cellular telephones implement standard speech processing algorithms such as acoustic echo cancellation, multi-microphone noise reduction, single-channel suppression, packet loss concealment, and the like, to improve speech quality. It is often beneficial for systems, such as cellular handsets with multiple microphones and speakerphone capabilities, to apply noise suppression to provide an enhanced speech signal for speech communication.

The use of speech processing applications on portable devices requires robustness to acoustic environments. It is often beneficial for such systems to apply noise suppression to provide an enhanced speech signal for speech communication. Acoustic scene analysis (ASA) is used for multi-microphone noise reduction (MMNR) and/or suppression, because it allows decisions to be made regarding the location and activity of the desired source. For multi-microphone noise suppression, the angle of incidence of the desired source (DS) is determined in order to appropriately steer a beamformer to the DS so as to better capture sound from the DS. Additionally, durations of DS activity/inactivity must be recognized in order to appropriately update statistical parameters of the system.

Traditional ASA methods utilize spatial information such as time difference of arrival (TDOA) or energy levels to locate acoustic sources. The DS location can be estimated by comparing observed measures to those expected for DS behavior. For example, a DS can be expected to show a spatial signature similar to a point source, with high energy relative to interfering sources. A major drawback to such ASA methods is that multiple acoustic sources may be present which behave similarly to the expected signature. In such scenarios the DS cannot be accurately differentiated from interfering sources.

BRIEF SUMMARY

Methods, systems, and apparatuses are described for improved multi-microphone source tracking and noise suppression, substantially as shown in and/or described herein in connection with at least one of the figures, as set forth more completely in the claims.

BRIEF DESCRIPTION OF THE DRAWINGS/FIGURES

The accompanying drawings, which are incorporated herein and form a part of the specification, illustrate embodiments and, together with the description, further serve to explain the principles of the embodiments and to enable a person skilled in the pertinent art to make and use the embodiments.

Embodiments will now be described with reference to the accompanying drawings. In the drawings, like reference numbers indicate identical or functionally similar elements.

Figure 1:
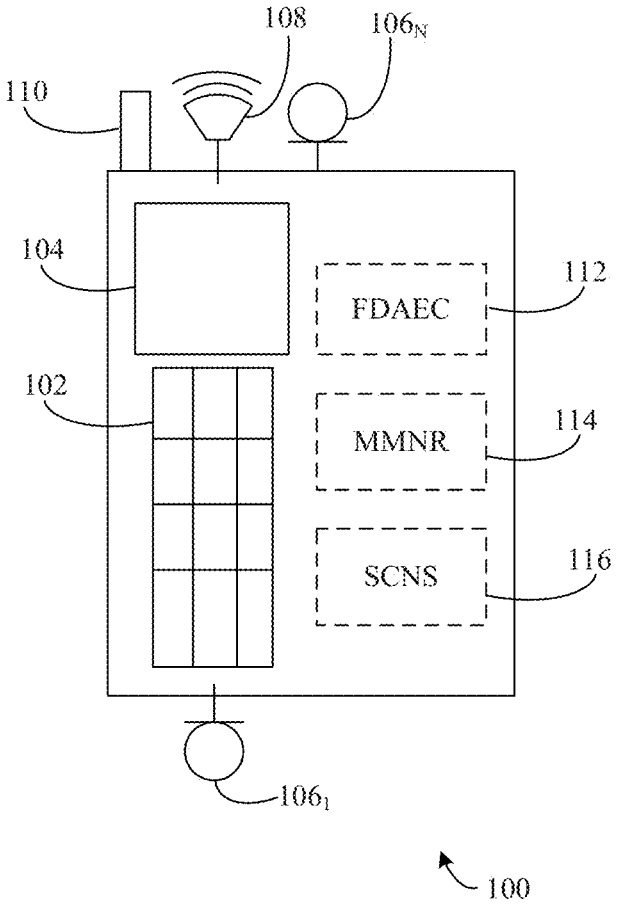
FIG. 1 shows a block diagram of a communication device, according to an example embodiment.

Additionally, the left-most digit(s) of a reference number identifies the drawing in which the reference number first appears.

DETAILED DESCRIPTION

I. Introduction

The present specification discloses numerous example embodiments. The scope of the present patent application is not limited to the disclosed embodiments, but also encompasses combinations of the disclosed embodiments, as well as modifications to the disclosed embodiments.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Further, descriptive terms used herein such as "about," "approximately," and "substantially" have equivalent meanings and may be used interchangeably.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Still further, it should be noted that the drawings/figures are not drawn to scale unless otherwise noted herein.

Still further, the terms "coupled" and "connected" may be used synonymously herein, and may refer to physical, operative, electrical, communicative and/or other connections between components described herein, as would be understood by a person of skill in the relevant art(s) having the benefit of this disclosure.

Numerous exemplary embodiments are now described. Any section/subsection headings provided herein are not intended to be limiting. Embodiments are described throughout this document, and any type of embodiment may be included under any section/subsection. Furthermore, it is contemplated that the disclosed embodiments may be combined with each other in any manner.

II. Example Embodiments

The example techniques and embodiments described herein may be adapted to various types of communication devices, communications systems, computing systems, electronic devices, and/or the like, which perform multi-microphone source tracking and/or noise suppression. For example, multi-microphone pairing configurations, multi-microphone frequency domain acoustic echo cancellation, source tracking, speakerphone mode detection, switched super-directive beamforming, adaptive blocking matrices, adaptive noise cancellation, and single-channel noise cancellation may be implemented in devices and systems according to the techniques and embodiments herein. Furthermore, additional structural and operational embodiments, including modifications and/or alterations, will become apparent to persons skilled in the relevant art(s) from the teachings herein.

In embodiments, a device (e.g., a communication device) may operate in a speakerphone mode during a communication session, such as a phone call, in which a near-end user provides speech signals to a far-end user via an up-link and receives speech signals from the far-end user via a down-link. The device may receive audio signals from two or more microphones, and the audio signals may comprise audio from a desired source (DS) (e.g., a source, user, or speaker who is talking to a far-end participant using the device) and/or from one or more interfering sources (e.g., background noise, far-end audio produced by a loudspeaker of the device, other speakers in the acoustic space, and/or the like). Situations may arise in which the DS and/or the interfering source(s) change position relative to the device (e.g., the DS moves around a conference room during a conference call, the DS is holding a smartphone operating in speakerphone mode in his/her hand and there is hand movement, etc.). The embodiments and techniques described provide for improvements for tracking the DS, improving DS speech signal quality and clarity, and reducing noise and/or non-DS audio from the speech signal transmitted to a far-end user.

For example, audio signals may be received by the microphones and provided as microphone inputs to the device. The microphones may be configured into pairs, each pair including a designated primary microphone and one of the remaining supporting microphones. The device may cancel and/or reduce acoustic echo, using frequency domain techniques, that is associated with a down-link audio signal (e.g., from a loudspeaker of the device) that is present in the microphone inputs. In embodiments, multiple instances of the acoustic echo canceller may be included in the device (e.g., one instance for each microphone input). A microphone-level normalization may be performed between the microphones with respect to the primary microphone to compensate for varying microphone levels present due to manufacturing processes and/or the like. The echo-reduced, normalized microphone inputs may then be provided to a processing front end.

With respect to front-end processing, the device may further perform a steered null error phase transform (SNE-PHAT) time delay of arrival (TDOA) estimation associated with the microphone inputs, and an up-link-down-link coherence estimation. This spatial information may be modeled on-line (e.g., using a Gaussian mixture model (GMM) or the like) to model the acoustic scene of the near-end and generate underlying statistics and probabilities. The microphone inputs, the spatial information, and the statistics and probabilities may be used to direct a switched super-directive beamformer to track the DS, and may also be used in closed-form solutions with an adaptive blocking matrices and an adaptive noise canceller to cancel and/or reduce non-DS audio components. In embodiments, the processing front end may also automatically detect whether the device is in a single-user speaker mode or a conference speaker mode and modify front-end processing accordingly. The processing front end may transmit a single-channel DS output to a processing back end for further noise suppression.

With respect to back-end processing, single-channel suppression may be performed. In addition to the single-channel DS output from the front end, the processing back end may also receive adaptive blocking matrix outputs and information indicative of the operating mode (e.g., single-user speaker mode or a conference speaker mode) from the front end. The processing back end may also receive information associated with a far-end talker's pitch period received from the down-link audio signal. The single-channel suppression techniques may utilize one or more of these received inputs in multiple suppression branches (e.g., a non-spatial branch, a spatial branch, and/or a residual echo suppression branch). The back end may provide a suppressed signal to be further processed and/or transmitted to a far-end user on the up-link. A soft-disable output may also be provided from the back end to the front end to disable one or more aspects of the front end based on characteristics of the acoustic scene in embodiments.

The techniques and embodiments described herein provide for such improvements in source tracking and microphone noise suppression for speech signals as described above.

For instance, methods, systems, and apparatuses are provided for microphone noise suppression for speech signals. In an example aspect, a system is disclosed. The system includes two or more microphones, an acoustic echo cancellation (AEC) component, and a front-end processing component. The two or more microphones are configured to receive audio signals from at least one audio source in an acoustic scene and provide an audio input for each respective microphone. The AEC component is configured to cancel acoustic echo for each microphone input to generate a plurality of microphone signals. The front-end processing component is configured to estimate a first time delay of arrival (TDOA) for one or more pairs of the microphone inputs using a steered null error phase transform. The front-end processing component is also configured to adaptively model the acoustic scene on-line using at least the first TDOA and a merit at the first TDOA to generate a second TDOA, and to select a single output of a beamformer associated with a first instance of the plurality of microphone signals based at least in part on the second TDOA.

In another example aspect, a system is disclosed. The system includes a frequency-dependent time delay of arrival (TDOA) estimator and an acoustic scene modeling component. The TDOA estimator is configured to determine one or more phases for each of one or more pairs of audio signals that correspond to one or more respective TDOAs using a steered null error phase transform. The TDOA estimator is also configured to designate a first TDOA from the one or more respective TDOAs based on a phase of the first TDOA having a highest prediction gain of the one or more phases. The acoustic scene modeling component is configured to adaptively model the acoustic scene on-line using at least the first TDOA and a merit at the first TDOA to generate a second TDOA.

In yet another example aspect, a system is disclosed. The system includes an adaptive blocking matrix component and an adaptive noise canceller. The adaptive blocking matrix component is configured to receive a plurality of microphone signals corresponding to one or more microphone pairs and to suppress an audio source (e.g., a DS) in at least one microphone signal to generate at least one audio source (e.g., DS) suppressed microphone signal (e.g., DS suppressed supporting microphone signal(s)). The adaptive blocking matrix component is also configured to provide the at least one audio source suppressed microphone signal to the adaptive noise canceller. The adaptive noise canceller is configured to receive a single output from a beamformer and to estimate at least one spatial statistic associated with the at least one audio source suppressed microphone signal. The adaptive noise canceller is further configured to perform a closed-form noise cancellation for the single output based on the estimate of the at least one spatial statistic and the at least one audio source suppressed microphone signals.

Various example embodiments are described in the following subsections. In particular, example device and system embodiments are described, followed by example embodiments for multi-microphone configurations. This is followed by a description of multi-microphone frequency domain acoustic echo cancellation embodiments and a description of example source tracking embodiments. Switched super-directive beamformer embodiments are subsequently described. Example adaptive noise canceller and adaptive blocking matrices are then described, followed by example single-channel suppression embodiments. An example processor circuit implementation is also described. Next, example operational embodiments are described, followed by further example embodiments. Finally, some concluding remarks are provided. It is noted that the division of the following description generally into subsections is provided for ease of illustration, and it is to be understood that any type of embodiment may be described in any subsection.

III. Example Device and System Embodiments

Systems and devices may be configured in various ways to perform multi-microphone source tracking and noise suppression. Techniques and embodiments are provided for implementing devices and systems with improved multi-microphone acoustic echo cancellation, improved microphone mismatch compensation, improved source tracking, improved beamforming, improved adaptive noise cancellation, and improved single-channel noise cancellation. For instance, in embodiments, a communication device may be used in a single-user speakerphone mode or a conference speakerphone mode (e.g., not in a handset mode) in which one or more of these improvements may be utilized, although it should be noted that handset mode embodiments are contemplated for the back-end single-channel suppression techniques described below, and for other handset mode operations as described herein.

FIG. 1 shows an example communication device 100 for implementing the above-referenced improvements. Communication device 100 may include an input interface 102, an optional display interface 104, a plurality of microphones $\mathbf{106}_1$-$\mathbf{106}_N$, a loudspeaker 108, and a communication interface 110. In embodiments, as described in further detail below, communication device 100 may include one or more instances of a frequency domain acoustic echo cancellation (FDAEC) component 112, a multi-microphone noise reduction (MMNR) component 114, and/or a single-channel suppression (SCS) component 116. In embodiments, communication device 100 may include one or more processor circuits (not shown) such as processor circuit 1100 of FIG. 11 described below.

In embodiments, input interface 102 and optional display interface 104 may be combined into a single, multi-purpose input-output interface, such as a touchscreen, or may be any other form and/or combination of known user interfaces as would understood by a person of skill in the relevant art(s) having the benefit of this disclosure.

Furthermore, loudspeaker 108 may be any standard electronic device loudspeaker that is configurable to operate in a speakerphone or conference phone type mode (e.g., not in a handset mode). For example, loudspeaker 108 may comprise an electro-mechanical transducer that operates in a well-known manner to convert electrical signals into sound waves for perception by a user. In embodiments, communication interface 110 may comprise wired and/or wireless communication circuitry and/or connections to enable voice and/or data communications between communication device 100 and other devices such as, but not limited to, computer networks, telecommunication networks, other electronic devices, the Internet, and/or the like.

While only two microphones are illustrated for the sake of brevity and illustrative clarity, plurality of microphones $106_1$-$106_N$ may include two or more microphones, in embodiments. Each of these microphones may comprise an acoustic-to-electric transducer that operates in a well-known manner to convert sound waves into an electrical signal. Accordingly, plurality of microphones $106_1$-$106_N$ may be said to comprise a microphone array that may be used by communication device 100 to perform one or more of the techniques described herein. For instance, in embodiments, plurality of microphones $106_1$-$106_N$ may include 2, 3, 4, . . . , to N microphones located at various locations of communication device 100. Indeed, any number of microphones (greater than one) may be configured in communication device 100 embodiments. As described herein, embodiments that include more microphones in plurality of microphones $106_1$-$106_N$ provide for greater directability and resolution of beamformers for tracking a desired source (DS). In other single-microphone embodiments (e.g., for handset modes), the back-end SCS 116 can be used by itself without MMNR 114.

In embodiments, frequency domain acoustic echo cancellation (FDAEC) component 112 is configured to provide a scalable algorithm and/or circuitry for two to many microphone inputs. Multi-microphone noise reduction (MMNR) component 114 is configured to include a plurality of sub-components for determining and/or estimating spatial parameters associated with audio sources, for directing a beamformer, for online modeling of acoustic scenes, for performing source tracking, and for performing adaptive noise reduction, suppression, and/or cancellation. In embodiments, SCS component 116 is configurable to perform single-channel suppression using non-spatial information, using spatial information, and/or using down-link signal information. Further details and embodiments of frequency domain acoustic echo cancellation (FDAEC) component 112, multi-microphone noise reduction (MMNR) component 114, and SCS component 116 are provided below.

While FIG. 1 is shown in the context of a communication device, the described embodiments may be applied to a variety of products that employ multi-microphone noise suppression for speech signals. Embodiments may be applied to portable products, such as smart phones, tablets, laptops, gaming systems, etc., to stationary products, such as desktop computers, office phones, conference phones, gaming systems, etc., and to car entertainment/navigation systems, as well as being applied to further types of mobile and stationary devices. Embodiments may be used for MMNR and/or suppression for speech communication, for enhanced audio source tracking, for enhancing speech signals as a pre-processing step for automated speech processing applications, such as automatic speech recognition (ASR), and in further types of applications.

Figure 2:
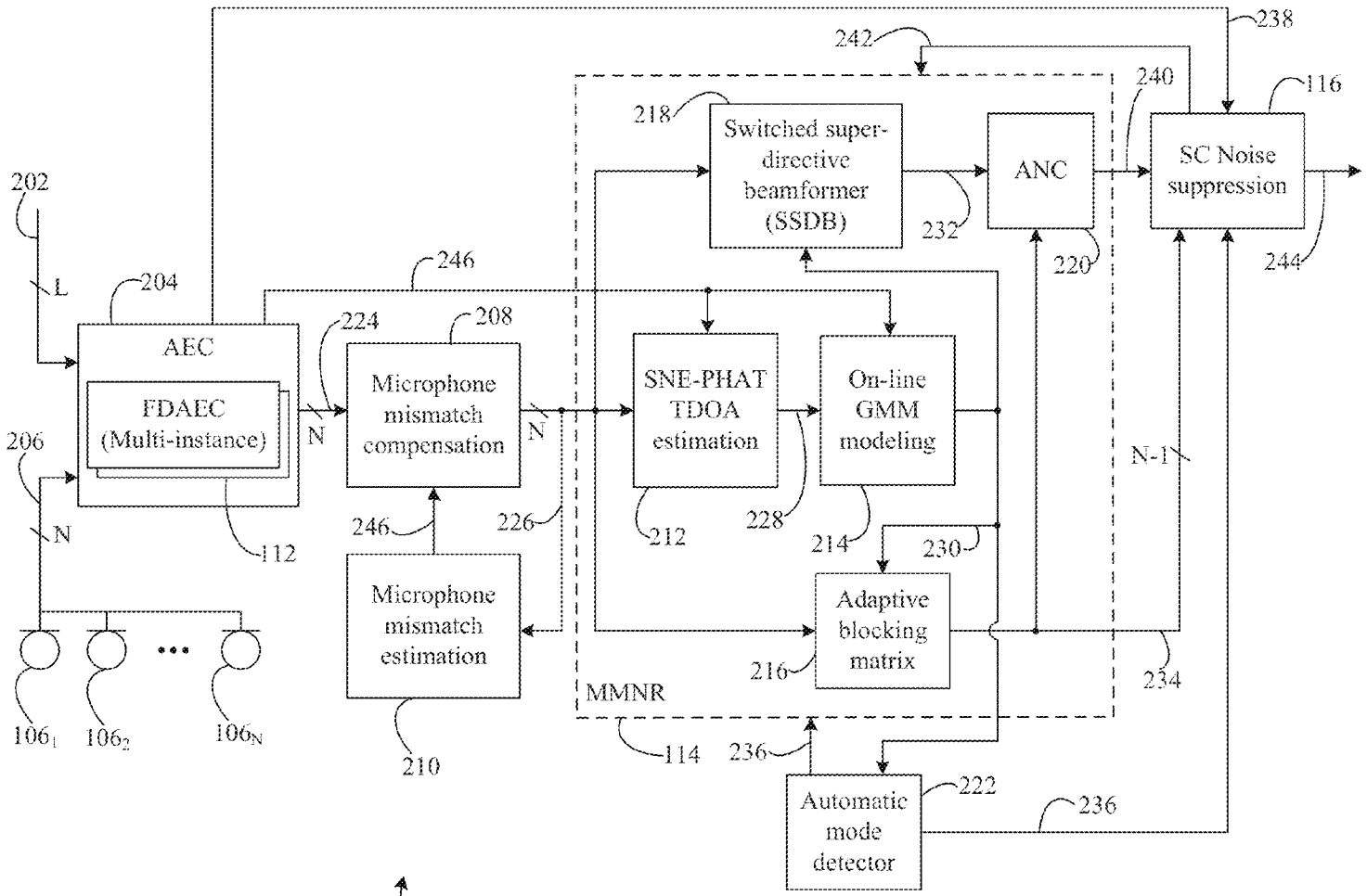
FIG. 2 shows a block diagram of an example system that includes multi-microphone configurations, frequency domain acoustic echo cancellation, source tracking, switched super-directive beamforming, adaptive blocking matrices, adaptive noise cancellation, and single-channel suppression, according to example embodiments.

Turning now to FIG. 2, a system 200 is shown. System 200 may be a further embodiment of a portion of communication device 100 of FIG. 1. For example, in embodiments, system 200 may be included, in whole or in part, in communication device 100. As shown, system 200 includes plurality of microphones $106_1$-$106_N$, FDAEC component 112, MMNR component 114, and SCS component 116. System 200 also includes an acoustic echo cancellation (AEC) component 204, a microphone mismatch compensation component 208, a microphone mismatch estimation component 210, and an automatic mode detector 222. In embodiments, FDAEC component 112 may be included in AEC component 204 as shown, and references to AEC component 204 herein may inherently include a reference to FDAEC component 112 unless specifically stated otherwise. MMNR component 114 includes an SNE-PHAT TDOA estimation component 212, an on-line GMM modeling component 214, an adaptive blocking matrix component 216, a switched super-directive beamformer (SSDB) 218, and an adaptive noise canceller (ANC) 220. In some embodiments, automatic mode detector 222 may be structurally and/or logically included in MMNR component 114.

In embodiments, MMNR component 114 may be considered to be the front-end processing portion of system 200 (e.g., the "front end"), and SCS component 116 may be considered to be the back-end processing portion of system 200 (e.g., the "back end"). For the sake of simplicity when referring to embodiments herein, AEC component 204, FDAEC component 112, microphone mismatch compensation component 208, and microphone mismatch estimation component 210 may be included in references to the front end.

As shown in FIG. 2, plurality of microphones $106_1$-$106_N$ provides N microphone inputs 206 to AEC 204 and its instances of FDAEC 112. AEC 204 also receives a down-link signal 202 as an input, which may include one or more down-link signals "L" in embodiments. AEC 204 provides echo-cancelled outputs 224 to microphone mismatch compensation component 208, provides residual echo information 238 to SCS component 116, and provides down-link-up-link coherence information 246 (i.e., an estimate of the coherence between the downlink and uplink signals as a measure of echo presence) to SNE-PHAT TDOA estimation component 212 and/or on-line GMM modeling component 214. Microphone mismatch estimation component 210 provides estimated microphone mismatch values 246 to microphone mismatch compensation component 208. Microphone mismatch compensation component 208 provides compensated microphone outputs 226 (e.g., normalized microphone outputs) to microphone mismatch estimation component 210 (and in some embodiments, not shown, microphone mismatch estimation component 210 may also receive echo-cancelled outputs 224 directly), to SNE-PHAT TDOA estimation component 212, to adaptive blocking matrix component 216, and to SSDB 218. SNE-PHAT TDOA estimation component 212 provides spatial information 228 to on-line GMM modeling component 214, and on-line GMM modeling component 214 provides statistics, mixtures, and probabilities 230 based on acoustic scene modeling to automatic mode detector 222, to adaptive blocking matrix component 216, and to SSDB 218. SSDB 218 provides a DS single output selected signal 232 to ANC 220, and adaptive blocking matrix component 216 provides non-DS beam signals 234 to ANC 220, as well as to SCS component 116. Automatic mode detector 222 provides a mode enable signal 236 to MMNR component 114 and to SCS component 116, ANC 220 provides a noise-cancelled DS signal 240 to SCS component 116, and SCS component 116 provides a suppressed signal 244 as an output for subsequent processing and/or up-link transmission. SCS component 116 also provides a soft-disable output 242 to MMNR component 114.

In embodiments, plurality of microphones $106_1$-$106_N$ of FIG. 2 may include 2, 3, 4, . . . , to N microphones located at various locations of system 200. The arrangement and orientation of plurality of microphones $106_1$-$106_N$ may be referred to as the microphone geometry(ies). As noted above, plurality of microphones $106_1$-$106_N$ may be configured into pairs, each pair including a designated primary microphone and one of the remaining supporting microphones. Techniques and embodiments for the operation and configuration of plurality of microphones $106_1$-$106_N$ are described in further detail below in a subsequent section.

AEC component 204 and FDAEC component 112 may each be configured to perform acoustic echo cancellation associated with a down-link audio source(s) and plurality of microphones $\mathbf{106}_1$-$\mathbf{106}_N$. In some embodiments, AEC component 204 may perform one or more standard acoustic echo cancellation processes, as would understood by a person of ordinary skill in the relevant art(s) having the benefit of this disclosure. According to the embodiments herein, FDAEC component 112 is configured to perform frequency domain acoustic echo cancellation, as described in further detail in a following section. AEC component 204 may include multiple instances of FDAEC component 112 (e.g., one instance for each microphone input 206). In embodiments, AEC component 204 and/or FDAEC component 112 are configured to provide residual echo information 238 to SCS component 116, and in embodiments, information related to pitch period(s) associated with far-end talkers from down-link signal 202 may be included in residual echo information 238. In some embodiments, a correlation between the outputs of FDAEC component 112 (echo-cancelled outputs 224) at the pitch period(s) of down-link signal 202 may be performed by AEC component 204 and/or FDAEC component 112 in a manner consistent with the embodiments described below with respect to FIG. 10, and the resulting correlation information may be provided to SCS component 116 as residual echo information 238. AEC component 204 and/or FDAEC component 112 may also be configured to provide up-link-down-link coherence information 246 to SNE-PHAT TDOA estimation component 212 and/or on-line GMM modeling component 214. Techniques and embodiments for the operation and configuration of FDAEC component 112 are described in further detail below in a subsequent section.

Microphone mismatch compensation component 208 is configured to compensate or adjust microphones of plurality of microphones $\mathbf{106}_1$-$\mathbf{106}_N$ in order to make the output level and/or sensitivity of each microphone in plurality of microphones $\mathbf{106}_1$-$\mathbf{106}_N$ be approximately equal, in effect "normalizing" the microphone output and sensitivity levels. Techniques and embodiments for the operation and configuration of microphone mismatch compensation component 208 are described in further detail below in a subsequent section.

Microphone mismatch estimation component 210 is configured to estimate the output level and/or sensitivity of the primary microphone, as described herein, and then estimate a difference or variance of each supporting microphone with respect to the primary microphone. Thus, in embodiments, the microphones of plurality of microphones $\mathbf{106}_1$-$\mathbf{106}_N$ may be normalized prior to front-end spatial processing. Techniques and embodiments for the operation and configuration of microphone mismatch estimation component 210 are described in further detail below in a subsequent section.

MMNR component 114 is configured to perform front-end, multi-microphone noise reduction processing in various ways. MMNR component 114 is configured to receive a soft-disable output 242 from SCS component 116, and is also configured to receive a mode enable signal 236 from automatic mode detector 222. The mode enable signal and the soft-disable output may indicate that alterations in the functionality of MMNR component 114 and/or one or more of its sub-components. For example, MMNR component 114 and/or one or more of its sub-components may be configured to go off-line or become disabled when the soft-disable output is asserted, and to come back on-line or become enabled when the soft-disable output is de-asserted. Similarly, the mode enable signal may cause an adaptation in MMNR component 114 and/or one or more of its sub-components to alter models, estimations, and/or other functionality as described herein.

SNE-PHAT TDOA estimation component 212 is configured to estimate spatial properties of the acoustic scene with respect to one or more microphone pairs, one or more talkers, such as TDOA and up-link-down-link coherence. SNE-PHAT TDOA estimation component 212 is configured to generate these estimations using a steered null error phase transform technique based on directional prediction gain. Techniques and embodiments for the operation and configuration of SNE-PHAT TDOA estimation component 212 are described in further detail below in a subsequent section.

On-line GMM modeling component 214 is configured to adaptively model the acoustic scene using spatial property estimations from SNE-PHAT TDOA estimation component 212 (e.g., TDOA), as well as other information such as up-link-down-link coherence information 246, in embodiments. On-line GMM modeling component 214 is further configured to generate underlying statistics of features providing information which discriminates between a DS and interfering sources. For instance, a TDOA (either pairwise for microphones, or jointly considered), a merit at the TDOA (e.g., a merit function value related to TDOA, i.e., a cost delay of arrival (CDOA)), a log likelihood ratio (LLR) related to the DS, a coherence value, and/or the like, may be used in modeling the acoustic scene. Techniques and embodiments for the operation and configuration of on-line GMM modeling component 214 are described in further detail below in a subsequent section.

Adaptive blocking matrix component 216 is configured to utilize closed-form solutions to track underlying statistics (e.g., from on-line GMM modeling component 214). Adaptive blocking matrix component 216 is configured to track according microphone pairs as described herein, and to provide pairwise, non-DS beam signals 234 (i.e., speech suppressed signals) to ANC 220. Techniques and embodiments for the operation and configuration of adaptive blocking matrix component 216 are described in further detail below in a subsequent Section.

SSDB 218 is configured receive microphone inputs, and to select and pass, as an output, a DS single-output selected signal 232 to ANC 220. That is, a single beam associated with the microphone inputs having the best DS signal is provided by SSDB 218 to ANC 220. SSDB 218 is also configured to select the DS single beam (i.e., a speech reinforced signal) based at least in part on one or more inputs received from on-line GMM modeling component 214. Techniques and embodiments for the operation and configuration of SSDB 218 are described in further detail below in a subsequent section.

ANC 220 is configured to utilize the closed-form solutions in conjunction with adaptive blocking matrix component 216 and to receive speech reinforced signal inputs from SSDB 218 (i.e., DS single-output selected signal 232) and speech suppressed signal inputs from adaptive blocking matrix component 216 (i.e., non-DS beam signals 234). ANC 220 is configured to suppress the interfering in the speech reinforced signal based on the speech suppressed signals. ANC 220 is configured to provide the resulting noise-cancelled DS signal (240) to SCS component 116.

Automatic mode detector 222 is configured to automatically determine whether the communication device (e.g., communication device 100) is operating in a single-user speakerphone mode or a conference speakerphone mode. Automatic mode detector 222 is also configured to receive statistics, mixtures, and probabilities 230 (and/or any other information indicative of talkers' voices) from on-line GMM modeling component 214, or from other components and/or sub-components of system 200 to make such a determination.

Further, as shown in FIG. 2, automatic mode detector 222 outputs mode enable signal 236 to SCS component 116 and to MMNR component 114 in accordance with the described embodiments. Techniques and embodiments for the operation and configuration of automatic mode detector 222 are described in further detail below in a subsequent section.

SCS component 116 is configured to perform single-channel suppression on the DS signal 240. SCS component 116 is configured to perform single-channel suppression using non-spatial information, using spatial information, and/or using down-link signal information. SCS is also configured to determine spatial ambiguity in the acoustic scene, and to provide a soft-disable output (242) indicative of acoustic scene spatial ambiguity. As noted above, in embodiments, one or more of the components and/or sub-components of system 200 may be configured to be dynamically disabled based upon enable/disable outputs received from the back end, such as soft-disable output 242. The specific system connections and logic associated therewith is not shown for the sake of brevity and illustrative clarity in FIG. 2, but would be understood by persons of skill in the relevant art(s) having the benefit of this disclosure.

Further example techniques and embodiments of communication device 100 and system 200 will now be described in the Sections that follow.

IV. Example Multi-Microphone Configuration Embodiments

Techniques are also provided for configuring multiple microphones in a communication device. As described above, in embodiments, a communication device may include two or more microphones for receiving audio inputs. However, traditional microphone pairing solutions do not take into account the benefits of the source tracking and beamformer techniques described herein. The multiple microphones configuration techniques provided herein allow for a full utilization of the other inventive techniques described herein by configuring microphone pair as follows.

As described above with respect to FIGS. 1 and 2, plurality of microphones 1061-106N may include two or more microphones. In embodiments, a microphone of plurality of microphones 1061-106N is designated as the primary microphone, and each other microphone is designated as a supporting microphone. This designation may be performed and/or set by a manufacturer, in firmware, and/or by a user. For instance, a manufacturer of a smart phone may designate the microphone closest to a user's mouth when in a handset mode as the primary microphone. Similarly, a manufacturer of a conference phone may designate the microphone with the closest approximation to free-field properties as the primary microphone. In some embodiments, the primary microphone may be adaptively designated as the microphone that is closest to the DS. For instance, the primary microphone may be adaptively designated based on spatial information (e.g., TDOA) values for all microphones.

According to embodiments, plurality of microphones $\mathbf{106}_1$-$\mathbf{106}_N$ may be configured as a number (N−1) of microphone pairs where each supporting microphone is paired with the primary microphone to form N−1 pairs. For instance, referring to FIG. 1, microphone $\mathbf{106}_1$ may be designated as the primary microphone and microphone $\mathbf{106}_N$ may be designated as the supporting microphone. In dual microphone embodiments, e.g., with two microphones $\mathbf{106}_1$ and $\mathbf{106}_N$ shown in FIG. 1, a single pair is formed. In embodiments with N>2 microphones, such as in the illustrated embodiment of FIG. 2, microphone $\mathbf{106}_1$ may be designated as the primary microphone, and $\mathbf{106}_2$ microphone $\mathbf{106}_N$ may be designated as the supporting microphones. Accordingly microphone pairs are created as follows: pair 1 comprises microphone $\mathbf{106}_1$ and microphone $\mathbf{106}_2$, and pair 2 comprises microphone $\mathbf{106}_1$ and microphone $\mathbf{106}_N$. Advantageously, with such a configuration, various techniques described herein can be further improved. For example, as described herein, various components of system 200 may be configured to suppress the DS in every supporting microphone for "cleaner" noise signals. Accordingly, the "cleaner" noise signals may then be provided to an ANC (e.g., ANC 220) for additional suppression.

Additionally, in embodiments, the beams representative of microphone pair signal inputs may be compensated (positively and/or negatively) to account for manufacturing-related variances in microphone level. For instance, in an embodiment with four microphones (e.g., microphone $\mathbf{106}_1$, microphone $\mathbf{106}_2$, microphone $\mathbf{106}_3$, and microphone $\mathbf{106}_N$), each microphone may operate at different level due to manufacturing variations. In this example embodiment, where microphone $\mathbf{106}_1$ is the primary microphone, microphone $\mathbf{106}_2$, microphone $\mathbf{106}_3$, and microphone $\mathbf{106}_N$ (the supporting microphones) may each operate at a level that is up to approximately +/−6 dB with respect to the level of microphone $\mathbf{106}_1$ if every microphone has a manufacturing variation of +/−3 dB. Accordingly, microphone mismatch estimation component 210 is configured to detect the variance or mismatch of each supporting microphone with respect to the primary microphone. In an example scenario, microphone mismatch estimation component 210 may detect the variance (with respect to primary microphone $\mathbf{106}_1$) of microphone $\mathbf{106}_2$ as +1 dB, of microphone $\mathbf{106}_3$ as +2 dB, and of microphone $\mathbf{106}_N$ as −1.5 dB. Microphone mismatch estimation component 210 may then provide these mismatch values to microphone mismatch compensation component 208 which may adjust the level of the supporting microphones (i.e., −1 dB for microphone $\mathbf{106}_2$, −2 dB for microphone $\mathbf{106}_3$, and +1.5 dB for microphone $\mathbf{106}_N$) in order to "normalize" the supporting microphone levels to approximately match the primary microphone level. Microphone mismatch compensation component 208 may then provide the adjusted, compensated signals 226 to other components of system 200.

V. Example Multi-Microphone FDAEC Embodiments

Techniques are also provided for performing frequency domain acoustic echo cancellation (FDAEC) for multiple microphone inputs. That is, in embodiments, a communication device may include two or more microphones for receiving audio inputs. However, with additional microphone inputs comes additional complexity and memory/computing requirements; processing requirements and complexity may scale approximately linearly with the addition of microphone inputs. The techniques provided herein allow for only a marginal increase in complexity and memory/computing requirements, while still providing substantially equivalent performance.

One solution for handling acoustic echo is to group acoustic background noise and acoustic echo together and consider both noise sources and not distinguish them. The acoustic echo would essentially appear as a point noise source from the perspective of the multiple microphones, and the spatial noise suppression would be expected to simply put a null in that direction. This may, however, not be an efficient way of using the information available in the system as the information in the down-link (a commonly used echo reference signal) is generally capable of providing excellent (e.g., 20-30 dB) echo suppression.

A preferable use of available information is to use the spatial filtering to suppress noise sources without availability of separate reference information instead of "wasting" the spatial resolution to suppress the acoustic echo. A given number of microphones may only offer a certain spatial resolution, similarly to how an FIR filter of a given order only offers a certain spectral resolution (e.g. a 2nd order FIR filter has limited ability to form arbitrary spectral selectivity). Complexity considerations may also factor into the underlying selection of an algorithm. There may be a desire to have an algorithm that scales with the number of microphones in the sense that the complexity does not become intractable as the number of microphones is increased. Having AEC on each microphone path may be a concern from a complexity perspective as both memory and computational complexity for acoustic echo cancellation will grow linearly with the number of microphones. A potential compromise may be to deploy multiple instances of a simpler AEC on each microphone path to remove the majority of acoustic echo by exploiting the information in the down-link signal, and then let the spatial noise suppression freely suppress any undesirable sound source (acoustic background noise or acoustic echo). In essence, any source not identified as the DS by a DS tracker may be suppressed spatially. However, without AEC on the individual microphone paths, the acoustic echo may become a concern for tracking the DS reliably as the acoustic echo is often higher in level than the DS with a device used in a speakerphone mode.

Additionally, if there is uncertainty in the delay between microphones, it becomes far more complex to avoid false detecting acoustic echo as the DS. Therefore, in the interest of reliable DS tracking, it as advantageous to have AEC components on individual microphone paths prior to the DS tracking.

As described above with respect to FIGS. 1 and 2, multi-instance FDAEC component 112 is configured to perform frequency domain acoustic echo cancellation for a plurality of microphone inputs $\mathbf{106}_1$-$\mathbf{106}_N$. In embodiments, multi-instance FDAEC component 112 is configured to include an FDAEC subcomponent to perform FDAEC on each microphone input. For example, in an embodiment with four microphone inputs $\mathbf{106}_1$-$\mathbf{106}_N$, multi-instance FDAEC component 112 may be configured to perform FDAEC on each of the four microphone inputs.

In embodiments, multi-instance FDAEC component 112 implements a multi-microphone FDAEC algorithm and structure that scales efficiently and easily from two to many microphones without a need for major algorithm modifications in order for the complexity to remain under control. Therefore, support for an increasing number of microphones for improved performance at customers' request, seamlessly and without a need for large investments in optimization or algorithm customization/re-design, is realized. This may be advantageously accomplished through recognition of the physical properties of the echo signals, and this recognition may be translated into an efficiently organized, dependent multi-instance FDAEC structure/algorithm such that the complexity grows slowly with the addition of more microphones, and yet retains individual FDAECs and performance thereof on each microphone path.

A traditional multi-instance FDAEC may be implemented as $N_{mic}$ independent FDAECs, with $N_{mic}$ being the number of microphones. This will result in the state memory and computational complexity of the multi-instance FDAEC being $N_{mic}$, times the state memory and computational complexity of the FDAEC of a single-microphone system. For example, three microphones triples the state memory and computational complexity. Potentially, this can inhibit computational complexity and efficient memory usage due to the complexity involved with an increasing number of microphones, and result in an architecture that does not scale well with an increasing number of microphones.

The traditional, independent multi-instance FDAEC essentially needs to solve the equation:

$$\underline{H}_{n_{mic}}(f) = \left(\underline{R}_X(f)\right)^{-1} \cdot r_{D_{n_{mic}},X^*}(f) \tag{1}$$

per microphone $n_{mic}=1, \ldots N_{mic}$, and hence estimate the statistics $\underline{R}_X(f)$ and $$r_{D_{n_{mic}},X^*}(f)$$

per microphone. These statistics are may be estimated by adaptive running means. For example:

$$\begin{aligned} \underline{R}_{X,n_{mic}}(m,f) &= \alpha_{n_{mic}}(m,f)\cdot \underline{R}_{X,n_{mic}}(m-1,f) + \\ &\quad (1-\alpha_{n_{mic}}(m,f))\cdot \underline{X}^*(m,f)\cdot \underline{X}(m,f)^{\bar{T}} \\ r_{D_{n_{mic}},X^*}(m,f) &= \alpha_{n_{mic}}(m,f)\cdot r_{D_{n_{mic}},X^*}(m-1,f) + \\ &\quad (1-\alpha_{n_{mic}}(m,f))\cdot D_{n_{mic}}(m,f)\cdot \underline{X}^*(m,f), \end{aligned} \tag{2, 3}$$

for $n_{mic}=1, \ldots N_{mic}$, and although technically $\underline{R}_{X,n_{mic}}(f)$ is only a function of the down-link signal X(f) (and not $D_{n_{mic}}(f)$), the adaptive leakage factor $\alpha_{n_{mic}}(m,f)$ is advantageously a function of the coherence at frequency f between the up-link and down-link signals, hereby indirectly making $\underline{R}_X(f)$ dependent on the up-link signal, and hence unique for each microphone. Hence, there is a need to maintain, store, and invert the matrix $\underline{R}_X(f)$ independently per microphone. Hence, the "independent" aspect of the traditional multi-instance FDAEC is clearly revealed, and the FDAECs are treated as completely independent instances of FDAEC, requiring solving $N_{mic}$ matrix equations of the form:

$$\underline{H}_{n_{mic}}(m,f) = \left(\underline{R}_{X,n_{mic}}(m,f)\right)^{-1} \cdot r_{D_{n_{mic}}},\, x^*(m,f) \tag{4}$$

per frequency f. For example, it is clear in the traditional, independent multi-instance FDAEC calculations, the correlation matrix is independent of the microphones used, but in practice, the adaptive leakage factor is dependent on individual microphone signals.

The state memory and computational complexity of the traditional independent multi-instance FDAEC can be reduced significantly if a common adaptive leakage factor is used across all microphones at a given frequency f. According to an embodiment, a dependent multi-instance FDAEC (e.g., multi-instance FDAEC component 112 of FIGS. 1 and 2) provides an improvement in state memory and computational complexity. For instance, in the dependent multi-instance FDAEC, only a single matrix $\underline{R}_X(f)$ needs to be stored, maintained, and inverted per frequency f:

$$\underline{\underline{R}}_X(m, f) = \alpha(m, f) \cdot \underline{\underline{R}}_X(m-1, f) + (1-\alpha(m, f)) \cdot \underline{X}^*(m, f) \cdot \underline{X}(m, f)^T \quad (5, 6)$$

$$\underline{r}_{D_{n_{mic}}, X^*}(m, f) = \alpha(m, f) \cdot \underline{r}_{D_{n_{mic}}, X^*}(m-1, f) + (1-\alpha(m, f)) \cdot D_{n_{mic}}(m, f) \cdot \underline{X}^*(m, f)^T,$$

where only the latter (i.e., $$\underline{r}_{D_{n_{mic}}}, X^*(m, f))$$

needs to be stored and maintained for each microphone $n_{mic}=1, \ldots N_{mic}$. The adaptive leakage factor essentially reflects the degree of acoustic echo present at a given microphone, and the fact that the acoustic echo originates from a single source (e.g., the loudspeaker in conference mode) indicates that the use of a single, common adaptive leakage factor across all microphones per frequency f provides an efficient and comparable solution, assuming that the microphones are not acoustically separated (i.e., are reasonably close).

If the adaptive leakage factor is derived from the main (also referred to as the primary or reference) microphone, then the dependent multi-instance FDAEC can be considered as one instance of FDAEC on the primary microphone with calculation of $$\underline{\underline{R}}_X(m, f) = \alpha(m, f) \cdot \underline{\underline{R}}_X(m-1, f) + (1-\alpha(m, f)) \cdot \underline{X}^*(m, f) \cdot \underline{X}(m, f)^T \quad (7, 8)$$

$$\underline{r}_{D_1, X^*}(m, f) = \alpha(m, f) \cdot \underline{r}_{D_1, X^*}(m-1, f) + (1-\alpha(m, f)) \cdot D_1(m, f) \cdot \underline{X}^*(m, f),$$

$$\underline{\underline{R}}_{inv\,X}(m,f) = (\underline{\underline{R}}_X(m,f))^{-1}, \quad (9)$$

and $$\underline{H}_1(m,f) = \underline{\underline{R}}_{inv\,X}(m,f) \cdot \underline{r}_{D_1, X^*}(m,f), \quad (10)$$

where superscript "T" denotes the non-conjugate transpose, and with support of remaining, non-primary microphones only requiring the additional maintenance and storage of $$\underline{r}_{D_{n_{mic}}, X^*}(m, f) = \alpha(m, f) \cdot \underline{r}_{D_{n_{mic}}, X^*}(m-1, f) + (1-\alpha(m, f)) \cdot D_{n_{mic}}(m, f) \cdot \underline{X}^*(m, f) \quad (11)$$

and the calculation of $$\underline{H}_{n_{mic}}(m, f) = \underline{\underline{R}}_{inv\,X}(m, f) \cdot \underline{r}_{D_{n_{mic}}, X^*}(m, f) \quad (12)$$

per additional microphone. In the context of multi-microphone implementations, these non-primary microphones may be referred as supporting microphones. The dependent multi-instance FDAEC is consistent with the single-microphone FDAEC in that it is a natural extension thereof, and only requires a small incremental maintenance and storage consideration with each additional supporting microphone vector, and no additional matrix inversions are required for additional supporting microphones. That is, in the dependent multi-instance FDAEC described herein, the state memory and computational complexity grows far slower than the independent multi-instance FDAEC with increasing numbers of microphones.

The technique of the dependent, multi-instance FDAEC may also be applied to a $2^{nd}$ stage non-linear FDAEC function. Additionally, in the case of multiple statistical trackers, e.g. fast and slow, with different leakage factors, the dependent, multi-instance FDAEC techniques maybe applied on a per-tracker basis. For instance, in the case of dual trackers, two matrices would be maintained, stored, and inverted per frequency f, independently of the number of microphones.

VI. Example Source Tracking Embodiments

Techniques are also provided for improved source tracking for speakerphone modes (single-user modes and/or conference modes) operation of a communication device. That is, in embodiments, a communication device may receive audio inputs from multiple sources such as, persons speaking or speakers, background sources, etc., concurrently, sequentially, and/or in an overlapping manner. In such cases, the communication device may track a primary speaker (i.e., a desired source (DS)) in order to improve the source quality of the DS. The techniques provided herein allow a communication device to improve DS tracking, improve beamformer direction, and utilize statistics to improve cancellation and/or reduction of interfering sources such as background noise and background speakers.

1. Example Source Tracking Embodiments

As described above with respect to FIG. 1, SNE-PHAT TDOA estimation component 212 is configured to estimate the time delay of arrival (TDOA) of audio signals from two or more microphones (e.g., microphone inputs 206). In embodiments, SNE-PHAT TDOA estimation component 212 is configured to estimate the TDOA by utilizing a steered null error (SNE) phase transform (PHAT), referred to herein as "SNE-PHAT." For example, in an embodiment with four microphone inputs 206, SNE-PHAT TDOA estimation component 212 may be configured to utilize microphone pairs of the four microphone inputs to determine a direction for an audio source(s) with the largest potential nulling of power instead of the largest potential positive reinforcement (as in traditional solutions).

In the described embodiments, SNE-PHAT TDOA estimation component 212 provides a more accurate TDOA estimate by using a merit function (i.e., a merit at the time delay of arrival (TDOA)) based on directional prediction gain with a more well-defined maximum and readily facilitates a robust frequency-dependent TDOA estimation, naturally exploiting spatial aliasing properties. Microphone pairs may be used to determine source direction, and the potential nulling of power may be determined using frequency-based analysis. In embodiments, SNE-PHAT TDOA estimation component 212 is configured to equalize the spectral envelope and provide a high level of processing for raw TDOA data to differentiate the DS from an interfering source. The TDOA may be estimated using a full-band approach and/or with frequency resolution by proper smoothing of frequency-dependent correlations in time. For example, the frequency-dependent TDOA may be found by searching around the full-band TDOA within the first spatial aliasing side lobe, as shown in further detail below.

Figure 3:
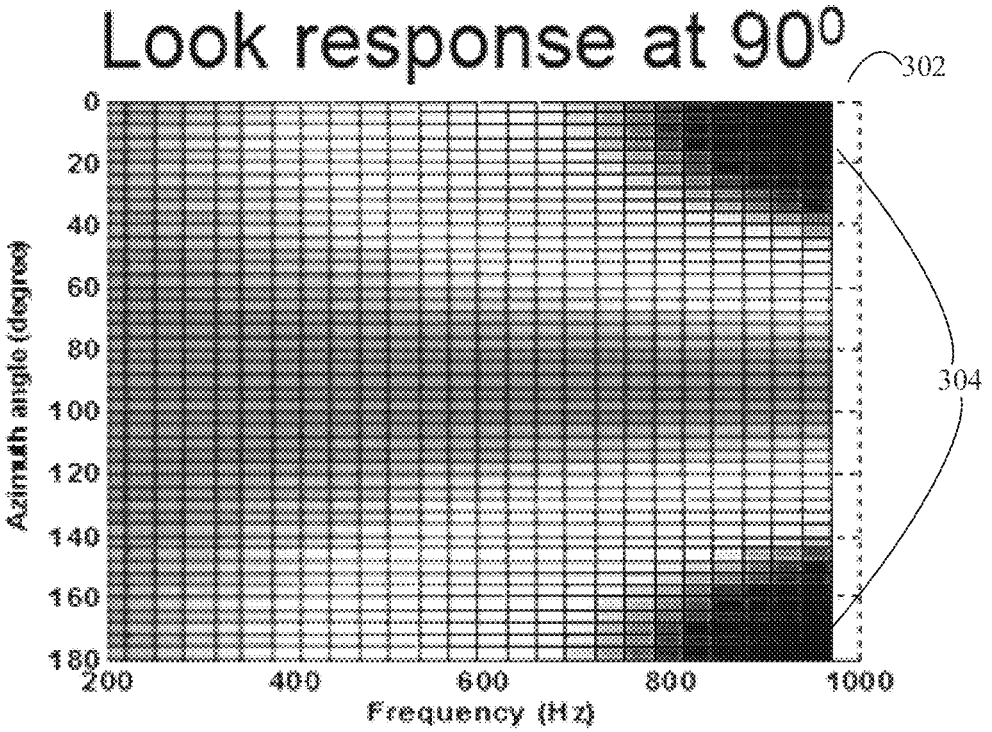
FIG. 3 shows an example graphical plot of null error response for source tracking, according to an example embodiment.
Figure 3:
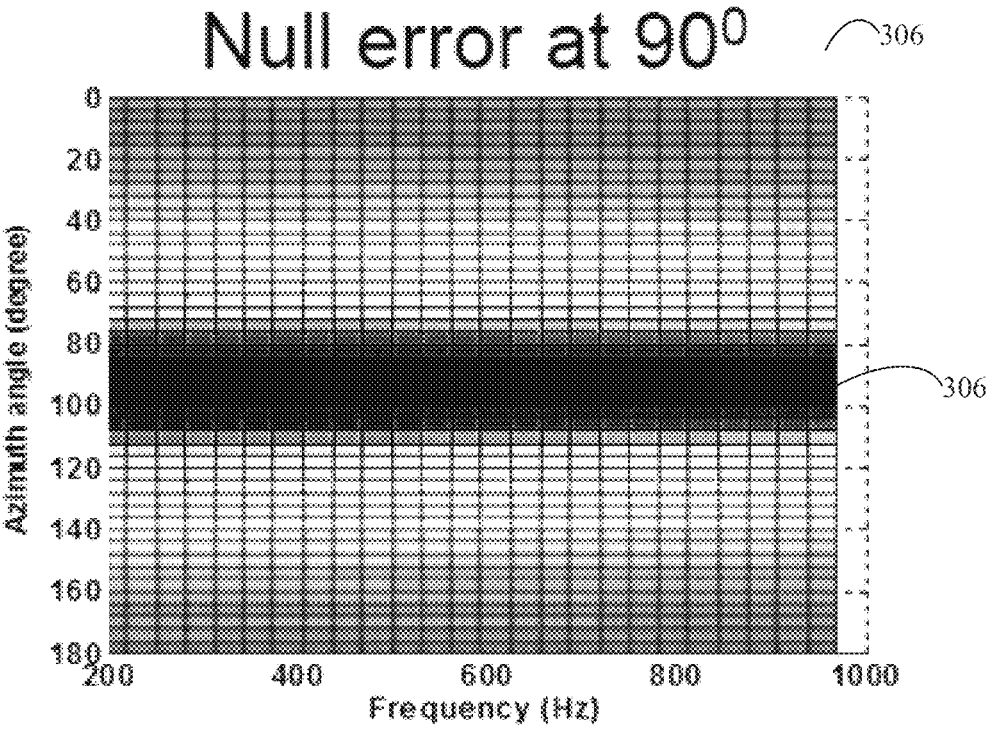

FIG. 3 shows a comparison of spatial resolution for determining TDOA between the SNE-PHAT techniques described herein and a conventional steered response power-phase transform (SRP-PHAT) implementing a steered-look response that is widely used as source tracking algorithm for audio applications. As illustrated, the SNE-PHAT technique provides improved tracking accuracy for a given number of microphones because the SNE-PHAT NULL error has better spatial resolution than the steered-look response. For example, FIG. 3 shows a steered-look response plot 302 in contrast to a null error plot 306 using SNE-PHAT techniques. As can be seen, the frequency-dependent SNE-PHAT techniques provide more uniform, consistent results across frequencies than the steered-look algorithm. While both algorithms have similar computational complexity, SNE-PHAT provides a frequency dependent TDOA determination, whereas SRP-PHAT does not.

SNE-PHAT TDOA estimation component 212 may be configured to perform the above-described techniques in various ways. For instance, in an embodiment, SNE-PHAT TDOA estimation component 212 scans the frequency domain phases corresponding to time delays of the audio inputs (e.g., microphone signals from microphone inputs 206) and selects the TDOA "τ", that, with optimal gain, allows the highest prediction gain of one microphone signal, $Y_2(\omega)$, from another microphone signal, $Y_1(\omega)$. In the frequency domain, for a given frequency ω, the delay τ becomes a phase shift, e.g., a multiplication operation by $e^{j\omega\tau}$. The measure of prediction error is found using:

$$E(\omega,\tau)=Y_2(\omega)-G(\omega)e^{j\omega\tau}Y_1(\omega), \tag{13}$$

where the gain is optimal given a delay of:

$$G(\omega,\tau)=\frac{\left|\mathrm{Re}\left\{Y_2(\omega)\cdot\left(e^{j\omega\tau}Y_1(\omega)\right)^*\right\}\right|}{Y_1(\omega)\cdot Y_1^*(\omega)}. \tag{14}$$

Therefore, prediction gain is found by:

$$P_{gain}(\omega,\tau)=10\log_{10}\frac{Y_2(\omega)Y_2^*(\omega)}{E(\omega,\tau)E^*(\omega,\tau)}. \tag{15}$$

The prediction gain calculation shown above may benefit from smoothing. In embodiments, the smoothing can be carried out with a simple running mean. For instance, applying smoothing:

$$G(\omega,\tau)=\frac{|\mathrm{Re}\{E\{Y_2(\omega)\cdot Y_1^*(\omega)\}e^{-j\omega\tau}\}|}{E\{Y_1(\omega)\cdot Y_1^*(\omega)\}}, \tag{16}$$

and thus the prediction gain may be found by:

$$P_{gain}(\omega,\tau)=10\log_{10}\frac{E\{Y_2(\omega)Y_2^*(\omega)\}}{E\{Y_2(\omega)Y_2^*(\omega)\}+|G(\omega,\tau)|^2E\{Y_1(\omega)Y_1^*(\omega)\}-2|G(\omega,\tau)|\mathrm{Re}\{E\{Y_2(\omega)Y_1^*(\omega)\}e^{-j\omega\tau}\}}. \tag{17}$$

A frequency dependent TDOA can be established from:

$$\tau_{TDOA}(\omega)=\underset{\tau}{\mathrm{argmax}}\{P_{gain}(\omega,\tau)\}, \tag{18}$$

and thus a full-band TDOA can be determined from:

$$\tau_{TDOA}^{Fullband}=\underset{\tau}{\mathrm{argmax}}\{P_{gain}^{Fullband}(\tau)\} \tag{19}$$

where $$P_{gain}^{Fullband}(\tau)=10\log_{10}\frac{\sum_\omega E\{Y_2(\omega)Y_2^*(\omega)\}}{\sum_\omega E\{Y_2(\omega)Y_2^*(\omega)\}+|G(\omega,\tau)|^2E\{Y_1(\omega)Y_1^*(\omega)\}-2|G(\omega,\tau)|\mathrm{Re}\{E\{Y_2(\omega)Y_1^*(\omega)\}e^{-j\omega\tau}\}}. \tag{20}$$

Equivalently, because $E\{Y_2(\omega)Y_2^*(\omega)\}$ is independent of τ, and $\log_{10}(\ )$ is a monotonically increasing function, the TDOA can be found as:

$$\tau_{TDOA}(\omega)=\underset{\tau}{\arg\min}\{|G(\omega,\tau)|^2E\{Y_1(\omega)Y_1^*(\omega)\}-2|G(\omega,\tau)|\mathrm{Re}\{E\{Y_2(\omega)Y_1^*(\omega)\}e^{-j\omega\tau}\}\}, \tag{21}$$

and the full-band TDOA can be found as:

$$\tau_{TDOA}^{Fullband}=\underset{\tau}{\mathrm{argmin}}\left\{\sum_\omega|G(\omega,\tau)|^2E\{Y_1(\omega)Y_1^*(\omega)\}-2|G(\omega,\tau)|\mathrm{Re}\{E\{Y_2(\omega)Y_1^*(\omega)\}e^{-j\omega\tau}\}\right\}. \tag{22}$$

Similarly, to minimize the error E(ω):

$$\tau_{TDOA}(\omega)=\underset{\tau}{\mathrm{argmin}}\{E\{E(\omega,\tau)E^*(\omega,\tau)\}\}, \tag{23}$$

and for the full-band:

$$\tau_{TDOA}^{Fullband}=\underset{\tau}{\mathrm{argmin}}\left\{\sum_\omega E\{E(\omega,\tau)E^*(\omega,\tau)\}\right\}. \tag{24}$$

Likewise, one minus the normalized error can be maximized as:

$$\begin{aligned}C(\omega,\tau)&=1-\frac{E\{E(\omega,\tau)E^*(\omega,\tau)\}}{E\{Y_2(\omega)Y_2^*(\omega)\}}\\&=1-\frac{E\{Y_2(\omega)Y_2^*(\omega)\}+|G(\omega,\tau)|^2E\{Y_1(\omega)Y_1^*(\omega)\}-2|G(\omega,\tau)|\mathrm{Re}\{e^{-j\omega\tau}E\{Y_2(\omega)Y_1^*(\omega)\}\}}{E\{Y_2(\omega)Y_2^*(\omega)\}}\\&=-\frac{|G(\omega,\tau)|\left[\begin{array}{l}|G(\omega,\tau)|E\{Y_1(\omega)Y_1^*(\omega)\}-\\2\mathrm{Re}\{e^{-j\omega\tau}E\{Y_2(\omega)Y_1^*(\omega)\}\}\end{array}\right]}{E\{Y_2(\omega)Y_2^*(\omega)\}}\\&=\frac{G(\omega,\tau)\left[\begin{array}{l}2\mathrm{Re}\{e^{-j\omega\tau}E\{Y_2(\omega)Y_1^*(\omega)\}\}-\\|\mathrm{Re}\{e^{-j\omega\tau}E\{Y_2(\omega)Y_1^*(\omega)\}\}|\end{array}\right]}{E\{Y_2(\omega)Y_2^*(\omega)\}}\\&=\frac{G(\omega,\tau)[2\mathrm{Re}\{e^{-j\omega\tau}R_{Y_2Y_1}(\omega)\}-|\mathrm{Re}\{e^{-j\omega\tau}R_{Y_2Y_1}(\omega)\}|]}{R_{Y_2Y_2}(\omega)}.\end{aligned} \tag{25}$$

From a spatial perspective, the technique described above looks for the direction in which a null will provide the greatest suppression of an audio source received as a microphone input. In embodiments, this technique can be carried out on a full-band, a sub-band, and/or a frequency bin basis.

Low-frequency content may often dominate speech signals, and at low frequencies (i.e., longer speech signal wave lengths) the spatial separation of the signals is poor, resulting in a poorly defined peak in the cost function. In such cases, exploiting spatial properties may still be utilized by advantageously equalizing the spectral envelope to some degree in order to provide greater weight to frequencies where the peak of the cost function is more clearly defined. The described techniques may apply magnitude spectrum normalization to reduce the impact from high-energy, spatially-ambiguous low-frequency content. This equalization may be included in the SNE results in the SNE-PHAT techniques described herein by equalizing the terms of the SNE-PHAT equations above according to:

$$R_{YZ}^{eq}(\omega) = \frac{R_{YZ}(\omega)}{\sqrt{R_{YY}(\omega)R_{ZZ}(\omega)}}, \tag{26}$$

where $R_{YZ}(\omega)=E\{Y(\omega)Z^*(\omega)\}$. Thus the frequency-dependent merit for SNE-PHAT becomes:

$$C_{eq}(\omega, \tau) = G_{eq}(\omega, \tau)[2\mathrm{Re}\{e^{-j\omega\tau} R_{Y_2Y_1}^{eq}(\omega)\} - |\mathrm{Re}\{e^{-j\omega\tau} R_{Y_2Y_1}^{eq}(\omega)\}|], \tag{27}$$

where $$G_{eq}(\omega, \tau) = |\mathrm{Re}\{e^{-j\omega\tau} R_{Y_2Y_1}^{eq}(\omega)\}|.$$

Accordingly, the full-band merit may be expressed as:

$$C_{EQ}^{Fullband}(\tau) = \frac{\sum_{\omega} G_{eq}(\omega, \tau)[2\mathrm{Re}\{e^{-j\omega\tau} R_{Y_2Y_1}^{eq}(\omega)\} - |\mathrm{Re}\{e^{-j\omega\tau} R_{Y_2Y_1}^{eq}(\omega)\}|]}{\sum_{\omega} 1}, \tag{28}$$

and the full-band TDOA is found as:

$$\tau_{TDOA}^{Fullband} = \underset{\tau}{\mathrm{argmax}}\{C_{Eq}^{Fullband}(\tau)\}. \tag{29}$$

While the frequency-dependent TDOA can be found as:

$$\tau_{TDOA}(\omega) = \underset{\tau}{\mathrm{argmax}}\{C_{EQ}(\omega, \tau)\}, \tag{30}$$

A better estimate of the true, underlying TDOA can be achieved by taking the full-band TDOA into account and constraining the frequency-dependent TDOA around full-band TDOA. For instance:

$$\tau_{TDOA}(\omega) = \underset{\tau\in[\tau_{TDOA}^{Fullband}-\delta_{lower};\tau_{TDOA}^{Fullband}+\delta_{upper}]}{\mathrm{argmax}}\{C_{Eq}(\omega, \tau)\}. \tag{31}$$

Additionally, the range may be frequency-dependent. That is, spatial aliasing may result in "false" peaks in the merit at $\tau=\tau_{true}\pm k/\omega$, k=1, 2, 3, . . . , and it may be advantageous to exclude false peaks from consideration. For example:

$$\tau_{TDOA}(\omega) = \underset{\tau\in[\tau_{TDOA}^{Fullband}-K\frac{2\pi}{\omega};\tau_{TDOA}^{Fullband}+K\frac{2\pi}{\omega}]}{\mathrm{argmax}}\{C_{EQ}(\omega, \tau)\}, \tag{32}$$

which limits the search to a constant of 0<K<1 from the first spatial lobe (i.e., the false peak) in either direction. In embodiments, the frequency dependent constraint can be combined with a fixed constraint (e.g. whichever constraint is tighter may be used). A fixed constraint may be beneficial because the spatial aliasing constraint may become unconstrained as the frequency decreases towards zero.

2. Example Adaptive Gaussian Mixture Model (GMM) Embodiments

Techniques are also provided herein for the modeling of acoustic scenes to differentiate between sources (e.g., talkers, noise sources, etc.). The embodiments described herein provide for improved acoustic scene analysis (ASA) techniques using speaker-dependent information. For instance, an adaptive, online Gaussian mixture model (GMM) algorithm to model acoustic scenes will now be described.

The ASA techniques described herein provide a statistical framework for modeling the acoustic scene that may easily be extended with relevant features (e.g., additional spatial and/or spectral information), to offer differentiation between speakers without a need for many manual parameters, tuning, and logic, and with a greater natural ability to generalize than conventional solutions. Furthermore, the described ASA techniques directly offer analytical calculations of "probability of source presence" at every frame based on the feature vector and the GMMs. Such probabilities are highly desirable and useful to downstream components (e.g., other components in MMNR component 114, automatic mode detector 222, and/or SCS component 116 described with respect to FIGS. 1 and 2). Without on-line adaptation of the GMM, the algorithm would not be able to track relative movement between a communication device and audio sources. Relative movement is a common phenomenon related to speakerphone modes in communication devices, and thus an adaptive online GMM algorithm is especially beneficial.

Figure 4:
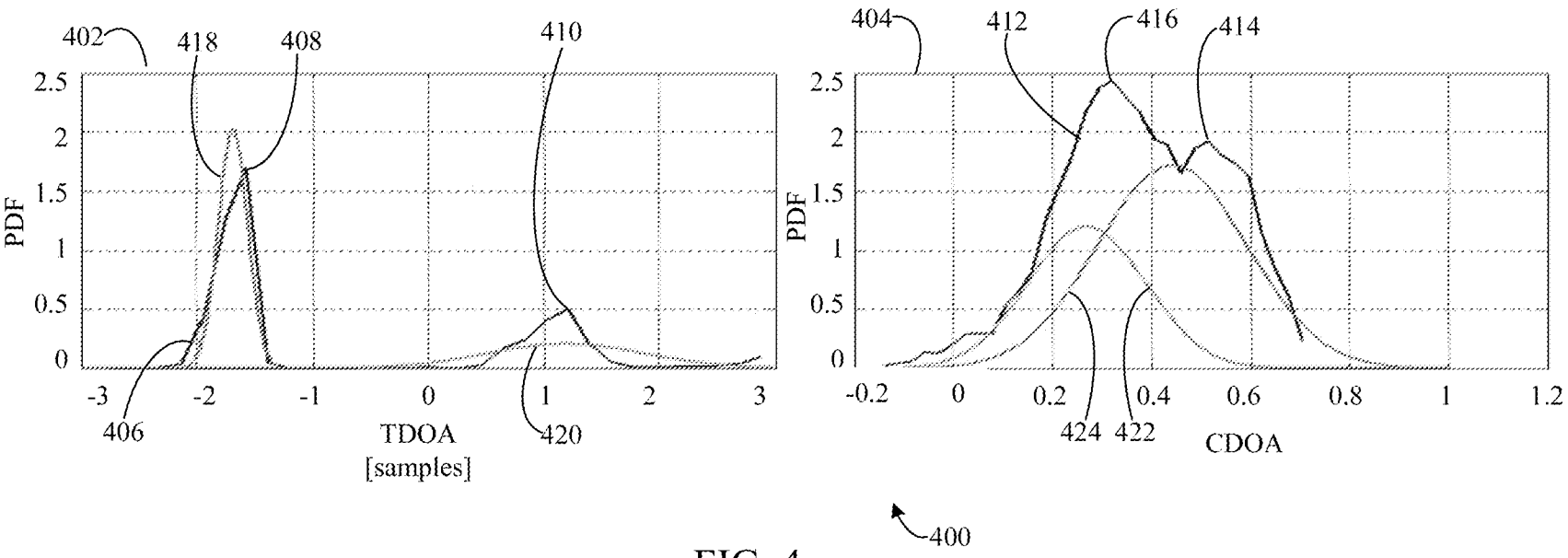
FIG. 4 shows example histograms and fitted Gaussian distributions of time delay of arrival and merit at the time delay of arrival for a desired source and an interfering source, according to an example embodiment.

In the ASA and GMM embodiments described herein, a desired source (DS) is a point source and interfering sources are either point sources or diffuse sources. A point source will typically have a TDOA with a distribution that reasonably can be assumed to follow a Gaussian distribution with mean equaling the TDOA and a variance reflecting its focus from the perspective of a communication device. A diffuse (interfering) source can be approximated by a spread out (i.e., high variance) Gaussian distribution. For example, FIG. 4 shows histograms and fitted Gaussian distributions 400 (with probability density function (PDF) on the Y-axis) from an example mixture with a DS and an interfering source in terms of TDOA and merit value (i.e., a [TDOA, CDOA] pair or a [TDOA, CDOA] feature vector). Histograms and fitted Gaussian distributions 400 includes a TDOA plot 402 and a merit value (e.g., CDOA) plot 404. TDOA plot 402 includes a marginal distribution 406 (black line) with a TDOA DS peak 408 and a TDOA interfering source peak 410. Similarly, CDOA plot 404 includes a marginal distribution 412 (black line) with a merit value DS peak 414 and a merit value interfering source peak 416.

In performing traditional ASA according to prior solutions, it may not be obvious which source is the DS and which is interfering source. However, when considering the physical property of the desired source being closer and subject to less dispersion (e.g., its direct path is more dominant), the DS will have a narrower TDOA distribution as utilized in the embodiments and technique herein. In some cases, an exception to this generalization could be acoustic echo as the loudspeaker is typically very close to the microphones and thus could be seen as a desired source. However, as the microphone locations are fixed relative to each other, a fixed super-directive beamformer could be constructed to null out the loudspeaker direction permanently, or GMMs with a mean TDOA corresponding to that known direction could automatically be disregarded as a desired source. Additionally, as noted herein, coherence between up-link and down-link can also be used to effectively distinguish GMs of DSs from GMs of acoustic echo. The DS will also have and a higher merit value (e.g., CDOA value) for similar reasons. Heuristics may be implemented to try deduce the desired and interfering sources from collected histograms, for example as shown in FIG. 4, however, the heuristics can easily become ad-hoc and difficult to implement.

Alternatively, Multi-Variate GMMs (MV-GMMs) can be fitted to the data of the [TDOA, CDOA] pair using an expectation-maximization (EM) algorithm, in accordance with the techniques and embodiments described herein. The MV-GMM technique captures the underlying mechanisms in a statistically optimal sense, and with the estimated GMMs and a [TDOA, CDOA] pair for a given frame, the probabilities of desired source can be calculated analytically for the frame. For instance, FIG. 4 shows a MV-GMM fit to the [TDOA, CDOA] pair with two Gaussian 2-D distributions using an EM algorithm (e.g., such as the EM algorithm described below in this section). An EM DS TDOA distribution 418 as shown is more readily distinguishable from an EM interfering source TDOA distribution 420. Likewise, an EM DS merit value distribution 424 as shown is more readily distinguishable from an EM interfering source merit value distribution 422. This implementation of the EM algorithm, however, requires the individual Gaussian mixtures (GMs) to be labeled as corresponding to desired or interfering sources, and the current state of the art lacks an adaptive, online EM algorithm to utilize such techniques in real-world applications. Accordingly, FIG. 4 illustrates the benefit of fitting GMs to the [TDOA, CDOA] data, and the techniques described herein fill the need for an adaptive, online EM algorithm.

Additionally, at the beginning of a telephone call, the relative positions between the communication device and the sources (desired and interfering) are unknown, and the spatial scene may be changing due to potential movement of the desired and/or interfering sources and/or movement of the device. In embodiments, the adaptive, online EM algorithm may be deployed to estimate the GMM parameters on-the-fly, or in a frame-by-frame manner, as new [TDOA, CDOA] pairs are received from SNE-PHAT TDOA estimation component 212. The feature vector [TDOA, CDOA] can be augmented with any additional parameters that differentiate between desired and interfering sources for further improved performance. Thus, the online EM algorithm allows tracking of the GMM adaptively, and with proper limits to step size, it accommodates spatially non-stationary scenarios.

As described above with respect to FIG. 2, online GMM modeling component 214 may perform ASA for a plurality of microphone signal inputs, such as microphone inputs 206, and may output statistics, mixtures, and probabilities 230 (e.g., GMM modeling of TDOA and merit value). The ASA may be performed for individual microphone pairs as described with respect to FIG. 2, or for all microphone pair TDOA information jointly. In embodiments, GMM modeling component 214 is configured to perform adaptive online expectation maximization (EM) or online Maximum A Posteriori (MAP) estimation. In embodiments, GMM modeling component 214 may utilize any feature offering a degree of differentiation in the feature vector to improve separation of the multi-variate Gaussian mixtures representing the audio sources in the acoustic scene. Such features include without limitation: spatially motivated features such as TDOA, merit value, as well as features distinguishing echo (e.g. coherence (including coherence as function of frequency) between up-link and down-link, and soft voice activity detection (VAD) decisions on down-link and up-link signals.

In embodiments, GMM modeling component 214 implements an ASA algorithm using GMMs and raw TDOA values and merit values associated with the raw TDOA values received from a TDOA estimator such as SNE-PHAT TDOA estimation component 212 of FIG. 2. In embodiments, a merit value represents the merit at a given TDOA from SNE-PHAT TDOA estimation component 212. The online EM algorithm allows adaptation to frequently, or constantly, changing acoustic scenes, and DS and interfering sources may be identified from GMM parameters. The ASA technique and algorithm will now be described in further detail.

The EM algorithm maximizes the likelihood of a data set $\{x_1, x_2, \ldots, x_N\}$ for a given GMM with a distribution of $f_X(x_1, x_2, \ldots, x_N)$. The EM algorithm uses statistics for a given mixture j:

$$E_{0,j}(n) = \sum_{m=1}^{n} P(m_j \mid x_m), \tag{33}$$

$$E_{1,j}(n) = \sum_{m=1}^{n} P(m_j \mid x_m) x_m, \tag{34}$$

and $$E_{2,j}(n) = \sum_{m=1}^{n} P(m_j \mid x_m) x_m x_m^T, \tag{35}$$

where $P(m_j|x_m)$ denotes the posterior probability of mixture j, given the observed feature at time index m. The subscripts 0, 1, and 2 denote the "order" of the statistics (e.g., $E_{2,j}(n)$ is the second order statistic), and superscript "T" denotes the non-conjugate transpose. The GMM parameters for mixture j can then be estimated, with means (Eq. 36), covariance matrix (Eq. 37), and mixture coefficients (Eq. 38), as:

$$\mu_{j,n} = E_{1,j}(n) / E_{0,j}(n), \tag{36}$$

$$\sum_{j,n} = E_{2,j}(n) / E_{0,j}(n) - \mu_{j,n}\mu_{j,n}^T, \tag{37}$$

and

-continued $$\pi_{j,n} = E_{0,j}(n) \Big/ \sum_i E_{0,i}(n). \tag{38}$$

The adaptive, online EM algorithm can thus be derived by expressing the GMM parameters for mixture j recursively as:

$$\mu_{j,n} = \alpha_{j,n}\mu_{j,n-1} + (1-\alpha_{j,n})x_n, \tag{39}$$

$$\sum_{j,n} = \alpha_{j,n}\left(\sum_{j,n-1} + \mu_{j,n-1}\mu_{j,n-1}^T\right) + (1-\alpha_{j,n})x_n x_n^T - \mu_{j,n}\mu_{j,n}^T, \tag{40}$$

and $$\pi_{j,n} = \pi_{j,n-1} + P(m_j \mid x_m) \Big/ \sum_i P(m_i \mid x_m), \tag{41}$$

with a step size derived as:

$$\alpha_{j,n} = E_{0,j}(n-1)/(E_{0,j}(n-1) + P(m_j|x_n)). \tag{42}$$

The MAP algorithm maximizes the posterior probability of a GMM given the data set $\{x_1, x_2, \ldots, x_N\}$. The MAP algorithm allows parameter estimation to be regularized to prior means $\pi_{j,0}$, $\mu_{j,0}$, and $\Sigma_{j,0}$. In embodiments, prior distributions may be chosen as conjugate priors to simplify calculations, and a relevance factor ($\lambda$) may be introduced in prior modeling to weight the regularization. The GMM parameters for a mixture j can then be estimated, with means (Eq. 43), covariance matrix (Eq. 44), and mixture coefficients (Eq. 45), as:

$$\mu_{j,n} = \beta_{j,n}E_{1,j}(n)/E_{0,j}(n) + (1-\beta_{j,n})\mu_{j,0}, \tag{43}$$

$$\sum_{j,n} = \beta_{j,n}E_{2,j}(n)/E_{0,j}(n) + (1-\beta_{j,n})\left(\sum_{j,0} + \mu_{j,0}\mu_{j,0}^T\right) - \mu_{j,n}\mu_{j,n}^T, \tag{44}$$

and $$\pi_{j,n} = \lfloor \beta_{j,n}E_{0,j}(n) + (1-\beta_{j,n})\pi_{j,0} \rfloor \Big/ \sum_i \pi_{i,n}, \tag{45}$$

with a step size derived as:

$$\beta_{j,n} = E_{0,j}(n)/(E_{0,j}(n) + \lambda). \tag{46}$$

The adaptive, online MAP algorithm can thus be derived by expressing the GMM parameters for mixture j recursively as:

$$\mu_{j,n} = \alpha_{j,n}\mu_{j,n-1} + (1-\alpha_{j,n})x_n, \tag{47}$$

$$\sum_{j,n} = \alpha_{j,n}\left(\sum_{j,n-1} + \mu_{j,n-1}\mu_{j,n-1}^T\right) + (1-\alpha_{j,n})x_n x_n^T - \mu_{j,n}\mu_{j,n}^T, \tag{48}$$

and $$\pi_{j,n} = \lfloor \alpha_{j,n}E_{0,j}(n) + (1-\alpha_{j,n})\pi_{j,0} \rfloor \Big/ \sum_i \pi_{i,n}, \tag{49}$$

with the step size derived as:

$$\alpha_{j,n} = (E_{0,j}(n) + \lambda)/(P(m_j|x_n) + E_{0,j}(n) + \lambda). \tag{50}$$

In embodiments, to accommodate non-stationary spatial scenarios it may be advantageous to limit the mixture counts in the update equations, effectively preventing the "step" size from becoming too small:

$$E_{0,j} \Leftarrow \min\{_{0,j}, E_{max}\}. \tag{51}$$

Additionally, in embodiments, not all GMs may be updated at every update, but instead only the mean and variance of the best match GM are updated, while mixture coefficients may be updated for all GMs. The motivation for this update scheme is based on the observation that the different Gaussian distributions are not sampled randomly, but often in bursts—e.g., the desired source will be active intermittently during the conversation with the far-end, and thus dominate the acoustic scene, as seen by the communication device, intermittently. The intermittent interval may be up to tens of seconds at a time, which could result in all GMs drifting in spurts towards a DS and then towards interfering sources depending on the DS activity pattern. This corresponds to forcing only the maximum mixture posterior $P(m_j|x_n)$ to be non-zero.

In one embodiment, it may be advantageous to regularize adaptation to avoid over-emphasis on initial observations. For instance, in the MAP algorithm, this can be done by increasing the relevance factor, $\lambda$. For the EM algorithm, this can be done by including a bias in the mixture counts:

$$E_{0,j}(n) = \sum_{m=1}^{n} P(m_j \mid x_m) + E_{init}. \tag{52}$$

From the GMMs, individual GMs representing the DS and interfering sources can be distinguished. This is based on physical properties as noted above: the DS will have a narrower TDOA distribution and a higher merit value. A narrower TDOA distribution is identified by smaller variance of the marginal distribution representing the TDOA (a by-product of the EM or MAP algorithm), and a higher merit value is identified by a higher mean of the marginal distribution representing the merit value (also a by-product of the EM or MAP algorithm). Compared to residual echo, the DS will also present a lower mean corresponding to up-link-down-link coherence. Based on the GMM parameters estimated during the on-line fitting of the multi-variate Gaussian distributions to the data, at every frame the GMs are grouped into two sets: Set Ω_DS representing the desired source, and Set Ω_IS representing interfering sources.

In embodiments, exemplary logic may be used to identify the GMs representing the DS:

$$\Omega_{DS} = \begin{cases} [J] & \text{if} \left( \begin{array}{l} J = \underset{k}{\operatorname{argmin}}\{\sum_k^{TDOA}\} \wedge \\ J = \underset{k}{\operatorname{argmax}}\{\mu_k^{CDOA}\} \end{array} \right) \vee \left( \begin{array}{l} \left| \begin{array}{l} \sum_{J=\underset{k}{\operatorname{argmax}}\{\mu_k^{CDOA}\}}^{TDOA} - \\ \sum_{\underset{k}{\operatorname{argmin}}\{\sum_k^{TDOA}\}}^{TDOA} \end{array} \right| < \\ Thr_{\Sigma^{TDOA}} \cdot \sum_{\underset{k}{\operatorname{argmin}}\{\sum_k^{TDOA}\}}^{TDOA} \end{array} \right) \\ [J] & \text{else if} \left| \begin{array}{l} \mu^{CDOA}_{J=\underset{k}{\operatorname{argmin}}\{\sum_k^{TDOA}\}} - \\ \mu^{CDOA}_{\underset{k}{\operatorname{argmax}}\{\mu_k^{CDOA}\}} \end{array} \right| < Thr_{\mu^{CDOA}} \cdot \mu^{CDOA}_{\underset{k}{\operatorname{argmax}}\{\mu_k^{CDOA}\}} \\ [J_1, J_2] & \text{otherwise} \end{cases} \tag{53}$$

where $$J_1 = \underset{k}{\operatorname{argmin}}\{\textstyle\sum_k^{TDOA}\},\ J_2 = \underset{k}{\operatorname{argmax}}\{\mu_k^{CDOA}\},$$

and $Thr_{\Sigma^{TDOA}}$ $Thr_{\mu^{CDOA}}$ are thresholds. The probability of DS presence at frame n can be calculated analytically from the $x_n$=[$TDOA_n$, $CDOA_n$] pair, the GMs, and the grouping into $\Omega_{DS}$ and $\Omega_{IS}$:

$$P_{DS}(n) = \frac{\sum_{i \in \Omega_{DS}} \pi_{i,n} P\left\{x_n \in N\left(\mu_{i,n}, \sum_{i,n}\right)\right\}}{\sum_{i \in \Omega_{DS} \cup \Omega_{IS}} \pi_{i,n} P\{x_n \in N(\mu_{i,n}, \sum_{i,n})\}}. \tag{54}$$

Similarly, the probability of interfering source presence can be calculated as:

$$P_{IS}(n) = \frac{\sum_{i \in \Omega_{IS}} \pi_{i,n} P\left\{x_n \in N\left(\mu_{i,n}, \sum_{i,n}\right)\right\}}{\sum_{i \in \Omega_{DS} \cup \Omega_{IS}} \pi_{i,n} P\{x_n \in N(\mu_{i,n}, \sum_{i,n})\}} = 1 - P_{DS}(n). \tag{55}$$

3. Example Source Identification (SID) Embodiments

The embodiments described herein are also directed to the utilization of speaker identification (SID) to further enhance ASA. For instance, if the identity of a DS is known, and a pre-trained acoustic model exists for the DS, the SID can be leveraged to improve ASA. Information provided by SID is complementary to previously described spatial information, and the combination of these streams can improve the accuracy of ASA. Using statistical modeling of the joint behavior of the spatial and SID signatures, better statistical separation can be achieved between acoustic sources. Thus, the DS is estimated based both on spatial signature and acoustic similarity to the pre-trained SID model. Embodiments thus overcome many of the scenarios for which traditional ASA systems fail due to ambiguous spatial information. It should be noted that while the context of the embodiments and techniques described herein pertains to dual- and/or multi-microphone implementations, the SID techniques in this sub-section are also applicable to single-microphone implementations. Furthermore, the EM adaptation techniques described above may be utilized in accordance with the SID techniques described below. The MAP adaptation techniques described above, and in further detail below, may also be used.

In order to be compatible with a pool of possible users, SID can be used to initially identify the current user or speaker. Multiple pre-trained acoustic speaker models can then be saved locally. However, for many portable devices, the user pool is relatively small, and the user distribution is often skewed, thereby only requiring a small set of models. Non-SID system behavior can be used for unidentified users, as described in various embodiments herein.

In embodiments, online training of acoustic speaker models may be used, thus avoiding an explicit, off-line training period. Because speaker labels are unknown for input frames from down-link signals, soft information from acoustic scene modeling can be used to implement online maximum a posteriori (MAP) adaptation of acoustic SID models.

Embodiments provide various comparative advantages, including utilizing speaker identification (SID) during acoustic scene analysis, which represents an information stream which is complementary to spatial measures, as well as performing modeling of the joint statistical behavior of spatial- and speaker-dependent information, thereby providing an elegant technique by which to integrate the two information streams. Furthermore, by leveraging SID, it is possible to detect and/or locate DSs if spatial information becomes ambiguous.

As described herein, multi-microphone noise suppression requires accurate tracking of the DS. Traditional source tracking solutions rely on information relating to spatial information of input signal components and relating to the down-link signal. Spatial and down-link information may become ambiguous if, e.g.: there exists a high-energy interfering point source (e.g. a competing talker), and/or the DS remains silent for an extended period. These are typical scenarios in real-world conversations.

According to the described techniques and embodiments, source tracking is enhanced by leveraging SID. Soft SID output scores can be passed to the source tracker. Thus, the source tracker may use this additional, rich information to perform DS tracking. The SID techniques and embodiments use spectral content, which is advantageously complementary to TDOA-related information. Accordingly, the source tracking techniques and embodiments described herein benefit from the increased robustness provided by the utilization of SID, especially in the case of real-world applications.

Figure 5:
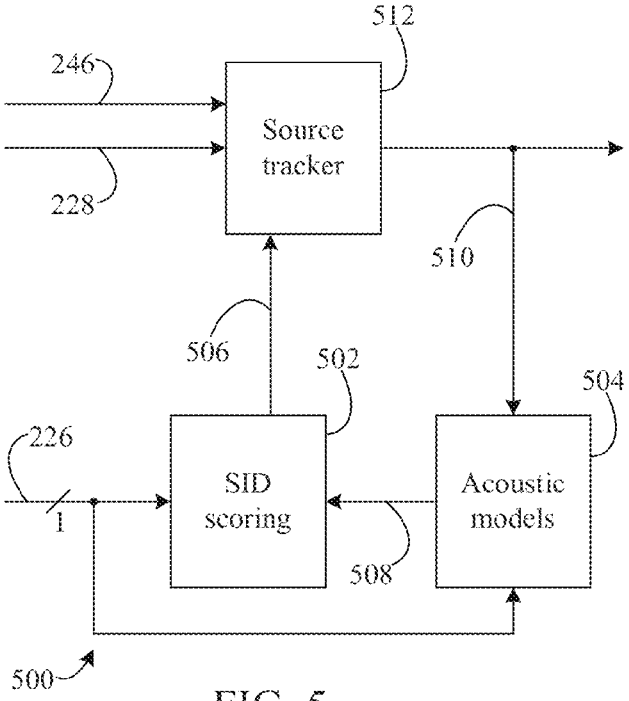
FIG. 5 shows a block diagram of a portion of the system of FIG. 2 that includes an example source identification tracking implementation, according to an example embodiment.

FIG. 5 shows a block diagram of a source tracking with SID implementation 500 that includes a source tracker 512 for tracking a desired source, an SID scoring component 502, and an acoustic models component 504, according to an example embodiment. Spatial information 228 is provided to source tracker 512. In embodiments, source tracker 512 also receives up-link-down-link coherence information 246. SID scoring component 502 and acoustic models component 504 each receive the primary microphone signal of compensated microphone outputs 226. Acoustic models component 504 also receives DS tracker outputs 510 provided by source tracker 512, as described herein. Acoustic models component 504 provides acoustic models 508 to SID scoring component 502. SID scoring component 502 provides a soft SID score 506 to source tracker 512.

According to embodiments, source tracker 512 is configured to provide DS tracker outputs 510 that may include a TDOA value for the DS. Source tracker 512 may generate DS tracker outputs 510 using multi-dimensional models of the acoustic scene (e.g., GMMs) as described in further detail below.

Acoustic models component 504 is configured to generate, update, and/or store acoustic models for DSs and interfering sources. These acoustic models may be trained on-line and adapted to the current acoustic scene or off-line in embodiments based on one or more inputs received by acoustic models component 504, as described herein. For example, models may be updated by acoustic models component 504 based DS tracker outputs 510. The acoustic models may be generated and updated using models of spectral shape for sources (e.g., GMMs) as described in further detail below.

SID scoring component 502 is configured to generate a soft SID score 506. In embodiments, soft SID score 506 may be a statistical representation of the probability that a given source in an audio frame is the DS. In embodiments, soft SID score 506 may comprise a log likelihood ratio (LLR) or other equivalent statistical measure. For instance, comparing the primary microphone portion of the compensated microphone outputs 226 to a DS model of acoustic models 508, SID scoring component 502 may generate soft SID score 506 comprising an LLR indicative of the likelihood of the DS in the audio frame. Soft SID score 506 may be generated using models of spectral shape for sources (e.g., GMMs) as described in further detail below.

In these described source tracking embodiments, important information regarding the behavior of the desired source (DS) is provided to improve overall system and device operation and performance. For instance, the DS TDOA may be more accurately estimated allowing a beamformer (e.g., SSDB 218) to be steered more correctly. Additionally, the likelihood of DS activity for the current audio frame (i.e., the DS posterior) allows statistics of a blocking matrix (e.g., adaptive block matrix component 216) to be updated during active DS frames. Other components in embodiments described herein may also utilize the DS TDOA and DS posterior generated by source tracker 512, such as SCS component 116.

The behavior of the acoustic scene may be modeled in various ways in embodiments. For instance, parametric models can be used for online modeling of acoustic sources by source tracker 512. One example, a Gaussian mixture model (GMM), may be used as shown below:

$$p(y_i) = \sum_{j=1}^{N} w_j p(y_i \mid m_j) = \sum_{j=1}^{N} w_j N\left(y_i \mid \mu_j, \sum_j\right), \tag{56}$$

where y is the feature vector N is the number of mixtures, j is the mixture index for mixture m, i is the frame index, w is the weight parameter, μ is the mixture mean, and Σ denotes the covariance.

Various features may be configured as feature vectors to provide information which can discriminate between speakers and/or sources based on spatial and spectral behavior. For example, TDOA may be used to convey an angle of incidence for an audio source, merit value may be used to describe how similar audio frames are to a point source, and LLRs may be used to convey spectral similarity(ies) to DSs. It should be noted that the LLR can be smoothed over time adaptively, by keeping track (e.g., storing) of salient speech segments. Additional features are also contemplated herein, as would be understood by one of skill in the relevant art(s) having the benefit of this disclosure. In the context of multi-dimensional relationships for the above-described features, acoustic sources (e.g., DSs) form distinct, individual clusters that may be identified and used for source tracking.

The example techniques in this subsection may be performed in accordance with embodiments alternatively to, or in addition to, the techniques from the previous subsection. The example techniques in this subsection allow for extension to additional and/or different features for modeling, thus providing for greater model generalization. In an example embodiment, the modeling of the statistical behavior of the acoustic scene may be performed using GMM with three mixtures (i.e., three audio source clusters), as shown in the following equation:

$$p(y_i) = \sum_{j=1}^{3} w_j p(y_i \mid m_j) = \sum_{j=1}^{3} w_j N\left(y_i \mid \mu_j, \sum_j\right). \tag{57}$$

In the context of this equation, an example 3-dimensional feature vector may be give as:

$$y_i = [\mathrm{CDOA}_i, \mathrm{TDOA}_i, \mathrm{LLR}_i]^T, \tag{58}$$

for every frame index i, where T denotes the non-conjugate transpose, and the mixture means may be given as:

$$\mu_j = [E\{\mathrm{CDOA}|m_j\}, E\{\mathrm{TDOA}|m_j\}, E\{\mathrm{LLR}|m_j\}]^T, \tag{59}$$

represented as a matrix of expectations E of the feature vectors, for mixtures m with index j. This is the mean of the mixture in the GMM. In some embodiments, covariance (Σ) may also be modeled.

Based on the modeling described above, alternative features vectors may be calculated, according to embodiments. An alternative feature vector (a "z vector" herein) used for determining which mixture is the DS, and thus calculating the DS posterior, can be shown by:

$$z_j = [E\{\mathrm{CDOA}|m_j\}, -\mathrm{var}\{\mathrm{TDOA}|m_j\}, E\{\mathrm{LLR}|m_j\}]^T, \tag{60}$$

where "var" denotes the variance of the TDOA and ti is the relevance of the model prior. The z vectors may be used determine which feature is indicative of a DS. For instance, a high merit value (e.g., CDOA) or a high LLR likely corresponds to a DS. A low variance of TDOA also likely corresponds to a DS, thus this term is negative in the equation above.

A maximum z vector may be given as:

$$z_{max} = \left[\max_i z_i(1), \max_i z_i(2), \max_j z_i(3)\right]^T, \tag{61}$$

and may be normalized by:

$$\tilde{z}_i = \left[\frac{z_{max}(1) - z_i(1)}{E\{z_i(1)\}}, \frac{z_{max}(2) - z_i(2)}{E\{z_i(2)\}}, \frac{z_{max}(3) - z_i(3)}{E\{z_i(3)\}}\right]. \tag{62}$$

The resulting, normalized z vector $\tilde{z}_i$ allows for an easily implemented range of values by which the DS may be determined. For instance, the smaller the norm of $\tilde{z}_i$, the more mixture i likens to the DS. Furthermore, each element of $\tilde{z}_i$ is nonnegative with unity mean.

As previously noted, the above equations can be extended to include other measures relating to spatial information, as well as full-band energy, zero-crossings, spectral energy, and/or the like. Furthermore, for the case of two-way communication, the equations can also be extended to include information relating to up-link-down-link coherence (e.g., using up-link-down-link coherence information 246).

In an embodiment, statistical inference of the TDOA and the posterior of the DS may be performed. Calculating the posterior of the DS of the DS for a give mixture in the acoustic scene analysis:

$$P(DS \mid m_j) = \frac{\exp(-\tilde{z}_j)}{\sum_i \exp(-\tilde{z}_i)} \cdot \frac{1}{1 + \exp(-E\{LLR \mid m_j\})}. \tag{63}$$

In embodiments, the LLR element of this equation may be dropped due to the equal weighting inherently applied using LLRs, and noise may be present (or represented) in LLRs raising the possibility of amplified noise in the analysis. Using statistical inference, calculating the frame likelihood of the DS may be provided by:

$$P(DS \mid y_i) = \sum_{l=1}^{3} P(DS \mid m_j) P(m_j \mid y_i). \tag{64}$$

This represents the posterior of the DS in given frame given a feature vector, and significantly, indicates if the DS is active for the vector. Calculating the expected TDOA of the DS may be provided by:

$$\begin{aligned} E\{TDOA \mid DS\} &= \sum_{l=1}^{3} E\{TDOA \mid m_j\} P(m_j \mid DS) \\ &= \frac{\sum_{j=1}^{3} w_j P(DS \mid m_j) E\{TDOA \mid m_j\}}{\sum_{l=1}^{3} w_l P(DS \mid m_l)}. \end{aligned} \tag{65}$$

This TDOA value (i.e., the final expected TDOA) may be used steer the beamformer (e.g., SSDB 218), to update filters in the adaptive blocking matrices (e.g., in adaptive blocking matrix component 216) or other components using TDOA values as described herein.

The techniques and embodiments herein also provide for on-line adaptation of acoustic GMMs for SID scoring by SID scoring component 502. The speaker-dependent GMMs used for SID scoring can be adapted on-line to improve training and to adapt to current conditions of the acoustic scene, and may include tens of mixtures and feature vectors. As previously noted, EM adaptations and/or MAP adaptations may be utilized for the SID techniques described. Because speaker labels are not known for down-link audio frames, the DS and interfering source models can be adapted using maximum a posteriori (MAP) adaptation (a further adaptation of the EM algorithm techniques herein, in embodiments) with soft labels, in embodiments, although other techniques may be used. Whereas the previously described EM algorithm techniques use a maximum likelihood criterion, the described MAP adaptation utilizes maximum a posteriori criteria. For instance, a mixture j of the DS model may be updated with feature $y_n$ according to:

$$\mu_{n,j} = (1 - \alpha_{n,j})\mu_{n-1,j} + \alpha_{n,j} y_{n,j}, \tag{66}$$

$$\sum_{n,j} = (1 - \alpha_{n,j})\left(\sum_{n-1,j} + \mu_{n-1,j}\mu_{n-1,j}^T\right) + \alpha_{n,j} y_{n,j} y_{n,j}^T - \mu_{n,j}\mu_{n,j}^T, \tag{67}$$

and $$\pi_{n,j} = [(1 - \alpha_{n,j})\pi_{n-1,j} + \alpha_{n,j}]/\lambda_{n,j}, \tag{68}$$

where:

$$\alpha_n = \frac{P(DS \mid y_n) P(m_j \mid y_n)}{\theta_{n,j} + \tau},$$

$$\theta_{n,j} = \sum_{k=1}^{n} P(m_j \mid y_k),$$

$$\lambda_{n,j} = \sum_i \pi_{n,i},$$

and $\tau$=relevance factor used to emphasize the model prior.

As used above, $\mu$ is the mean, $\Sigma$ is the covariance, and it is the prior. The P(DS) from source tracker 512 may be used to facilitate, with high confidence due to its complementary nature, the determination of which model to update.

An estimation of DS information may also be performed on a frequency-dependent basis by source tracker 512, in embodiments. For instance, feature vectors $y_i$ can be extracted for individual frequency bands. This allows $P(y_i|DS)$ to calculated on a frequency-dependent basis that may further distinguish the DS over interfering sources. For instance, a DS may be predominantly present in a first frequency band, while interfering sources may be predominantly present in other frequency bands. Thus, statistical measures used for designing the blocking matrices and the ANC can be adapted only for appropriate frequency bands.

In embodiments, separate statistical models can be used for individual frequency bands. This allows E{TDOA|DS} to be estimated on a frequency-dependent basis, and therefore, localization of the DS will not be biased by the presence of interfering sources in certain bands.

Extension of these frequency-dependent estimations may be performed during overlap of the desired and interfering sources, such as due to double-talk, background noise, and/or residual down-link echo.

4. Example Automatic Mode Detection Embodiments

In embodiments, communication devices may detect whether a single user or multiple users (e.g., audio sources) are present when in a speakerphone mode. This detection may be used in the dual-microphone or multi-microphone noise suppression techniques described herein. For example, when used in a speakerphone mode, a communication device (e.g., a cell phone or conference phone) that has two or more microphones may use a variety of front-end, multi-microphone noise reduction (MMNR) techniques to enhance the desired near-end talker's voice. For instance, by suppressing the acoustic background noise and/or the voices of interfering talkers nearby, the desired near-end talker's voice may be enhanced. Such multi-microphone techniques may include, but are not limited to, beamforming, independent component analysis (ICA), and other blind source separation techniques.

One particular challenge in applying such front-end MMNR techniques is the difficulty in determining acoustically whether the user is using the communication device in speakerphone mode by himself/herself (i.e. in a "single-user mode") or with other people physically near him/her who may also be participating in a conference call with the user (i.e., in a "conference mode"). There is a need to determine whether the communication device is used in the single-user mode or the conference mode, because the expected behavior of the front-end MMNR is different in these two modes. In the single-user mode, the voices of nearby talkers are considered interferences and should be suppressed, whereas in the conference mode the, voices of the nearby talkers who participate in the conference call should be preserved and passed through to the far-end participants of the conference call. If the voices of these near-end conference call participants are suppressed by the front-end MMNR, the far-end participants of the conference call will not be able to hear them well resulting in an unsatisfactory conference call experience.

It is difficult for a communication device to distinguish which of the two modes (single-user mode or conference mode) the speakerphone is in by analyzing the signal characteristics of the nearby talkers' voices, because the same set of talkers can be participating in a conference call in one setting but not participating in a conference call (i.e., be interfering talkers) in another setting. One way to deal with this problem is to have a button in the user interface of the communication device to let the user specify operation in the single-user mode or the conference mode. However, this is inconvenient to the user, and the user may forget to set the mode correctly. Thus the user will not realize the communication device is in the incorrect mode because the user does not hear the output signal sent to the far-end participant(s).

The embodiments and techniques described herein include an automatic mode detector (e.g., automatic mode detector 222 of FIG. 2) that may be configured to automatically detect whether the speakerphone is in the conference mode or the single-user mode. This mode detector is based on the observation that in a single-user mode, the interfering talkers nearby are conducting their conversations independent of the user's telephone conversation, but in a conference mode, the near-end conference participants will normally take turns to talk, not only among themselves, but also between themselves and the far-end conference participants. Occasionally different conference participants may try to talk at the same time, but normally within a short period of time (e.g., a second or two seconds) some of the participants will stop talking, leaving only one person to continue talking. That is, if two persons continue talking simultaneously, e.g., for more than two seconds, such a case is counter to generally accepted telephone conference protocols, and participants will generally avoid such scenarios.

Therefore, based on this observation of independent talking patterns in the single-user mode versus coordinated talking patterns in the conference mode, the automatic mode detector can detect which of the two modes the speakerphone is in by analyzing the talking patterns of different talkers over a given time period (e.g., up to tens of seconds). Most existing MMNR methods have the capability to distinguish talkers' voices if they come from different directions. Using the techniques described herein, within each talker's direction, all voice activities may be monitored by analyzing voice activities from different directions in the near end (the "Send" or "Up-link" signal), and in embodiments, the voice activity of the far-end signal (the "Receive" or "Down-link" signal) may be monitored as well) for a given time period such as over the last several tens of seconds, and the automatic mode detector is configured to determine whether the different talkers in the near end and the far end are talking independently or in a coordinated fashion (e.g., by taking turns). If the different talkers are talking independently (i.e., with much observed "double talk," or talking simultaneously), the automatic mode detector declares that the speakerphone is in a single-user mode; if the different talkers are talking in a coordinated fashion with no, or only very brief, simultaneous talking, then the automatic mode detector declares that the speakerphone is in a conference mode. In embodiments and with respect to FIG. 2, automatic mode detector 222 may receive statistics, mixtures, and probabilities 230 (and/or any other information indicative of talkers' voices) from on-line GMM modeling component 214, or from other components and/or sub-components of system 200. Further, as shown in FIG. 2, automatic mode detector 222 outputs mode enable signal 236 to SCS component 116 and to MMNR component 114 in accordance with the described embodiments.

In one embodiment, the communication device may start out in the conference mode by default after the call is connected to make sure conference participants' voices are not suppressed. After observing the talking pattern as described above, the automatic mode detector may then make a decision on which of the two modes the communication device is operating, and switch modes accordingly if necessary. For example, in one embodiment, an observation period of 30 seconds may be used to ensure a high level of confidence in the speaking patterns of the participants. The switching of modes does not have to be abrupt and can be done with gradual transition by gradually changing the MMNR parameters from one mode to the other mode over a transition region or period.

In another embodiment, a device manufacturer may decide to start a communication device such as a mobile phone in the single-user mode because a much higher percentage of telephone calls are in the single-user mode than in the conference mode. Thus, defaulting to the single-user mode to immediately suppress the background noise and interfering talkers' voices may likely be preferred. A device manufacturer may decide to start a communication device such as a conference phone in the conference mode because a much higher percentage of telephone calls are in the conference mode than in the single-user mode. Thus, defaulting to the conference mode may likely be preferred. In either case, after observing talking patterns for a number of seconds, the automatic mode detector will have enough confidence to detect the desired mode.

It should be noted that if two near-end talkers are talking from approximately the same direction (e.g., one talker may stand or sit behind another talker), then the front-end MMNR cannot "resolve" the two talkers by the angle of arrival of their voices at the microphones, so it will not be able to treat these two talkers as two separate talkers' voices when analyzing the talking pattern. However, in such a case the MMNR cannot suppress the voice of one of these two talkers but not the other, and therefore not being able to separately observe the two talkers' individual talking patterns does not pose an additional problem.

It should also be noted that including a far-end talker's voice activities in the consideration when analyzing the pattern of all talkers' voice activities may give a more ideal result, only considering the near-end talkers' voice activities and ignoring the far-end talker's voice activities results in an automatic mode detector that will also provide beneficial, mode-dependent suppression techniques.

It should further be noted that the techniques described above are not limited to use with the particular MMNR described herein. The described techniques are broadly applicable to other front-end MMNR methods that can distinguish talkers at different angles of arrival such that different talkers' voice activities can be individually monitored.

VII. Example Switched Super-Directive Beamformer (SSDB) Embodiments

The embodiments and techniques described herein also include improvements for implementations of beamformers.

For instance, a switched super-directive beamformer (SSDB) embodiment will now be described. The SSDB embodiments and techniques described allow for better diffuse noise suppression for the complete system, e.g., communication device 100 and/or system 200. The SSDB embodiments and techniques provide additional suppression of interfering sources to further improve adaptive-noise-canceller (ANC) performance. For example, traditional systems use a fixed filter in the front-end processing, where a desired sound source wavefront arrives, and the same model of the desired source wavefront is also used to create a blocking matrix for the ANC. In the described SSDB embodiments and techniques, the front-end processing is designed to pass the DS signal and to attenuate diffuse noise. Another important difference and improvement of the described embodiments and techniques is the modification of the beamformer beam weights using microphone data to correct for errors in the propagation model in conjugation with the switched beamforming.

As described above with respect to FIG. 2, SSDB 218 is configured to adjust a plurality of microphones toward a DS. SSDB 218 is configured to store calculated super-directive beamformer weights (which, in embodiments, may be calculated offline or may be pre-calculated) by dividing the acoustic space into fixed partitions. The acoustic space may be partitioned based on the number of microphones of the communication device and the geometry of the microphones with the partitioned acoustic space corresponding to a number of beams. Some beams may comprise a larger angle range, and thus be considered "wider" than other beams, and the width of each beam depends on the geometry of the microphones. Table 1 below shows an example of beam segments in a dual microphone embodiment. The selected beams may be defined by NULL beams in embodiments, as NULL beams may be narrower and provide improved directionality. A set (e.g., 1 or more) of beams may be selected to let the DS(s) pass (e.g., without attenuation or suppression) based on the direction (e.g., from TDOA) of the DS signal and supplemental information as described herein. In embodiments, a pair-wise relative transfer function (e.g., for each microphone pair) may be used to create super-directive beamformer weights for directing the beams of SSDB 218. Super-directive beamformer weights may be modified in the background based on the measured data of the acoustic scene in order to achieve robust SSDB 218 performance against the propagation of acoustic model errors.

Figure 6:
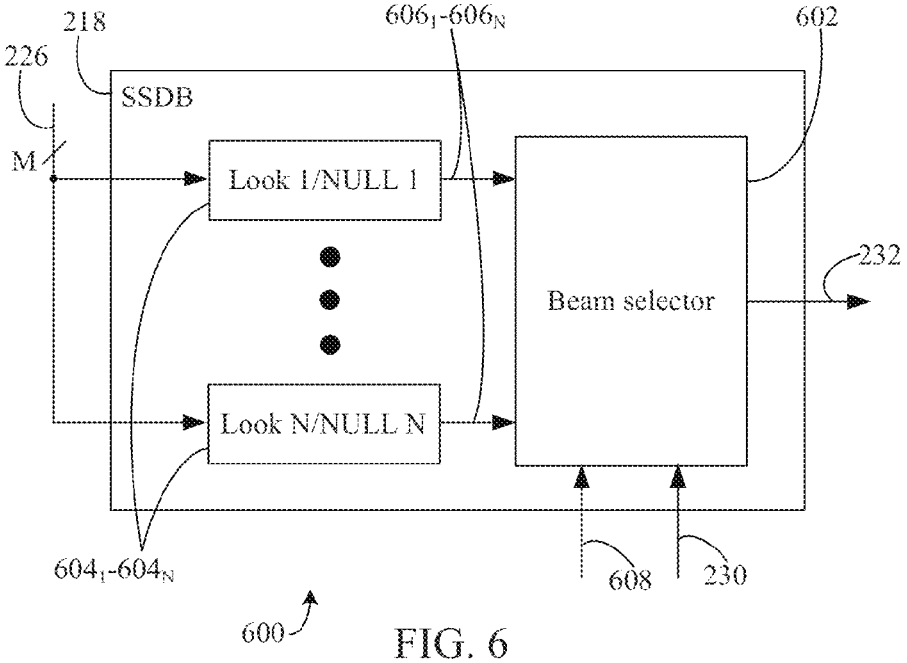
FIG. 6 shows a block diagram of an example switched super-directive beamformer, according to an example embodiment.

FIG. 6 shows a block diagram of an exemplary embodiment of an SSDB configuration 600. In embodiments, SSDB configuration 600 may be a further embodiment of SSDB 218 of FIG. 2 and is exemplarily described as such in FIG. 6. SSDB configuration 600 may be configured to perform the techniques described herein in various ways. As shown, SSDB configuration 600 includes SSDB 218 which comprises a beam selector 602 and "N" look/NULL components $\mathbf{604}_1$-$\mathbf{604}_N$. SSDB 218 receives M compensated microphone outputs 226, as described above for FIG. 2 (but with "N" microphone outputs for FIG. 2). Each of look/NULL components $\mathbf{604}_1$-$\mathbf{604}_N$ receives each of compensated microphone outputs 226 as described herein. Thus, if there are M microphones, there will be M−1 look/NULL components $\mathbf{604}_1$-$\mathbf{604}_N$ (shown as N look/NULL components $\mathbf{604}_1$-$\mathbf{604}_N$). Each of look/NULL components $\mathbf{604}_1$-$\mathbf{604}_N$ is configured to form a beam of beams $\mathbf{606}_1$-$\mathbf{606}_N$ (as shown in FIG. 6) and to weight its respective beam in accordance with the embodiments described herein. The weighted beams $\mathbf{606}_1$-$\mathbf{606}_N$ are provided to beam selector 602. Beam selector 602 also receives statistics, mixtures, and probabilities 230 (as described with respect to FIG. 2) from on-line GMM modeling component 214, and in embodiments may receive voice activity inputs 608 from a voice activity detector (VAD) (not shown) that is configured to detect voice activity in the acoustic scene. Beam selector 602 selects one of weighted beams $\mathbf{606}_1$-$\mathbf{606}_N$ as single-output selected signal 232 based on the received inputs.

In alternative embodiments, SSDB configuration 600 may select a beam associated with compensated microphone outputs 226 and then apply only the selected beam using the one component of look/NULL components $\mathbf{604}_1$-$\mathbf{604}_N$ that corresponds to the selected beam. In such embodiments, implementation complexity computational burden may be reduced as a single component of look/NULL components $\mathbf{604}_1$-$\mathbf{604}_N$ is applied, as described herein.

SSDB configuration 600 is configured to pre-calculate super-directive beamformer weights (also referred to as a "beam" herein) by dividing acoustic space into fixed segments (e.g., "N" segments as represented in FIG. 6) where each segment corresponds to a beam. In one example embodiment, as shown in Table 1 below, seven segments corresponding to seven beams may be utilized.

TABLE 1

Example Acoustic Space Segments

| | Lower Angle | Upper angle |
|---|---|---|
| Beam 1 | 0 | 40 |
| Beam 2 | 40 | 60 |
| Beam 3 | 60 | 80 |
| Beam 4 | 80 | 100 |
| Beam 5 | 100 | 120 |
| Beam 6 | 120 | 140 |
| Beam 7 | 140 | 180 |

A beam passes sound from the specified acoustic space, such as the space in which the DS is located, while attenuating sounds from other directions to reduce the effect of reflections interfering and noise sources. Based on the TDOA and in embodiments other supplemental information (e.g., statistics, mixtures, and probabilities 230 and/or voice activity inputs 608), a beam may be selected to let the desired source pass while attenuating reflections, interfering and noise sources.

In embodiments, SSDB configuration 600 is configured to generate super-directive beamformer weights using a minimum variance distortionless response (MVDR) for unit response and minimum noise variance. In embodiments, using a steering vector $D^H$ and a noise covariance matrix $R_n^{-1}$, a super-directive beamformer weight $W^H$ may be derived as:

$$W^H = \frac{D^H R_n^{-1}}{D^H R_n^{-1} D}. \tag{69}$$

In embodiments utilizing MVDR for unit response and NULL with minimum noise variance:

$$W^H = [10]([D_t|D_i]^H[R+\lambda I]^{-1}[D_t|D_i])^{-1}[D_t|D_i]^H[R+\lambda I]^{-1}, \tag{70}$$

where $\lambda$ is a regularization factor to control which-noise gain (WNG), $D_t$ is a steering vector, $D_i$ is a null steering vector, and [1 0] denotes minimum suppression.

In embodiments, SSDB configuration 600 is configured to generate super-directive beamformer weights using a minimum power distortionless response (MPDR). The MPDR techniques utilize the covariance matrix from the input audio signal. In embodiments, when far-field and free-field conditions are met, the steering vector may be used to create the covariance matrix.

In embodiments, SSDB configuration 600 is configured to generate super-directive beamformer weights using a weighted least squares (WLS) model. WLS uses direct minimization with constraints on the norm of coefficients to minimize WNG. For instance:

$$\min_w \|w^H D - b\|^2 \text{ such that } \|w\|^2 < \delta, \tag{71}$$

where D is the steering vector matrix, b is the beam shape, and δ is the WNG control.

In embodiments using direct optimization to control the NULL direction:

$$\min_w \|w^H D - b\|^2 \text{ such that } \|w\|^2 < \delta \text{ and } \|w^H Ds\|^2 < \gamma, \tag{72}$$

where Ds is the steering vector for NULLs and γ is the WNG control for NULLs.

Figure 7:
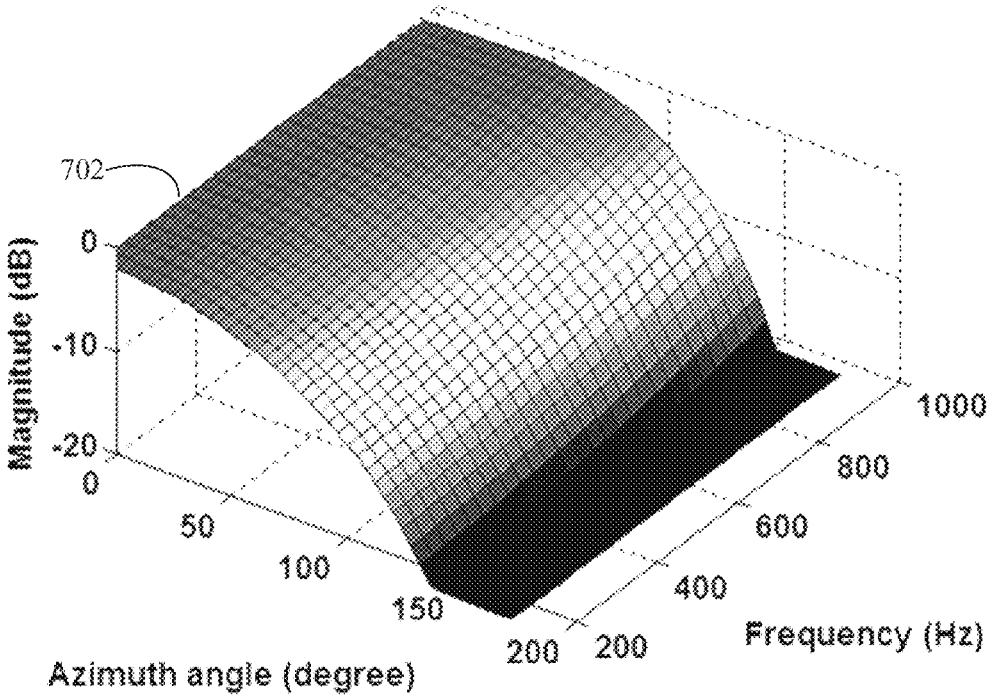
FIG. 7 shows example graphical plots of end-fire beams for a switched super-directive beamformer, according to an example embodiment.
Figure 7:
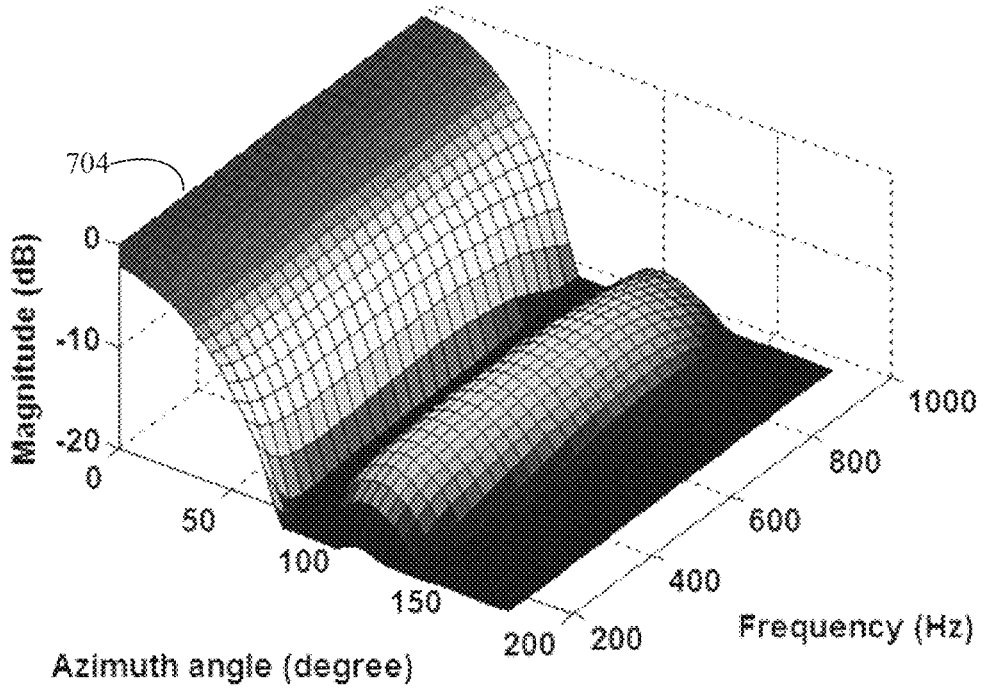

In applications of these embodiments, it can be shown that dual microphone implementations provide substantial attenuation of interfering sources as illustrated in FIG. 7. Attenuation graph comparison 700 shows a first attenuation graph 702 and a second attenuation graph 704. First attenuation graph 702 shows an attenuation plot for an end-fire beam of a dual-microphone implementation with a 3 dB cut-off at approximately 40°. Further attenuation may be achieved using more than two microphones. For example, second attenuation graph 704 shows an attenuation plot for an end-fire beam of a four-microphone implementation with a 3 dB cut-off at approximately 20°. As illustrated in FIG. 7, an increased number of microphones in a given implementation of the embodiments and techniques described herein provides for better directivity by using narrower beams. It should be noted that in embodiments with three or more microphones, microphone geometry and/or TDOA can advantageously be used in beam configuration. The number of beams configured may vary depending on the number of microphones and their corresponding geometries. For example, the greater the number of microphones, the greater the achievable spatial resolution of the super-directive beam.

In SSDB embodiments, the generation of super-directive beamformer weights may require noise covariance matrix calculations and recursive noise covariance updates. In practice, diffuse noise-field models may be used to calculate weights off-line, although on-line weight calculations are contemplated herein. In some embodiments, weights are calculated offline as inverting a matrix in real-time can be computationally expensive. An off-line weight calculation may begin according to a diffuse noise model, and the calculation may update if the running noise model differs significantly. Weights may be calculated during idle processing cycles to avoid excessive computational loads.

The SSDB embodiments also provide for hybrid SSDB implementations that allow an SSDB, e.g., SSDB 218, to operate according to a far-field model or a near-field model under a free-field assumption, or to operate according to a pairwise relative transfer function with respect to the primary microphone when a free-field assumption does not apply.

For example, under a free-field assumption, weight generation requires knowledge of sound source modeling with respect to microphone geometry. In embodiments, either far-field or near-field models may be used assuming microphones are in a free-field, and steering vectors with respect to a reference point can be designed based on full-band gain and delay. A steering vector at frequency ω in free-field for microphones M with polar coordinates $(r_1, \phi_1), (r_2, \phi_2), \ldots, (r_M, \phi_M)$ for a sound source with a wave front at speed c and at an angle ϕ can defined as:

$$d^H(\omega) = [a_1 e^{-j\omega\tau_1} a_2 e^{-j\omega\tau_2} a_M e^{-j\omega\tau_M}], \tag{73}$$

where $$a_i = \frac{\|r - r_i\|}{\|r\|}$$

and $\tau_i = r_i \cos(\phi - \phi_i)/c$.

Under a non-free-field assumption where free-field assumption may not be appropriate due to, e.g., microphones being shadowed in the body of a communication device or by the hand of a user, calculations as done in the case of a free-field cannot be used to calculate relative delay. In such cases, a pairwise relative transfer function with respect to a primary microphone can be used to create a steering vector. In embodiments, weight calculation may use an inverted noise covariance matrix (e.g., stored in memory) to save computational load. For instance:

$$d^H(\omega) = \left[1 \; \frac{E[X_1(\omega)X^*(\omega)]}{E[X(\omega)X^*(\omega)]} \; \cdots \; \frac{E[X_M(\omega)X^*(\omega)]}{E[X(\omega)X^*(\omega)]}\right], \tag{74}$$

where $X_i(\omega)$ is the $i^{th}$ microphone signal at frequency ω.

The SSDB embodiments thus provide for performance improvements over traditional delay-and-sum beamformers using conventional, adaptive beamforming components. For instance, through the above-described techniques, beam directivity is improved, and as narrow, directively improved beams are provided herein, increased beam width for end-fire beams allows for greater tracking of DS audio signals to accommodate for relative movements between the DS and the communication device. In one application with a DS at 0° and an interfering source at 180°, it has been empirically observed that for a DS audio input with a signal-to-interference ratio (SIR) of 7.6 dB, the SIR was approximately doubled using a conventional delay-and-sum beamformer approach, but the SIR was more than tripled using the SSDB techniques described herein for the same microphone pair.

VIII. Example Adaptive Noise Canceller (ANC) and Adaptive Blocking Matrix (BM) Embodiments Embodiments and techniques are also provided herein for an adaptive noise canceller (ANC) and for adaptive blocking matrices based on the tracking of underlying statistics. The embodiments described herein provide for improved noise cancellation using closed-form solutions for blocking matrices, using microphone pairs, and for adaptive noise cancelling using blocking matrix outputs jointly. Underlying statistics may be tracked based on source tracking information and super-directive beamforming information, as described herein. Techniques for closed-form adaptive noise cancelling solutions differ from traditional adaptive solutions at least in that the traditional, non-closed-form solutions do not track and estimate the underlying signal statistics over time, as described herein, thus providing a greater ability to generalize models. The described techniques allow for fast convergence without the risk of divergence or objectionable artifacts. The ANC and adaptive blocking matrices embodiments will now be described.

It should be noted that for descriptive focus upon the ANC and adaptive blocking matrices techniques and embodiments, these techniques and embodiments are described with respect to a standard delay-and-sum beamformer in the examples below. However, it is contemplated herein that the techniques and embodiments in this section are readily applicable and/or adaptable to the SSDB embodiments described above, and that such applicability and/or adaptability is fully intended in reference to the SSDB embodiments described above for techniques and embodiments in this section.

As noted herein, various techniques are provided for algorithms, devices, circuits, and systems for communication devices operating in a speakerphone mode, distinguished by not having close-talking microphones as in a handset mode. As a result of this distinction, all microphones in the speakerphone mode will receive audio inputs approximately the same level (i.e., a far-field assumption may be applied). Thus, a difference in microphone level for a desired source (DS) versus an interfering source cannot be exploited to control updates and/or adaptations of the techniques described herein. However, if directionality of a desired source is known, a beamformer can be used to reinforce the desired source, and blocking matrices can be used to suppress the desired source, as described in further detail below. As a result, the level difference between the speech reinforced signal of the DS and the speech suppressed signal(s) of interfering sources can be used to control updates and/or adaptations, much like the microphone signal(s) can be used directly if a close-talking microphone existed. An additional significant difference of a speakerphone mode compared to a handset mode is the likely significant relative movement between the telephone device and the DS, either from the DS moving, from the user moving the phone, or both. This circumstance necessitates tracking of the DS.

If the far-field assumption holds reasonably well in a speakerphone mode, then a delay-and-sum beamformer (or SSDB 218, according to embodiments) can be used to reinforce the desired source, and delay-and-difference beamformers can be used to suppress the desired source. If the far-field assumption does not hold, delay-and-weighted sum beamformers and/or delay-and-weighted difference beamformers may be required. This complicates matters as it is no longer sufficient to "only" track the DS by an estimate of the TDOA of the DS at multiple microphones. The ANC and adaptive blocking matrix embodiments and techniques can be configured to suppress the interfering sources in the speech reinforced signal based on the speech suppressed signal(s). In addition to tracking of the DS, the delay-and-sum beamformer (or SSDB 218), delay-and-difference beamformer, and the ANC, a microphone mismatch components (e.g., microphone mismatch estimation component 210 and microphone mismatch compensation component 208, as shown in FIG. 2 and described above) may be required for full realization of the described embodiments to remove microphone level mismatches.

For example, when a specific microphone is defined as the primary microphone, then all TDOAs can be estimated relative to this primary microphone, and the delay-and-difference beamforming can be carried out in pairs of two microphones as described above. Thus an M-microphone system (similarly described as an N-microphone herein), M−1 signals will be formed during the delay-and-difference beamforming and passed to the ANC, e.g., ANC 220. In the embodiments and techniques described herein, the delay-and-difference beamformer constitutes a blocking matrix (e.g., adaptive blocking matrix component 216 in embodiments). Furthermore, in practice, if there is a particular microphone closer to the desired source than others, it may be advantageous to define this as the reference microphone as noted above.

Figure 8:
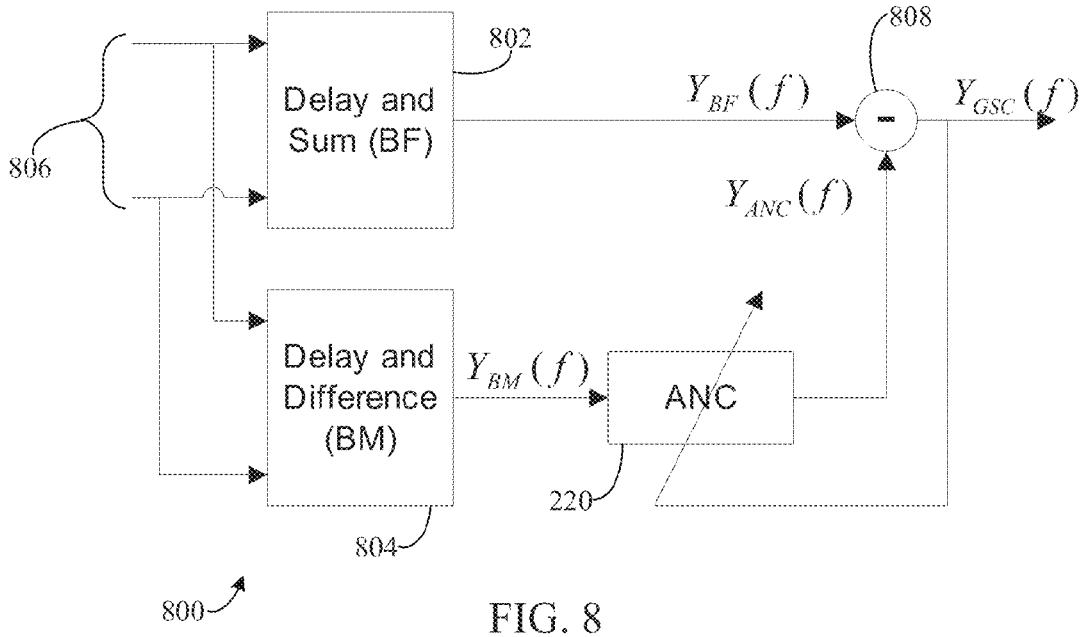
FIG. 8 shows a block diagram of a dual-microphone implementation for adaptive blocking matrices and an adaptive noise canceller, according to an example embodiment.

The examples described herein utilize a delay-and-sum beamformer, a delay-and-difference beamformers, and an ANC. In accordance with embodiments, a dual-microphone beamformer 800 is shown in FIG. 8. Dual-microphone beamformer 800 includes a delay-and-sum beamformer 802 (or substituted SSDB 218 according to embodiments), delay-and-difference beamformers 804, and ANC 220. As shown, two microphone inputs 806 are provided to a delay-and-sum beamformer 802 and delay-and-difference beamformers 804.

The delay-and-sum beamformer is given by:

$$Y_{BF}(f)=Y_1(f)\pm Y_2(f)\cdot e^{-j2\pi f\tau_{1,2}}. \tag{75}$$

The delay-and-difference beamformer is given by:

$$Y_{BM}(f)=Y_2(f)-Y_1(f)\cdot e^{j2\pi f\tau_{1,2}}, \tag{76}$$

and the ANC is carried out (using subtractor component 808) according to:

$$Y_{GSC}(f)=Y_{BF}(f)-W_{ANC}(f)\cdot Y_{BM}(f). \tag{77}$$

The variable $\tau_{1,2}$ represents the TDOA of the DS on the two microphones, and $Y_{GSC}(f)$ corresponds to noise-cancelled DS signal 240.

Figure 9:
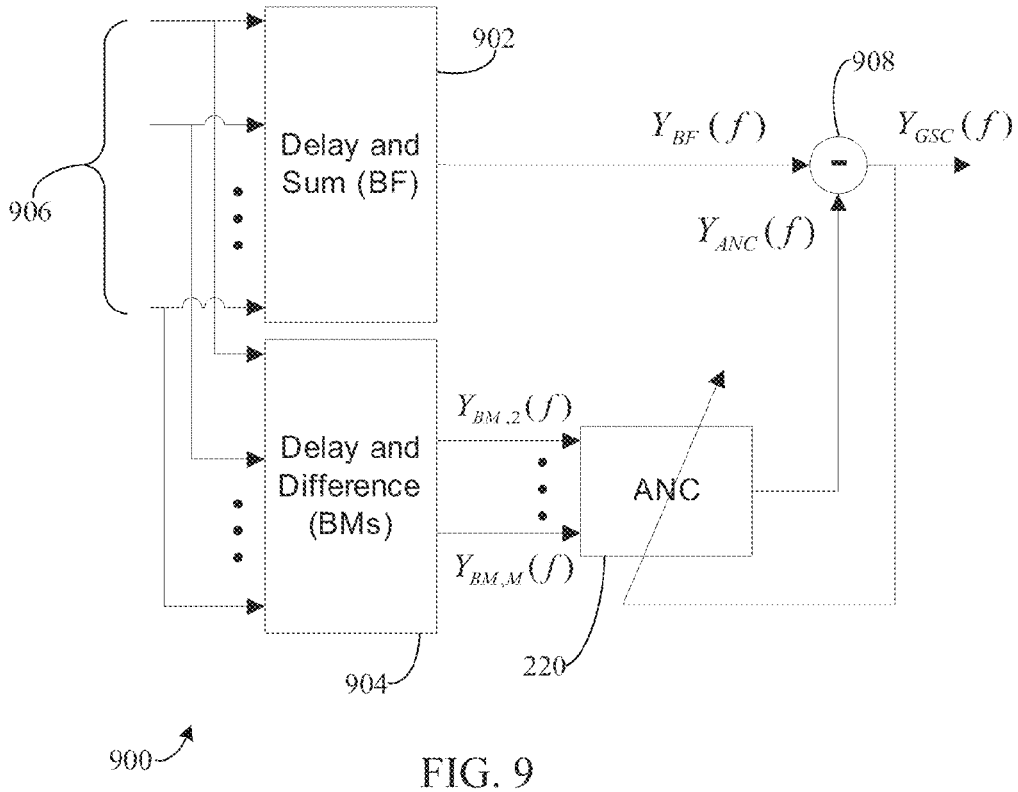
FIG. 9 shows a block diagram of a multi-microphone (greater than two) implementation for adaptive blocking matrices and an adaptive noise canceller, according to an example embodiment.

FIG. 9 shows a multi-microphone beamformer 900 which may be a further embodiment of dual-microphone beamformer 800 of FIG. 8. Multi-microphone beamformer 900 includes a delay-and-sum beamformer 902, delay-and-difference beamformers 904, and ANC 220. As shown in FIG. 9, rather than a dual-microphone embodiment, a general, multi-microphone embodiment 900 embodies M microphones with M microphone inputs 906. M microphone inputs 906 are provided to a delay-and-sum beamformer 902 and delay-and-difference beamformers 904.

The general delay-and-sum beamformer is given by $$Y_{BF}(f) = Y_1(f) + \sum_{m=2}^{M} Y_m(f)\cdot e^{-j2\pi f\tau_{1,m}}. \tag{78}$$

The delay-and-difference beamformers are given by $$Y_{BM,m}(f)=Y_m(f)-Y_1(f)\cdot e^{j2\pi f\tau_{1,m}}, m=2,3,\ldots,M, \tag{79}$$

and the ANC is carried out (using subtractor component 908) according to:

$$Y_{GSC}(f) = Y_{BF}(f) - \sum_{m=2}^{M} W_{ANC,m}(f)\cdot Y_{BM,m}(f). \tag{80}$$

In the above three equations the delays $\tau_{1,m}$, m==2, 3, . . . M represent the TDOAs between the primary microphone and the remaining supporting microphones in pairs of two, as described herein, and $Y_{GSC}(f)$ corresponds to noise-cancelled DS signal 240.

In the described beamforming techniques, the objective of the ANC is to minimize the output power of interfering sources to improve overall DS output. According to embodiments, this may be achieved with continuous updates if the blocking matrices are perfect, or it can be achieved by adaptively controlling the update of the necessary statistics according to speech presence probability (e.g., "no" update if speech presence probability is 1, "full" update if speech presence probability is 0, and a "partial" update when speech presence probability is neither 1 nor 0). Consistent with the objective of the ANC, the closed-form ANC techniques herein essentially require knowledge of the noise statistics of the internal signals, (i.e., the delay-and-sum beamformer output and the multiple delay-and-difference blocking matrix outputs). In practice, this can translate to mapping speech presence probability to a smoothing factor for the running mean estimation of the noise statistics, where the smoothing factor is 1 for speech, an optimal value during noise only, and between 1 and the optimal value during uncertainty. For dual-microphone handset modes, the microphone-level difference is used to estimate the speech presence probability by exploiting the near-field property of the primary microphone. This does not apply to speakerphone modes due to the predominantly far-field property that generally applies. However, the difference in level between the speech-reinforced signal and the speech-suppressed signal can be used in a similar manner.

For example, in embodiments, the object of the ANC, to minimize output power of interfering sources, may be represented as:

$$\begin{aligned} E_{Y_{GSC}} &= E\{y_{GSC}^2(n)\} \\ &\approx \sum_n y_{GSC}^2(n) \\ &= \sum_m \sum_f Y_{GSC}(m,f)\cdot Y_{GSC}^*(m,f), \end{aligned} \tag{81}$$

where n is the discrete time index, m is the frame index for the DFTs, and f is the frequency index. The output is expanded as:

$$\begin{aligned} Y_{GSC}(m,f) &= Y_{BF}(m,f) - Y_{ANC}(m,f) \\ &= Y_{BF}(m,f) - \sum_{l=2}^{M} W_{ANC}(l,f)\cdot Y_{BM,l}(m,f). \end{aligned} \tag{82}$$

Allowing the ANC taps, $W_{ANC}(l,f)$, to be complex prevents taking the derivative with respect to the coefficients due to the complex conjugate (of $Y_{GSC}(m,f)$) not being differentiable. The complex conjugate does not satisfy the Cauchy-Riemann equations. However, since the cost function of Eq. 81 is real, the gradient can be calculated as:

$$\nabla(E_{Y_{GSC}}) = \frac{\partial E_{Y_{GSC}}}{\partial \mathrm{Re}\{W_{ANC}(l,f)\}} + j\frac{\partial E_{Y_{GSC}}}{\partial \mathrm{Im}\{W_{ANC}(l,f)\}}, \quad l = 2, 3, \ldots M. \tag{83}$$

Thus, the gradient will be with respect to M−1 complex taps and result in a system of equations to solve for the complex ANC taps. The gradient with respect to a particular complex tap, $W_{ANC}(k,f)$ is expanded as:

$$\begin{aligned} \nabla_{W_{ANC}(k,f)}(E_{Y_{GSC}}) &= \frac{\partial E_{Y_{GSC}}}{\partial \mathrm{Re}\{W_{ANC}(k,f)\}} + j\frac{\partial E_{Y_{GSC}}}{\partial \mathrm{Im}\{W_{ANC}(k,f)\}} \\ &= \sum_m Y_{GSC}^*(m,f)\frac{\partial Y_{GSC}(m,f)}{\partial \mathrm{Re}\{W_{ANC}(k,f)\}} + Y_{GSC}(m,f)\frac{\partial Y_{GSC}^*(m,f)}{\partial \mathrm{Re}\{W_{ANC}(k,f)\}} + j\sum_m Y_{GSC}^*(m,f)\frac{\partial Y_{GSC}(m,f)}{\partial \mathrm{Im}\{W_{ANC}(k,f)\}} + Y_{GSC}(m,f)\frac{\partial Y_{GSC}^*(m,f)}{\partial \mathrm{Im}\{W_{ANC}(k,f)\}} \\ &= \sum_m -Y_{GSC}^*(m,f)Y_{BM,k}(m,f) - Y_{GSC}(m,f)Y_{BM,k}^*(m,f) + j\sum_m -Y_{GSC}^*(m,f)jY_{BM,k}(m,f) + Y_{GSC}(m,f)jY_{BM,k}^*(m,f) \\ &= -2\sum_m Y_{GSC}(m,f)Y_{BM,k}^*(m,f) \\ &= -2\sum_m \left(Y_{BF}(m,f) - \sum_{l=2}^{M} W_{ANC}(l,f)Y_{BM,l}(m,f)\right) Y_{BM,k}^*(m,f) \\ &= 2\sum_{l=2}^{M} W_{ANC}(l,f)\left(\sum_m Y_{BM,l}(m,f)Y_{BM,k}^*(m,f)\right) - 2\left(\sum_m Y_{BM}(m,f)Y_{BM,k}^*(m,f)\right). \end{aligned} \tag{84}$$

The set of M−1 equations (for k=2, 3, . . . M) of Eq. 84 provides a matrix equation for every frequency bin f to solve for $W_{ANC}(k,f)$ k=2, 3, . . . M−1:

$$\begin{bmatrix} \sum_m Y_{BM,2}(m,f)Y_{BM,2}^*(m,f) & \sum_m Y_{BM,3}(m,f)Y_{BM,2}^*(m,f) & \cdots & \sum_m Y_{BM,M}(m,f)Y_{BM,2}^*(m,f) \\ \sum_m Y_{BM,2}(m,f)Y_{BM,3}^*(m,f) & \sum_m Y_{BM,3}(m,f)Y_{BM,3}^*(m,f) & \cdots & \sum_m Y_{BM,M}(m,f)Y_{BM,3}^*(m,f) \\ \vdots & \vdots & \ddots & \vdots \\ \sum_m Y_{BM,2}(m,f)Y_{BM,M}^*(m,f) & \sum_m Y_{BM,3}(m,f)Y_{BM,M}^*(m,f) & \cdots & \sum_m Y_{BM,M}(m,f)Y_{BM,M}^*(m,f) \end{bmatrix} \begin{bmatrix} W_{ANC}(2,f) \\ W_{ANC}(3,f) \\ \vdots \\ W_{ANC}(M,f) \end{bmatrix} = \tag{85}$$

-continued $$\begin{bmatrix} \sum_m Y_{BF}(m,f)Y^*_{BM,2}(m,f) \\ \sum_m Y_{BF}(m,f)Y^*_{BM,3}(m,f) \\ \vdots \\ \sum_m Y_{BF}(m,f)Y^*_{BM,M}(m,f) \end{bmatrix}.$$

This solution can be written as:

$$\underline{\underline{R}}_{Y_{BM}}(f)\cdot\underline{W}_{ANC}(f)=r_{Y_{BF},Y^*_{BM}}(f), \tag{86}$$

where $$\underline{\underline{R}}_{Y_{BM}}(f)=\sum_m \underline{Y}^*_{BM}(m,f)\cdot\underline{Y}_{BM}(m,f)^T, \tag{87}$$

$$r_{Y_{BF},Y^*_{BM}}(f)=\sum_m Y_{BF}(m,f)\cdot\underline{Y}^*_{BM}(m,f), \tag{88}$$

$$\underline{Y}_{BM}(m,f)=\begin{bmatrix} Y_{BM,2}(m,f) \\ Y_{BM,3}(m,f) \\ \vdots \\ Y_{BM,M}(m,f) \end{bmatrix}, \tag{89}$$

$$\underline{W}_{ANC}(f)=\begin{bmatrix} W_{ANC}(2,f) \\ W_{ANC}(3,f) \\ \vdots \\ W_{ANC}(M,f) \end{bmatrix},$$

and superscript "T" denotes the non-conjugate transpose. The solution per frequency bin to the ANC taps on the outputs from the blocking matrices is given by:

$$\underline{W}_{ANC}(f)=(\underline{R}_{Y_{BM}}(f))^{-1}\cdot r_{Y_{BF},Y_{BM}}(f). \tag{90}$$

This appears to require a matrix inversion of an order equivalent to the number of microphones minus one (M−1). Accordingly, for a dual microphone system it becomes a simple division. Although it requires a matrix inversion in general, in most practical applications this is not needed. Up to order 4 (i.e., for 5 microphones) closed-form solutions may be derived to solve Eq. 86. It should be noted that the correlation matrix $\underline{R}_{Y_{BM}}(f)$ is Hermitian (although not Toeplitz in general).

The closed-form solution of Eq. 90 requires an estimation of the statistics given by Eqs. 87 and 88 of interfering sources such as ambient noise and competing talkers. This can be achieved as outlined above in this Section.

In embodiments where a simple delay and difference beamformer is inadequate as a blocking matrix, a delay-and-weighted difference beamformer may be utilized. In such an embodiment, the phase may be given by the estimated TDOA from the tracking of the DS, but the magnitude may require estimation. The objective of the blocking matrix is to minimize the speech presence in the supporting microphone signals under the phase constraint. The cost function is given by:

$$\begin{aligned} E_{Y_{BM,m}} &= E\{y^2_{BM,m}(n)\} \\ &\approx \sum_n y^2_{BM,m}(n) \\ &= \sum_m \sum_f Y_{BM,m}(m,f)\cdot Y^*_{BM,m}(m,f), \end{aligned} \tag{91}$$

where the blocking matrix output is now given by:

$$Y_{BM,m}(f)=Y_m(f)-|W_{BM,m}|Y_1(f)\cdot e^{j2\pi f\tau_{1,m}}, m=2,3,\ldots,M. \tag{92}$$

In alternative embodiments, some deviation in phase may be advantageously allowed. This can be achieved by deriving the unconstrained solution, which will become a function of various statistics described herein. The estimation of the statistics can be carried out as a running mean where the update is contingent upon the presence of the DS, where the phase of the cross-spectrum at the given bin is within a certain range of the estimated TDOA. Such a technique will allow for variation of the TDOA over frequency within a range of the estimated full-band TDOA, and will accommodate spectral shaping of the channel between two microphones. The unconstrained solution is given by:

$$W_{BM,m}(f)=\frac{r_{Y_m,Y^*_1}(f)}{R_{Y_1,Y^*_1}(f)}, \tag{93}$$

where $$r_{Y_m,Y^*_1}(f)=\sum_l Y_m(l,f)Y^*_1(l,f), \tag{94}$$

and $$R_{Y_1,Y^*_1}(f)=\sum_m Y_1(l,f)Y^*_1(l,f). \tag{95}$$

The averaging is made contingent upon the phase being within some range of the phase corresponding to the estimated TDOA, e.g.:

$$r_{Y_m,Y^*_1}(f)=\sum_{l|\angle(Y_m(l,f),Y)_1(l,f)\in[tdoa(f)-\delta;tdoa(f)+\delta]} Y_m(l,f)Y^*_1(l,f), \tag{96}$$

and similar for $R_{Y_1,Y_1^*}(f)$ if a correspondence of segments over which statistics are calculated is desirable.

According to an embodiment, a solution with even greater flexibility includes a fully adaptive set of blocking matrices, where both phase and magnitude are determined according to Eq. 93:

$$W_{BM,j}(m, f) = \frac{r_{Y_j,Y_1^*}(m, f)}{R_{Y_1,Y_1^*}(m, f)}, \tag{97}$$

(noting the switch from index m to j for the bin), where the required statistics are estimated adaptively according to:

$$R_{Y_1,Y_1^*}(m,f)=\alpha_{track}\cdot R_{Y_1,Y_1^*}(m-1,f)+(1-\alpha_{track})\cdot Y_1(m,f)\cdot Y_1^*(m,f), \tag{98}$$

and $$r_{Y_1,Y_j^*}(m,f)=\alpha_{track,j}\cdot r_{Y_1Y_j^*}(m-1,f)+(1-\alpha_{track,j})\cdot Y_j(m,f)\cdot Y_1^*(m,f), \tag{99}$$

where the leakage factors are controlled according to probability of DS speech presence. Such control can be achieved based on information from a source tracking component (e.g., source tracker 512 of FIG. 5 or on-line GMM model component 214), and the blocking matrices will not explicitly use the full-band TDOA from a source tracking component. The phase of the fully adaptive blocking matrices approximately follows that of the TDOA for the delay-and-difference blocking matrices. It has been empirically shown experimentally according to the described embodiments that the magnitude deviates significantly from unity, and hence improved performance is expected from the fully adaptive blocking matrices. The advantageous effect of using the delay-and-difference blocking matrices has been empirically shown experimentally (with a primary user (the DS) sitting at a table in a reverberant office environment holding a phone in his hand at approximately 1-2 feet, at 0° angle, and a competing talker standing at 90° at a distance of approximately 5 feet) with significant improvements in DS signal quality and clarity.

IX. Example Single-Channel Suppression Embodiments

Figure 10:
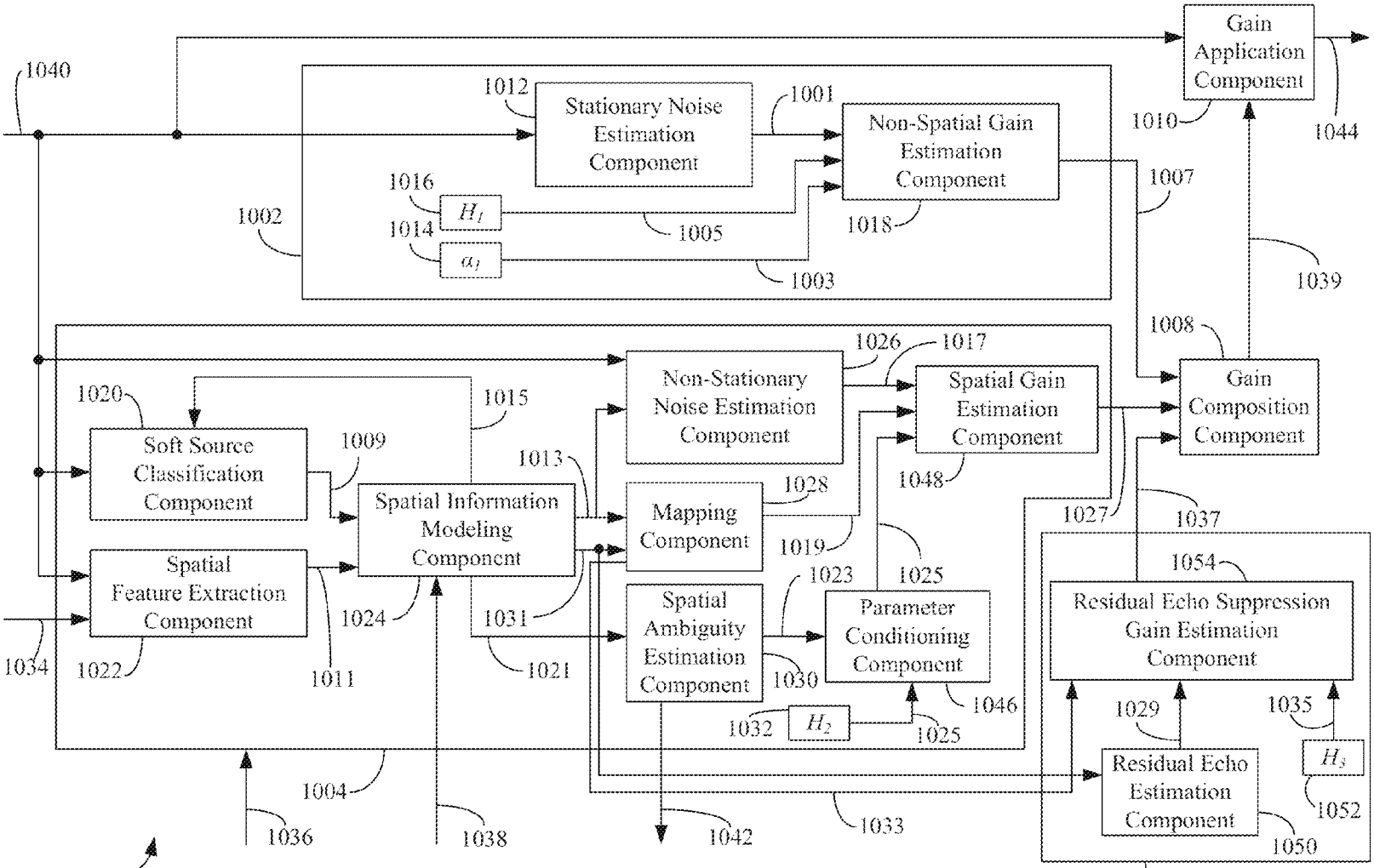
FIG. 10 shows a block diagram of a single-channel suppression component, according to an example embodiment.

Techniques and embodiments are also provided herein for single-channel suppression (SCS). For example, FIG. 10 is a block diagram of a back-end single-channel suppression (SCS) component 1000 in accordance with an embodiment. Back-end SCS component 1000 may be configured to receive a first signal 1040 and a second signal 1034 and provide a suppressed signal 1044. In accordance the embodiments described herein, suppressed signal 1044 may correspond to suppressed signal 244, as shown in FIG. 2. First signal 1040 may be suppressed signal provided by a multi-microphone noise reduction (MMNR) component (e.g., MMNR component 114), and second signal 1034 may be a noise estimate provided by the MMNR component that is used to obtain first signal 1040. Back-end SCS component 1000 may comprise an implementation of back-end SCS component 116, as described above in reference to FIGS. 1 and 2. In accordance with such an embodiment, first signal 1040 may correspond to noise-cancelled DS signal 240 (as shown in FIG. 2), and second signal 1034 may correspond to non-DS beam signals 234 (as shown in FIG. 2). As shown in FIG. 10, back-end SCS component 1000 includes non-spatial SCS component 1002, spatial SCS component 1004, residual echo suppression component 1006, gain composition component 1008, and gain application component 1010.

Non-spatial SCS component 1002 may be configured to estimate a non-spatial gain associated with stationary noise included in first signal 1040. As shown in FIG. 10, non-spatial SCS component 1002 includes stationary noise estimation component 1012, first parameter provider 1014, second parameter provider 1016, and non-spatial gain estimation component 1018. Stationary noise estimation component 1012 may be configured to provide a stationary noise estimation 1001 of stationary noise present in first signal 1040. The estimate may be provided as a signal-to-stationary noise ratio of first signal 1040 on a per-frame basis. The signal-to-stationary noise ratio may be based on a GMM modeling of non-spatial information obtained from first signal 1040. By using GMM modeling, a probability that a particular frame of first signal 1040 is a desired source (e.g., speech) and a probability that the particular frame of first signal 1040 is a non-desired source (e.g., an interfering source, such as stationary background noise) may be determined. In accordance with an embodiment, the signal-to-stationary noise ratio for a particular frame may be equal to the probability that the particular frame is a desired source divided by the probability that the particular frame is a non-desired source.

First parameter provider 1014 may configured to obtain and provide a value of a first tradeoff parameter $\alpha_1$ 1003 that specifies a degree of balance between distortion of the desired source included in first signal 1040 and unnaturalness of residual noise included in suppressed signal 1044. In one embodiment, the value of first tradeoff parameter $\alpha_1$ 1003 comprises a fixed aspect of back-end SCS component 1000 that is determined during a design or tuning phase associated with that component. Alternatively, the value of first tradeoff parameter $\alpha_1$ 1003 may be determined in response to some form of user input (e.g., responsive to user control of settings of a device that includes back-end SCS component 1000).

In a still further embodiment, first parameter provider 1014 adaptively determines the value of first tradeoff parameter $\alpha_1$ 1003. For example, first parameter provider 1014 may adaptively determine the value of first tradeoff parameter $\alpha_1$ 1003 based at least in part on the probability that a particular frame of the first signal 1040 is a desired source (as described above). For instance, if the probability that a particular frame of first signal 1040 is a desired source is high, first parameter provider 1014 may vary the value of first tradeoff parameter $\alpha_1$ 1003 such that an increased emphasis is placed on minimizing the distortion of the desired source during frames including the desired source. If the probability that the particular frame of first signal 1040 is a desired source is low, first parameter provider 1014 may vary the value of first tradeoff parameter $\alpha_1$ 1003 such that an increased emphasis is placed on minimizing the unnaturalness of the residual noise signal during frames including a non-desired source.

In addition to, or in lieu of, adaptively determining the value of first tradeoff parameter $\alpha_1$ 1003 based on a probability that a particular frame of first signal 1040 is a desired source, first parameter provider 1014 may adaptively determine the value of first tradeoff parameter $\alpha_1$ 1003 based on modulation information. For example, first parameter provider 1014 may determine the energy contour of first signal 1040 and determine a rate at which the energy contour is changing. It has been observed that an energy contour of a signal that changes relatively fast equates to the signal including a desired source; whereas an energy contour of a signal that changes relatively slow equates to the signal including an interfering stationary source. Accordingly, in response to determining that the rate at which the energy contour of first signal 1040 changes is relatively fast, first parameter provider 1014 may vary the value of first tradeoff parameter $\alpha_1$ 1003 such that an increased emphasis is placed on minimizing the distortion of the desired source during frames including the desired source. In response to determining that the rate at which the energy contour of first signal 1040 changes is relatively slow, first parameter provider 1014 may vary the value of first tradeoff parameter $\alpha_1$ 1003 such that an increased emphasis is placed on minimizing the unnaturalness of the residual noise signal during frames including a non-desired source. Still other adaptive schemes for setting the value of first tradeoff parameter $\alpha_1$ 1003 may be used.

Second parameter provider 1016 may be configured to obtain and provide a value of a first target suppression parameter $H_1$ 1005 that specifies an amount of attenuation to be applied to the additive stationary noise included in first signal 1040. In one embodiment, the value of first target suppression parameter $H_1$ 1005 comprises a fixed aspect of back-end SCS component 1000 that is determined during a design or tuning phase associated with that component. Alternatively, the value of first target suppression parameter $H_1$ 1005 may be determined in response to some form of user input (e.g., responsive to user control of settings of a device that includes back-end SCS first target suppression 1000). In a still further embodiment, second parameter provider 1016 adaptively determines the value of first target suppression parameter $H_1$ 1005 based at least in part on characteristics of first signal 1040. In accordance with any these embodiments, the value of first target suppression parameter $H_1$ 1005 may be constant across all frequencies of first signal 1040, or alternatively, the value of first target suppression parameter $H_1$ 1005 may very per frequency bin of first signal 1040.

Non-spatial gain estimation component 1018 may be configured to determine and provide a non-spatial gain estimation 1007 of a non-spatial gain associated with stationary noise included in first signal 1040. Non-spatial gain estimation 1007 may be based on stationary noise estimate 1001 provided by stationary noise estimation component 1012, first tradeoff parameter $\alpha_1$ 1003 provided by first parameter provider 1014, and first target suppression parameter $H_1$ 1005 provided by second parameter provider 1016, as shown below in accordance with Eq. 100:

$$G_1(f) = \frac{\alpha_1(f)SNR_1(f) + (1 - \alpha_1(f))H_1(f)}{\alpha_1(f)SNR_1(f) + (1 - \alpha_1(f))}, \tag{100}$$

where $G_1(f)$ corresponds to the non-spatial gain estimation 1007 of first signal 1040, $SNR_1(f)$ corresponds to stationary noise estimate 1001 that is present in first signal 1040.

Spatial SCS component 1004 may be configured to estimate a spatial gain associated with first signal 1040. As shown in FIG. 10, spatial SCS component 1004 includes a soft source classification component 1020, a spatial feature extraction component 1022, a spatial information modeling component 1024, a non-stationary noise estimation component 1026, a mapping component 1028, a spatial ambiguity estimation component 1030, a third parameter provider 1032, a parameter conditioning component 1046, and a spatial gain estimation component 1048.

Soft source classification component 1020 may be configured to obtain and provide a classification 1009 for each frame of first signal 1040. Classification 1009 may indicate whether a particular frame of first signal 1040 is either a desired source or a non-desired source. In accordance with an embodiment, classification 1009 is provided as a probability as to whether a particular frame is a desired source or a non-desired source, where higher the probability, the more likely that the particular frame is a desired source. In accordance with an embodiment, soft source classification component 1020 is further configured to classify a particular frame of first signal 1040 as being associated with a target speaker. In accordance with such an embodiment, spatial SCS component 1004 may include a speaker identification component (or may be coupled to speaker identification component) that assists in determining whether a particular frame of first signal 1040 is associated with a target speaker.

Spatial feature extraction component 1022 may be configured to extract and provide features 1011 from each frame of first signal 1040 and second signal 1034. Examples of features that may be extracted include, but are not limited to, linear spectral amplitudes (power, magnitude amplitudes, etc.).

Spatial information modeling component 1024 may be configured to further distinguish between desired source(s) and non-desired source(s) in first signal 1040 using GMM modeling of spatial information. For example, spatial information modeling component 1024 may be configured to determine and provide a probability 1013 that a particular frame of first signal 1040 includes a desired source or a non-desired source. Probability 1013 may be based on a ratio between features 1011 associated with first signal 1040 and second signal 1034. The ratios may be modeled using a GMM. For example, at least one mixture of the GMM may correspond to a distribution of a non-desired source, and at least one other mixture of the GMM may correspond to a distribution of a desired source. The at least one mixture corresponding to the desired source may be updated using features 1011 associated with first signal 1040 when classification 1009 indicates that a particular frame of first signal 1040 is from a desired source, and the at least one mixture corresponding to the non-desired source may be updated using features 1011 that are associated with second signal 1034 when classification 1009 indicates that the particular frame of first signal 1040 is from a non-desired source.

To determine which mixture corresponds to the desired source and which mixture corresponds to the non-desired source, spatial information modeling component 1024 may monitor the mean associated with each mixture. The mixture having a relatively higher mean equates to the mixture corresponding to a desired source, and the mixture having a relatively lower mean equates to the mixture corresponding to a non-desired source.

In accordance with an embodiment, probability 1013 may be based on a ratio between the mixture associated with the desired source and the mixture associated with the non-desired source. For example, probability 1013 may indicate that first signal 1040 is from a desired source if the ratio is relatively high, and probability 1013 may indicate that first signal 1040 is from a non-desired source if the ratio is relatively low. In accordance with an embodiment, the ratios may be determined for a plurality of frequency ranges of first signal 1040. For example, a ratio associated with the wideband of first signal 1040 and a ratio associated with the narrowband of first signal 1040 may be determined. In accordance with such an embodiment, probability 1013 is based on a combination of these ratios.

Spatial information modeling component 1024 may also provide a feedback signal 1015 that causes soft source classification component 1020 to update classification 1009. For example, if spatial information modeling component 1024 determines that a particular frame of first signal 1040 is from a desired source (i.e., probability 2013 is relatively high), then, in response to receiving feedback signal 1015, soft source classification component 1020 updates classification 1009.

Non-stationary noise estimation component 1026 may be configured to provide a noise estimate 1017 of non-stationary noise present in first signal 1040. The estimate may be provided as a signal-to-non-stationary ratio noise present in first signal 1040 on a per-frame basis. In accordance with an embodiment, the signal-to-non-stationary noise ratio for a particular frame may be equal to the probability that the particular frame is from a desired source divided by the probability that the particular frame is a from a non-desired source (e.g., non-stationary noise).

Mapping component 1028 may be configured to heuristically map probability 2013 to second tradeoff parameter $\alpha_2$ 1019, which is provided to spatial gain estimation component 1048. For instance, if probability 2013 is relatively high (i.e., a particular frame of first signal 1040 is likely from a desired source), mapping component 1028 may vary the value of second tradeoff parameter $\alpha_2$ 1019 such that an increased emphasis is placed on minimizing the distortion of the desired source during frames including the desired source. If probability 2013 is relatively low (i.e., the particular frame of first signal 1040 is likely from a non-desired source), mapping component 1028 may vary second tradeoff parameter $\alpha_2$ 1019 such that an increased emphasis is placed on minimizing the unnaturalness of the residual noise signal during frames including the non-desired source.

Spatial ambiguity estimation component 1030 may be configured to determine and provide a measure of spatial ambiguity 1023. Measure of spatial ambiguity 1023 may be indicative of how well spatial SCS component 1004 is able to distinguish a desired source from non-stationary noise. Measure of spatial ambiguity 1023 may be determined based on GMM information 1021 that is provided by spatial information modeling component 1024. In accordance with an embodiment, GMM information 1021 may include the means for each of the mixtures of the GMM modeled by spatial information modeling component 1024. In accordance with such an embodiment, if the mixtures of the GMM are not easily separable (i.e., the means of each mixture are relatively close to one another such that a particular mixture cannot be associated with a desired source or a non-desired source (e.g., non-stationary noise), the value of measure of spatial ambiguity 1023 may be set such that it is indicative of spatial SCS component 1004 being in a spatially ambiguous state. In contrast, if the mixtures of the GMM are easily separable (i.e., a mean of one mixture is relatively high, and the mean of the other mixture is relatively low), the value of measure of spatial ambiguity 1023 may be set such that it is indicative of spatial SCS component 1004 being in a spatially unambiguous state, i.e., in a spatially confident state. As will be described below, in response to determining that spatial SCS component 1004 is in a spatially ambiguous state, spatial SCS component 1004 may be soft-disabled (i.e., the gain estimated for the non-stationary noise is not used to suppress non-stationary noise from first signal 1040).

In accordance with an embodiment, in response to determining that spatial SCS component 1004 is in a spatially ambiguous state, spatial ambiguity estimation component 1030 provides a soft-disable output 1042, which is provided to MMNR component 114 (as shown in FIG. 2). Soft-disable output 1042 may cause one or more components and/or subcomponents of MMNR component 114 to be disabled. In accordance with such an embodiment, soft-disable output 1042 may correspond to soft-disable output signal 242, as shown in FIG. 2.

Third parameter provider 1032 may be configured to obtain and provide a value of a second target suppression parameter $H_2$ 1025 that specifies an amount of attenuation to be applied to the non-stationary noise included in first signal 1040. In one embodiment, the value of second target suppression parameter $H_2$ 1025 comprises a fixed aspect of back-end SCS component 1000 that is determined during a design or tuning phase associated with that component. Alternatively, the value of second target suppression parameter $H_2$ 1025 may be determined in response to some form of user input (e.g., responsive to user control of settings of a device that includes back-end SCS component 1000). In a still further embodiment, third parameter provider 1032 adaptively determines the value of second target suppression parameter $H_2$ 1025 based at least in part on characteristics of first signal 1040. In accordance with any these embodiments, the value of second target suppression parameter $H_2$ 1025 may be constant across all frequencies of first signal 1040, or alternatively, the value of second target suppression parameter $H_2$ 1025 may vary per frequency bin of first signal 1040.

Parameter conditioning component 1046 may be configured to condition second target suppression parameter $H_2$ 1025 based on measure of spatial ambiguity 1023 to provide a conditioned version of second target suppression parameter $H_2$ 1025. For example, if measure of spatial ambiguity 1023 indicates that spatial SCS component 1004 is in a spatially ambiguous state, parameter conditioning component 1046 may set the value of second target suppression parameter $H_2$ 1025 to a relatively large value close to 1 such that the resulting gain estimated by spatial gain estimation component 1048 is also relatively close to 1. As will be described below, gain composition component 1008 may be configured to determine the lesser of the gain estimates provided by non-spatial gain estimation component 1018 and spatial gain estimation component 1048. The determined lesser gain estimate is then used to suppress the non-desired source from first signal 1040. Accordingly, if the resulting gain estimated by spatial gain estimation component 1048 is a relatively large value, gain composition component 1008 will determine that the gain estimate provided by non-spatial gain estimation component 1018 is the lesser gain estimate, thereby rendering spatial SCS component 1004 effectively disabled.

If measure of spatial ambiguity 1023 indicates that spatial SCS component 1004 is in a spatially unambiguous state, parameter conditioning component 1046 may be configured to pass second target suppression parameter $H_2$ 1025, unconditioned, to spatial gain estimation component 1048.

Spatial gain estimation component 1048 may be configured to determine and provide an estimation 1027 of a spatial gain associated with non-stationary noise included in first signal 1040. Spatial gain estimate 1027 may be based on non-stationary noise estimate 1017 provided by non-stationary noise estimation component 1026, second tradeoff parameter $\alpha_2$ 1019 provided by mapping component 1028, and second target suppression parameter $H_2$ 1025 provided by parameter conditioning component 1046, as shown below with respect to Eq. 101:

$$G_2(f) = \frac{\alpha_2(f)SNR_2(f) + (1 - \alpha_2(f))H_2(f)}{\alpha_2(f)SNR_2(f) + (1 - \alpha_2(f))}, \tag{101}$$

where $G_2(f)$ corresponds to spatial gain estimation 1027 of first signal 1040 and $SNR_2(f)$ corresponds to non-stationary noise estimate 1026 that is present in first signal 1040.

Residual echo suppression component 1006 may be configured to provide an estimate of a residual echo suppression gain associated with first signal 1040. As shown in FIG. 10, residual echo suppression component 1006 includes a residual echo estimation component 1050, a fourth parameter provider 1052, and residual echo suppression gain estimation component 1054. Residual echo estimation component 1050 may be configured to provide a noise estimate 1029 of residual echo present in first signal 1040. The estimate may be provided as a signal-to-residual echo ratio present in first signal 1040 on a per-frame basis.

In accordance with an embodiment, the signal-to-residual echo ratio for a particular frame may be equal to the probability that the particular frame is from a desired source divided by the probability that the particular frame is a from a non-desired source (e.g., residual echo). The probability may be determined and provided by spatial information modeling component 1024. For example, the GMM being modeled may also include a mixture that corresponds to the residual echo. The mixture may be adapted based on residual echo information 1038 provided by an acoustic echo canceller (e.g., FDAEC 204, as shown in FIG. 2). Accordingly, residual echo information 1038 may correspond to residual echo information 238, as shown in FIG. 2.

In accordance with an embodiment, residual echo information 1038 may include a measure of correlation in the FDAEC output signal (224, as shown in FIG. 2) at the pitch period of a far-end talker(s) of the downlink signal (202, as shown in FIG. 2) as a function of frequency, where a relatively high correlation is an indication of residual echo presence and a relatively low correlation is an indication of no residual echo presence. In accordance with another embodiment, residual echo information 1038 may include the FDAEC output signal and the downlink signal (or the pitch period thereof), and single channel suppression component 1000 determines the measure of correlation in the FDAEC output signal at the pitch period of the downlink signal as a function of frequency. In accordance with either embodiment, a probability (e.g., probability 1031) may be obtained based on the measure of correlation. Probability 1031 may be relatively higher if the measure of correlation indicates that the FDAEC output signal has high correlation at the pitch period of the downlink signal, and probability 1031 may be relatively lower if the measure of correlation indicates that the FDAEC output signal has low correlation at the pitch period of the downlink signal. The correlation at the down-link pitch period of the FDAEC output signal may be calculated as a normalized autocorrelation at a lag corresponding to the down-link pitch period of the FDAEC output signal, providing a correlation measure that is bounded between 0 and 1.

Probability 1031 may also be provided to mapping component 1028. Mapping component 1028 may be configured to heuristically map probability 1031 to a third tradeoff parameter $\alpha_3$ 1033, which is provided to residual echo suppression gain estimation component 1054. For instance, if probability 1031 is low (i.e., a particular frame of first signal 1040 is likely from a desired source), mapping component 1028 may vary the value of third tradeoff parameter $\alpha_3$ 1033 such that an increased emphasis is placed on minimizing the distortion of the desired source during frames that include the desired source. If probability 1031 is high (i.e., the particular frame of first signal 1040 likely contains residual echo), mapping component 1028 may vary third tradeoff parameter $\alpha_3$ 1033 such that an increased emphasis is placed on minimizing the unnaturalness of the residual noise signal during frames that include the non-desired source.

Fourth parameter provider 1052 may be configured to obtain and provide a value of a third target suppression parameter $H_3$ 1035 that specifies an amount of attenuation to be applied to the residual echo included in first signal 1040. In one embodiment, the value of third target suppression parameter $H_3$ 1035 comprises a fixed aspect of back-end SCS component 1000 that is determined during a design or tuning phase associated with that component. Alternatively, the value of third target suppression parameter $H_3$ 1035 may be determined in response to some form of user input (e.g., responsive to user control of settings of a device that includes back-end SCS component 1000). In a still further embodiment, fourth parameter provider 1052 adaptively determines the value of third target suppression parameter $H_3$ 1035 based at least in part on characteristics of first signal 1040. In accordance with any these embodiments, the value of third target suppression parameter $H_3$ 1035 may be constant across all frequencies of first signal 1040, or alternatively, the value of third target suppression parameter $H_3$ 1035 may vary per frequency bin of first signal 1040.

Residual echo suppression gain estimation component 1054 may be configured to determine and provide an estimation 1037 of a gain associated with residual echo included in first signal 1040. Residual echo suppression gain estimate 1037 may be based on residual echo estimate 1029 provided by residual echo suppression gain estimation component 1054, third tradeoff parameter $\alpha_3$ 1033 provided by mapping component 1028, and third target suppression parameter $H_3$ 1035 provided by fourth parameter provider 1052, as shown below with respect to Eq. 102:

$$G_3(f) = \frac{\alpha_3(f)SNR_3(f) + (1 - \alpha_3(f))H_3(f)}{\alpha_3(f)SNR_3(f) + (1 - \alpha_3(f))}, \tag{102}$$

where $G_3(f)$ corresponds to residual echo suppression gain estimate 1037 of first signal 1040 and $SNR_3(f)$ corresponds to residual echo estimate 1029 present in first signal 1040.

Gain composition component 1008 may be configured to determine the lesser of non-spatial gain estimate 1007 and spatial gain estimate 1027 and combine the determined lesser gain with residual echo suppression gain estimate 1037 to obtain a combined gain 1039. In accordance with an embodiment, gain composition component 1008 adds residual echo suppression gain estimate 1037 to the lesser of non-spatial gain estimate 1007 and spatial gain estimate 1027 to obtain combined gain 1039. In accordance with another embodiment, gain composition component 1008 is configured to determine the lesser of non-spatial gain estimate 1007 and spatial gain estimate 1027 and combine the determined lesser gain with residual echo suppression gain estimate 1037 on a frequency bin-by-frequency bin basis to provide a respective combined gain value for each frequency-bin.

Gain application component 1010 may be configured to suppress noise (e.g., stationary noise, non-stationary noise and/or residual echo) from first signal 1040 based on combined gain 1039 to provide suppressed signal 1044. In accordance with an embodiment, gain application component 1010 is configured to suppress noise from first signal 1040 on a frequency bin-by-frequency bin basis using the respective combined gain values for each frequency bin, as described above.

It is noted that in accordance with an embodiment, back-end SCS component 1000 is configured to operate in a handset mode of a device in which back-end SCS component 1000 is implemented or a speakerphone mode of such a device. In accordance with such an embodiment, back-end SCS component 1000 receives a mode enable signal 1036 from a mode detector (e.g., mode detector 222, as shown in FIG. 2) that causes back-end SCS system 1000 to switch between handset mode and conference mode. Accordingly, mode enable signal 1036 may correspond to mode enable signal 236, as shown in FIG. 2. When operating in conference mode, mode enable signal 1036 may cause spatial SCS component 1004 to be disabled, such that the spatial gain is not estimated. Accordingly, gain application component 1010 may be configured to suppress stationary noise and/or residual echo from first signal 1040 (and not non-stationary noise). When operating in handset mode, mode enable signal 1036 may cause spatial SCS component 1004 to be enabled. Accordingly, gain application component 1010 may be configured to suppress stationary noise, non-stationary noise, and/or residual echo from first signal 1040.

X. Example Processor Implementation

Figure 11:
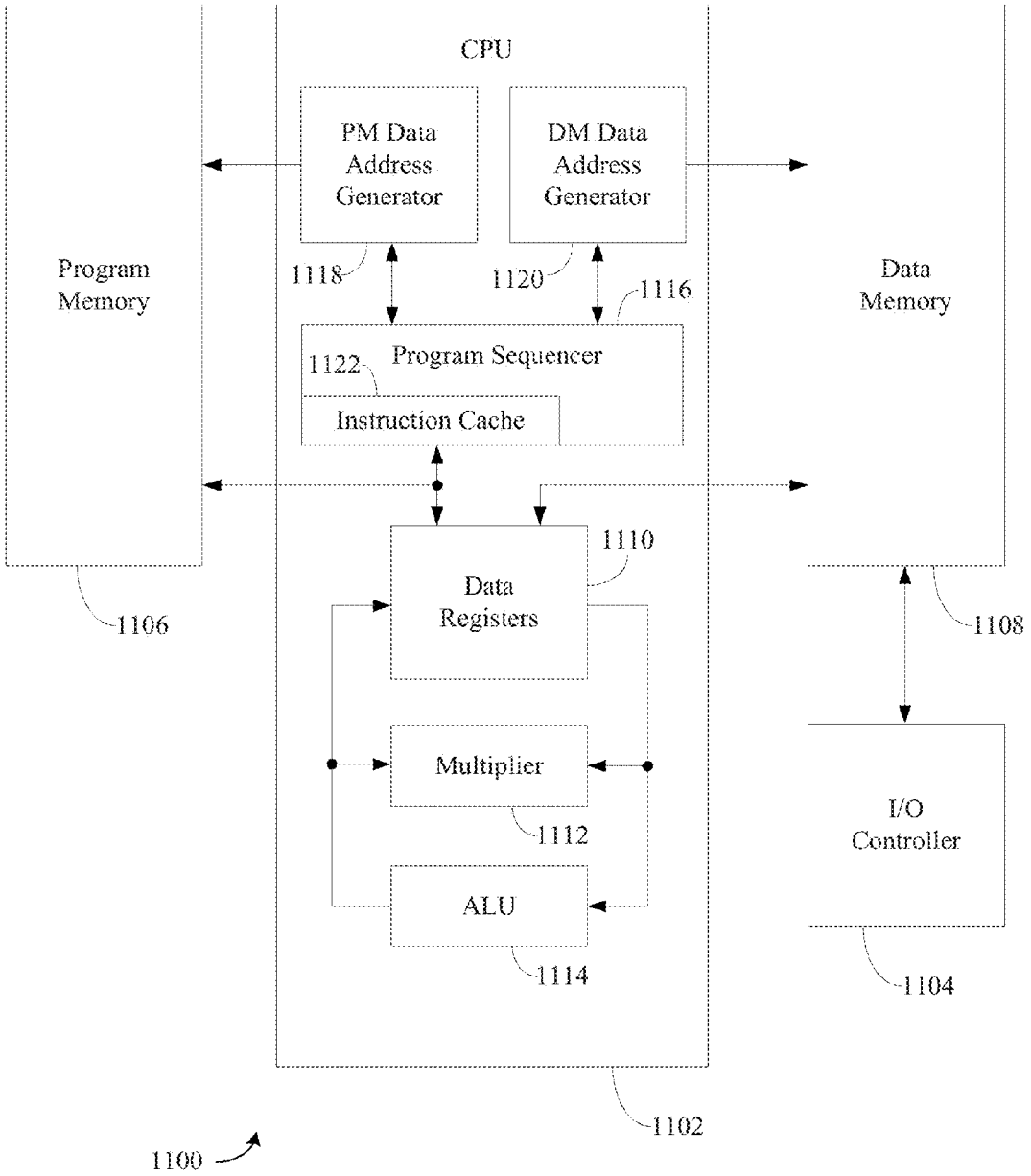
FIG. 11 depicts a block diagram of a processor circuit that may be configured to perform techniques disclosed herein.
Figure 12:
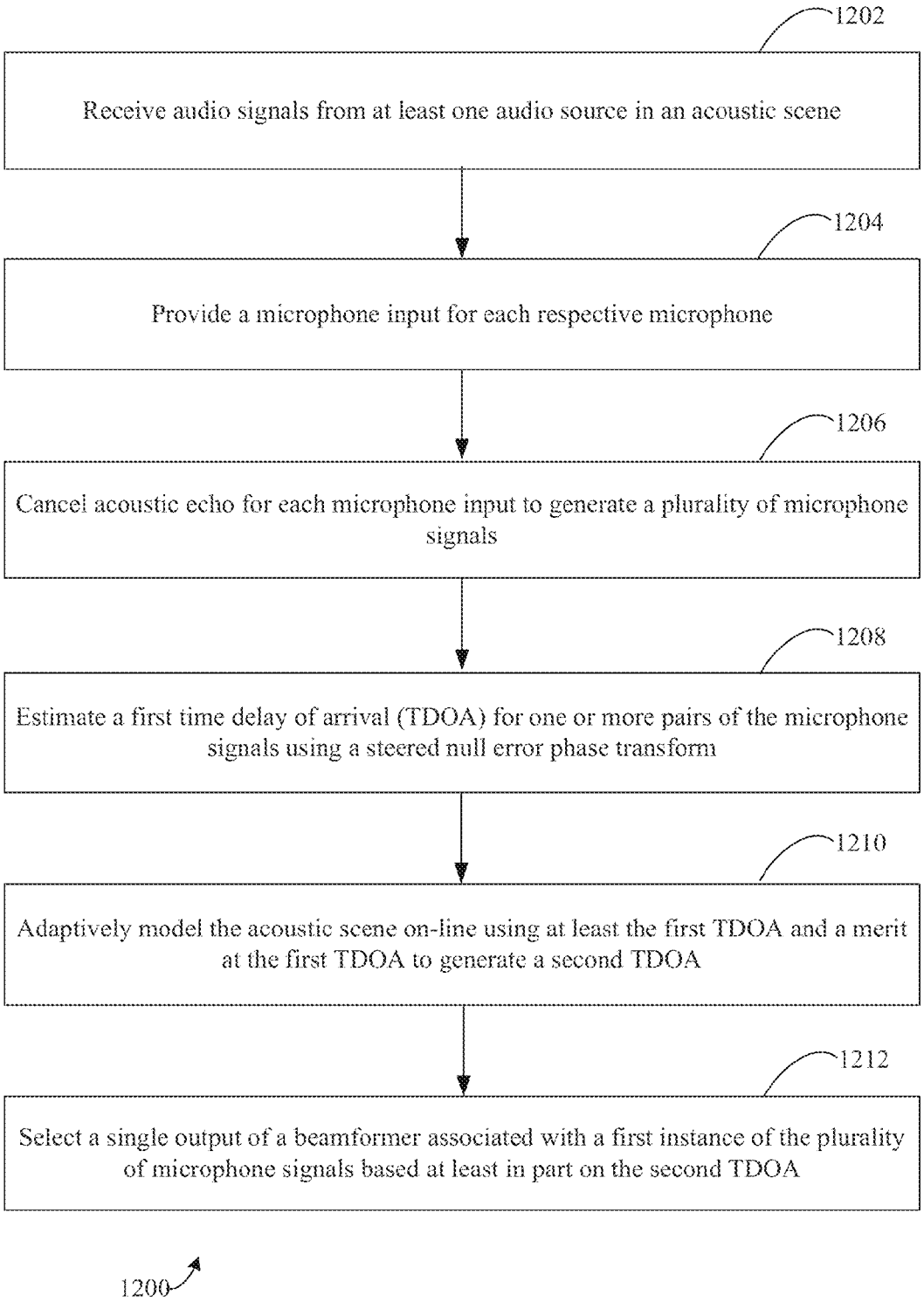
FIG. 12 shows a flowchart providing example steps for multi-microphone source tracking and noise suppression, according to an example embodiment.
Figure 13:
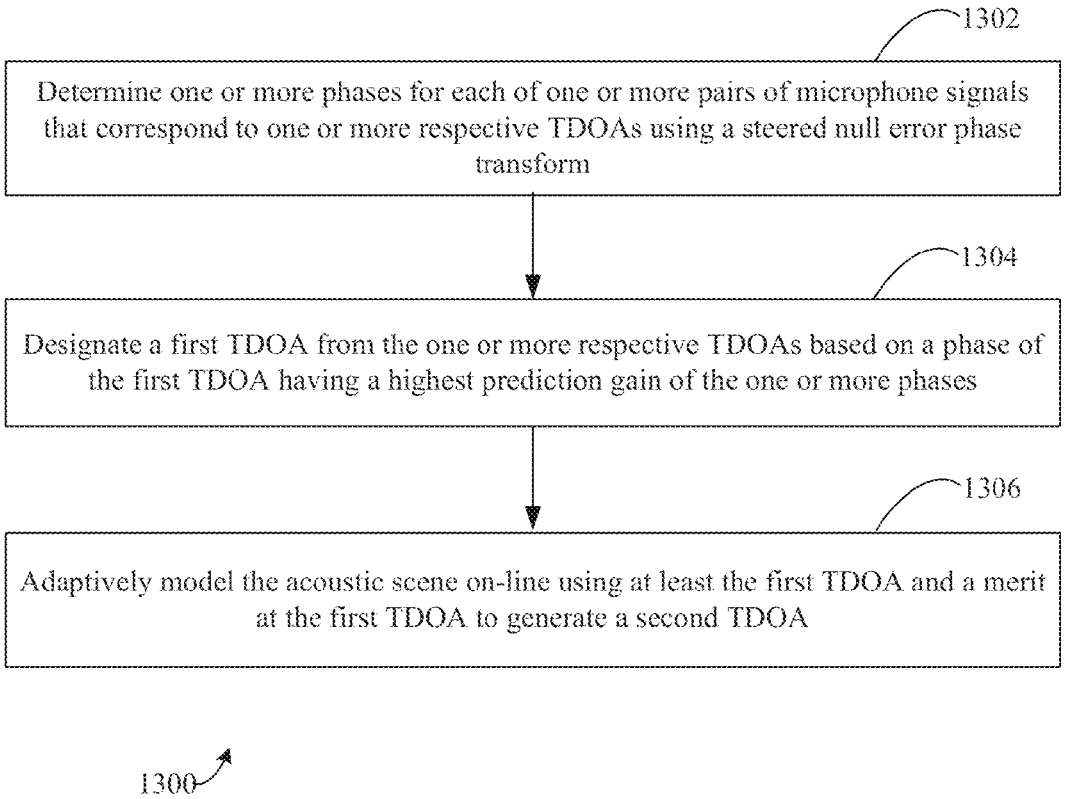
FIG. 13 shows a flowchart providing example steps for multi-microphone source tracking and noise suppression, according to an example embodiment.
Figure 14:
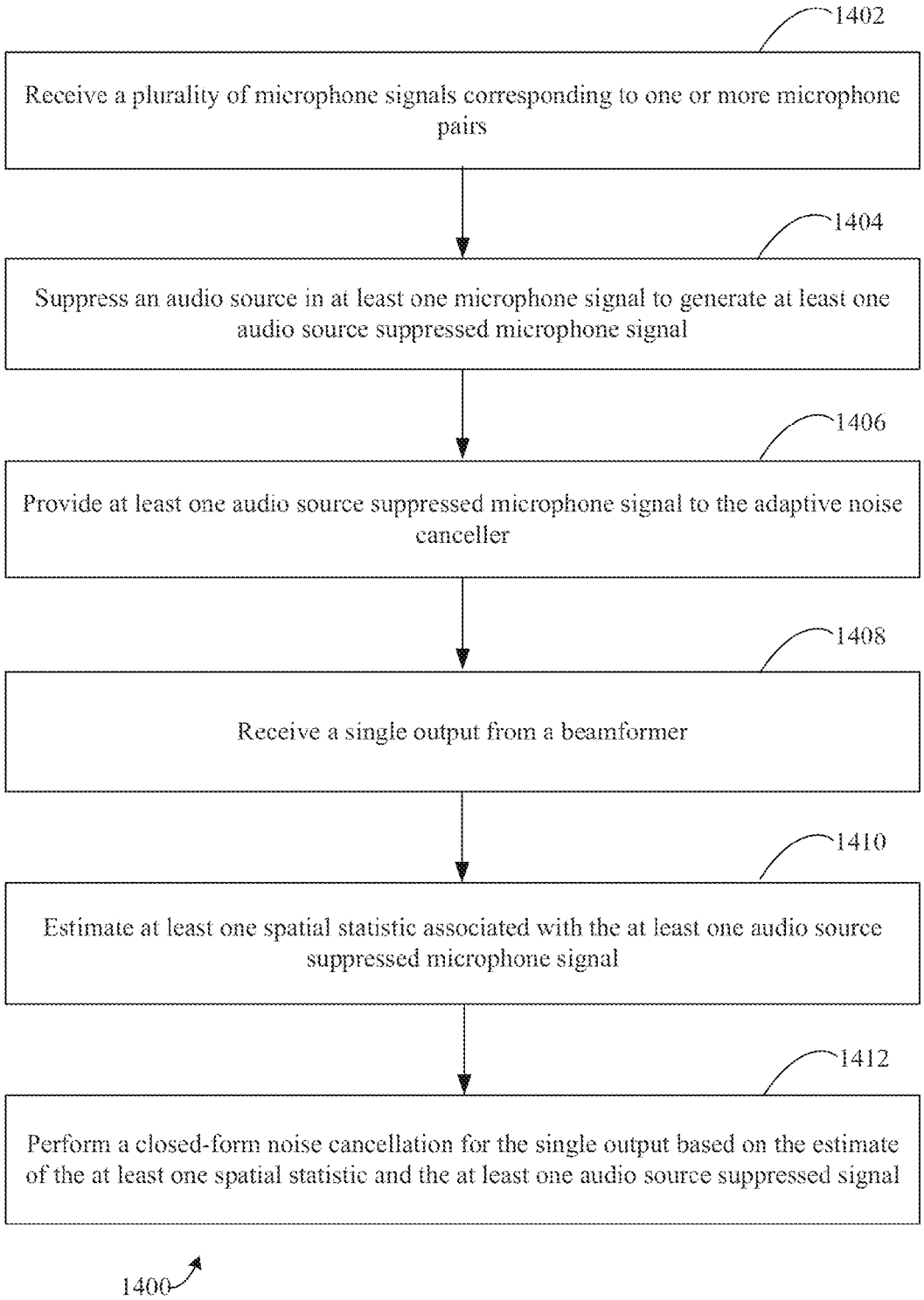
FIG. 14 shows a flowchart providing example steps for multi-microphone source tracking and noise suppression, according to an example embodiment.

FIG. 11 depicts a block diagram of a processor circuit 1100 in which portions of communication device 100, as shown in FIG. 1, system 200 (and the components and/or sub-components described therein), as shown in FIG. 2, SID implementation 500 (and the components and/or sub-components described therein), as shown in FIG. 5, SSDB configuration 600 (and the components and/or sub-components described therein), as shown in FIG. 6, dual-microphone beamformer 800 (and the components and/or sub-components described therein), as shown in FIG. 8, multi-microphone beamformer 900 (and the components and/or sub-components described therein), as shown in FIG. 9, SCS 1000 (and the components and/or sub-components described therein), as shown in FIG. 10, flowchart 1200, as shown in FIG. 12, flowchart 1300, as shown in FIG. 13, flowchart 1400, as shown in FIG. 14, as well as any methods, algorithms, and functions described herein, may be implemented. Processor circuit 1100 is a physical hardware processing circuit and may include central processing unit (CPU) 1102, an I/O controller 1104, a program memory 1106, and a data memory 1108. CPU 1102 may be configured to perform the main computation and data processing function of processor circuit 1100. I/O controller 1104 may be configured to control communication to external devices via one or more serial ports and/or one or more link ports. For example, I/O controller 1104 may be configured to provide data read from data memory 1108 to one or more external devices and/or store data received from external device(s) into data memory 1108. Program memory 1106 may be configured to store program instructions used to process data. Data memory 1108 may be configured to store the data to be processed.

Processor circuit 1100 further includes one or more data registers 1110, a multiplier 1112, and/or an arithmetic logic unit (ALU) 1114. Data register(s) 1110 may be configured to store data for intermediate calculations, prepare data to be processed by CPU 1102, serve as a buffer for data transfer, hold flags for program control, etc. Multiplier 1112 may be configured to receive data stored in data register(s) 1110, multiply the data, and store the result into data register(s) 1110 and/or data memory 1108. ALU 1114 may be configured to perform addition, subtraction, absolute value operations, logical operations (AND, OR, XOR, NOT, etc.), shifting operations, conversion between fixed and floating point formats, and/or the like.

CPU 1102 further includes a program sequencer 1116, a program memory (PM) data address generator 1118, a data memory (DM) data address generator 1120. Program sequencer 1116 may be configured to manage program structure and program flow by generating an address of an instruction to be fetched from program memory 1106. Program sequencer 1116 may also be configured to fetch instruction(s) from instruction cache 1122, which may store an N number of recently-executed instructions, where N is a positive integer. PM data address generator 1118 may be configured to supply one or more addresses to program memory 1106, which specify where the data is to be read from or written to in program memory 1106. DM data address generator 1120 may be configured to supply address(es) to data memory 1108, which specify where the data is to be read from or written to in data memory 1108.

XI. Example Operational Embodiments

Embodiments and techniques, including methods, described herein may be performed in various ways such as but not limited to, being implemented by hardware, software, firmware, and/or any combination thereof. Device 100, system 200 (and the components and/or sub-components described therein), as shown in FIG. 2, SID implementation 500 (and the components and/or sub-components described therein), as shown in FIG. 5, SSDB configuration 600 (and the components and/or sub-components described therein), as shown in FIG. 6, dual-microphone beamformer 800 (and the components and/or sub-components described therein), as shown in FIG. 8, multi-microphone beamformer 900 (and the components and/or sub-components described therein), as shown in FIG. 9, SCS 1000 (and the components and/or sub-components described therein), as shown in FIG. 10, may each operate according to one or more of the flowcharts described in this section. Other structural and operational embodiments will be apparent to persons skilled in the relevant art(s) based on the discussion regarding the described flowcharts.

For example, FIG. 12 shows a flowchart 1200 providing example steps for multi-microphone source tracking and noise suppression, according to an example embodiment. FIG. 13 shows a flowchart 1300 providing example steps for multi-microphone source tracking and noise suppression, according to an example embodiment. FIG. 14 shows a flowchart 1400 providing example steps for multi-microphone source tracking and noise suppression, according to an example embodiment. Flowchart 1200 is described as follows.

Flowchart 1200 may begin with step 1202. In step 1202, audio signals may be received from at least one audio source in an acoustic scene. In embodiments, the audio signals may be created by one or more sources (e.g., DS or interfering source) and received by plurality of microphones $\mathbf{106}_1$-$\mathbf{106}_N$ of FIGS. 1 and 2.

In step 1204, a microphone input may be provided for each respective microphone. For example, microphone inputs such as microphone inputs 206 may be generated by $\mathbf{106}_1$-$\mathbf{106}_N$ and provided to AEC component 204, as shown in FIG. 2.

In step 1206, acoustic echo may be cancelled for each microphone input to generate a plurality of microphone signals. According to embodiments, AEC component 204 and/or FDAEC component(s) 112 may cancel acoustic echo for the received microphone inputs 206 to generate echo-cancelled outputs 224, as shown in FIG. 2. In embodiments, a separate FDAEC component 112 may be used for each microphone input 206.

In step 1208, a first time delay of arrival (TDOA) may be estimated for one or more pairs of the microphone signals using a steered null error phase transform. For instance, a front-end processing component such as MMNR 114 and/or SNE-PHAT TDOA estimation component 212 may estimate the TDOA associated with compensated microphone outputs 226 (e.g., subsequent to microphone mismatch compensation, as shown in FIG. 2) corresponding to microphone pair configurations described herein.

In step 1210, the acoustic scene may be adaptively modeled on-line using at least the first TDOA and a merit based on the first TDOA to generate a second TDOA. According to embodiments, a front-end processing component such as MMNR 114 and/or on-line GMM modeling component 214 may adaptively model the acoustic scene on-line, as shown in FIG. 2. As described in the preceding Sections, the acoustic scene may be modeled using statistics such as a TDOA (e.g., received from SNE-PHAT TDOA estimation component 212) and its associated merit.

In step 1212, a single output of a beamformer associated with a first instance of the plurality of microphone signals may be selected based at least in part on the second TDOA. In embodiments, a beamformer, such as SSDB 218 shown in FIG. 2 may select a single output (e.g., DS single-output selected signal 232) from the beams associated with compensated microphone outputs 226. For example, as shown in SSDB configuration 600 of FIG. 6, each of look/NULL components $\mathbf{604}_1$-$\mathbf{604}_N$ receives compensated microphone outputs 226, and weighted beams $\mathbf{606}_1$-$\mathbf{606}_N$ are provided to beam selector 602 for selection of DS single-output selected signal 232 based at least in part on a TDOA (e.g., statistics, mixtures, and probabilities 230). As noted herein, a beam associated with compensated microphone outputs 226 may first be selected and then applied by SSDB 218 and/or SSDB configuration 600.

In some example embodiments, one or more steps 1202, 1204, 1206, 1208, 1210, and/or 1212 of flowchart 1300 may not be performed. Moreover, steps in addition to or in lieu of steps 1202, 1204, 1206, 1208, 1210, and/or 1212 may be performed. Further, in some example embodiments, one or more of steps 1202, 1204, 1206, 1208, 1210, and/or 1212 may be performed out of order, in an alternate sequence, or partially (or completely) concurrently with other steps.

Flowchart 1300 is described as follows. Flowchart 1300 may begin with step 1302. In step 1302, one or more phases may be determined for each of one or more pairs of microphone signals that correspond to one or more respective TDOAs using a steered null error phase transform. In embodiments, a frequency dependent TDOA estimator may be used to determine the phases. For example, SNE-PHAT TDOA estimation component 212 may determine phases associated with audio signals provided as compensated microphone outputs 226, as shown in FIG. 2.

In step 1304, a first TDOA may be designated from the one or more respective TDOAs based on a phase of the first TDOA having a highest prediction gain of the one or more phases. For instance, SNE-PHAT TDOA estimation component 212 may designate or determine that a TDOA is associated with a DS based on the TDOA allowing for the highest prediction gain relative to the phases of other TDOAs.

In step 1306, the acoustic scene may be adaptively modeled on-line using at least the first TDOA and a merit based on the first TDOA to generate a second TDOA. An acoustic scene modeling component may be used to adaptively model the acoustic scene on-line. In embodiments, the acoustic scene modeling component may be on-line GMM modeling component 214 of FIG. 2. As described herein, on-line GMM modeling component 214 may receive spatial information 228 (e.g., TDOAs) from SNE-PHAT TDOA estimation component 212 and associated merit values.

In some example embodiments, one or more steps 1302, 1304, 1306, 1308, 1310, and/or 1312 of flowchart 1300 may not be performed. Moreover, steps in addition to or in lieu of steps 1302, 1304, 1306, 1308, 1310, and/or 1312 may be performed. Further, in some example embodiments, one or more of steps 1302, 1304, 1306, 1308, 1310, and/or 1312 may be performed out of order, in an alternate sequence, or partially (or completely) concurrently with other steps.

Flowchart 1400 is described as follows. Flowchart 1400 may begin with step 1402. In step 1402, a plurality of microphone signals corresponding to one or more microphone pairs may be received. According to embodiments, adaptive blocking matrices (e.g., adaptive blocking matrix component 216) may receive compensated microphone outputs 226, as illustrated in FIG. 2, and by FIGS. 8 and 9. In some embodiments, adaptive blocking matrix component 216 may comprise a delay-and-difference beamformer, as described herein, and may form beams, using weighting parameters, from compensated microphone outputs 226.

In step 1404, an audio source in at least one microphone signals may be suppressed to generate at least one audio source suppressed microphone signal. For example, adaptive blocking matrix component 216 may suppress a DS in the received compensated microphone outputs 226 described in step 1402. By suppressing the DS, interfering sources may be relatively reinforced for use by an adaptive noise canceller (ANC).

In step 1406, the at least one audio source suppressed microphone signal may be provided to the adaptive noise canceller. For instance, the at least one audio source suppressed microphone signal in which the DS is suppressed, as in step 1404 (and shown as non-DS beam signals 234 in FIG. 2, $Y_{BM}(f)$ in FIG. 8, and $Y_{BM,2}(f)$-$Y_{BM,M}(f)$ in FIG. 9), may be provided to ANC 220 from adaptive blocking matrix component 216 (804 in FIG. 8, and 904 in FIG. 9).

In step 1408, a single output of a beamformer may be received. In embodiments, the single output (e.g., DS single-output selected signal 232) may be received by ANC 220 from SSDB 218, as described herein.

In step 1410, at least one spatial statistic associated with the at least one audio source suppressed microphone signal may be estimated. ANC 220 may estimate, e.g., a running mean of one or more spatial noise statistics, as described herein, over a given time period. In some embodiments, ANC 220 may map a speech presence probability (e.g., the probability of a DS or other speaking source) to a smoothing factor for the running mean estimation of the noise statistics. These noise statistics may be determined based on the received input(s) from SSDB 218 and/or adaptive blocking matrix component 216.

In step 1412, a closed-form noise cancellation may be performed for the single output based on the estimate of the at least one spatial statistic and at least one audio source suppressed microphone signal. That is, in embodiments, ANC 220 may perform a closed-form noise cancellation in which the noise components represented in the at least one audio source suppressed microphone signal output of adaptive blocking matrix component 216 is removed, suppressed, and/or cancelled from the single output of the beamformer (e.g., DS single-output selected signal 232). This noise cancellation may be based on one or more spatial statistics, as estimated in step 1410 and/or as described herein.

In some example embodiments, one or more steps 1402, 1404, 1406, 1408, 1410, and/or 1412 of flowchart 1400 may not be performed. Moreover, steps in addition to or in lieu of steps 1402, 1404, 1406, 1408, 1410, and/or 1412 may be performed. Further, in some example embodiments, one or more of steps 1402, 1404, 1406, 1408, 1410, and/or 1412 may be performed out of order, in an alternate sequence, or partially (or completely) concurrently with other steps.

XII. Further Example Embodiments

Techniques, including methods, and embodiments described herein may be implemented by hardware (digital and/or analog) or a combination of hardware with one or both of software and/or firmware. Techniques described herein may be implemented by one or more components. Embodiments may comprise computer program products comprising logic (e.g., in the form of program code or software as well as firmware) stored on any computer useable medium, which may be integrated in or separate from other components. Such program code, when executed by one or more processor circuits, causes a device to operate as described herein. Devices in which embodiments may be implemented may include storage, such as storage drives, memory devices, and further types of physical hardware computer-readable storage media. Examples of such computer-readable storage media include, a hard disk, a removable magnetic disk, a removable optical disk, flash memory cards, digital video disks, random access memories (RAMs), read only memories (ROM), and other types of physical hardware storage media. In greater detail, examples of such computer-readable storage media include, but are not limited to, a hard disk associated with a hard disk drive, a removable magnetic disk, a removable optical disk (e.g., CDROMs, DVDs, etc.), zip disks, tapes, magnetic storage devices, MEMS (micro-electromechanical systems) storage, nanotechnology-based storage devices, flash memory cards, digital video discs, RAM devices, ROM devices, and further types of physical hardware storage media. Such computer-readable storage media may, for example, store computer program logic, e.g., program modules, comprising computer executable instructions that, when executed by one or more processor circuits, provide and/or maintain one or more aspects of functionality described herein with reference to the figures, as well as any and all components, steps and functions therein and/or further embodiments described herein.

Such computer-readable storage media are distinguished from and non-overlapping with communication media (do not include communication media). Communication media embodies computer-readable instructions, data structures, program modules or other data in a modulated data signal such as a carrier wave. The term "modulated data signal" means a signal that has one or more of its characteristics set or changed in such a manner as to encode information in the signal. By way of example, and not limitation, communication media includes wireless media such as acoustic, RF, infrared and other wireless media, as well as signals transmitted over wires. Embodiments are also directed to such communication media.

The techniques and embodiments described herein may be implemented as, or in, various types of devices. For instance, embodiments may be included in mobile devices such as laptop computers, handheld devices such as mobile phones (e.g., cellular and smart phones), handheld computers, and further types of mobile devices, stationary devices such as conference phones, office phones, gaming consoles, and desktop computers, as well as car entertainment/navigation systems. A device, as defined herein, is a machine or manufacture as defined by 35 U.S.C. §101. Devices may include digital circuits, analog circuits, or a combination thereof. Devices may include one or more processor circuits (e.g., processor circuit 1100 of FIG. 11, central processing units (CPUs), microprocessors, digital signal processors (DSPs), and further types of physical hardware processor circuits) and/or may be implemented with any semiconductor technology in a semiconductor material, including one or more of a Bipolar Junction Transistor (BJT), a heterojunction bipolar transistor (HBT), a metal oxide field effect transistor (MOSFET) device, a metal semiconductor field effect transistor (MESFET) or other transconductor or transistor technology device. Such devices may use the same or alternative configurations other than the configuration illustrated in embodiments presented herein.

XIII. Conclusion

While various embodiments have been described above, it should be understood that they have been presented by way of example only, and not limitation. It will be apparent to persons skilled in the relevant art that various changes in form and detail can be made therein without departing from the spirit and scope of the embodiments. Thus, the breadth and scope of the embodiments should not be limited by any of the above-described exemplary embodiments, but should be defined only in accordance with the following claims and their equivalents.

What is claimed is:

1. A system that comprises:

two or more microphones configured to:

receive audio signals from at least one audio source in an acoustic scene; and provide a microphone input for each respective microphone;

an acoustic echo cancellation (AEC) component configured to cancel acoustic echo for each microphone input to generate a plurality of microphone signals; and a front-end processing component configured to:

estimate a first time delay of arrival (TDOA) for one or more pairs of the microphone signals using a steered null error phase transform;

adaptively model the acoustic scene on-line using at least the first TDOA and a merit at the first TDOA to generate a second TDOA; and select a single output of a beamformer associated with a first instance of the plurality of microphone signals based at least in part on the second TDOA.

2. The system of claim 1, wherein the two or more microphones comprise a primary microphone and one or more supporting microphones, wherein the two or more microphones are configured as one or more microphone pairs, each microphone pair including the primary microphone and a respective one of the supporting microphones, and wherein the one or more pairs of the microphone signals respectively correspond to the one or more microphone pairs.

3. The system of claim 2, wherein the AEC component includes two or more frequency-dependent AEC components that are configured to cancel acoustic echo using a frequency-dependent acoustic echo cancellation that shares an adaptive leakage factor of the primary microphone with each of the one or more supporting microphones.

4. The system of claim 3, wherein a number of the two or more frequency-dependent AEC components is greater than or equal to a number of the two or more microphones, and wherein each of the two or more frequency-dependent AEC components cancel acoustic echo for the microphone input for one respective microphone.

5. The system of claim 2, wherein wherein the front-end processing component is configured to:

track an audio source for each of the plurality of microphone signals;

suppress the audio source in a second instance of the plurality of microphone signals to generate a subset of the plurality of microphone signals; and suppress the subset of the plurality of microphone signals from the single output of the beamformer to generate a single-channel audio output.

6. The system of claim 5, wherein the front-end processing component is configured to provide the single-channel audio output to a back-end processing component that is configured to perform spatial noise cancellation.

7. The system of claim 2, wherein the system further comprises:

a microphone mismatch estimation component configured to estimate a difference in a sensitivity level and/or an output level of each supporting microphone relative to the primary microphone; and a microphone mismatch compensation component configured to normalize the sensitivity level and/or the output level of each supporting microphone relative to the primary microphone based on the estimated difference for each supporting microphone.

8. A system that comprises:

a frequency-dependent time delay of arrival (TDOA) estimator configured to:

determine one or more phases for each of one or more pairs of microphone signals that correspond to one or more respective TDOAs using a steered null error phase transform; and designate a first TDOA from the one or more respective TDOAs based on a phase of the first TDOA having a highest prediction gain of the one or more phases; and an acoustic scene modeling component configured to:

adaptively model the acoustic scene on-line using at least the first TDOA and a merit at the first TDOA to generate a second TDOA.

9. The system of claim 8, wherein the TDOA estimator is configured to use the steered null error phase transform in a frequency band, in a plurality of frequency bands, and/or over full frequency spectrum.

10. The system of claim 8, wherein the TDOA estimator is configured to determine the phase of the first TDOA having the highest prediction gain of the one or more phases using spatial aliasing to identify at least one of the one or more phases as a false peak.

11. The system of claim 8, wherein the second TDOA corresponds to a desired source in the one or more pairs of microphone signals, and wherein the acoustic scene modeling component comprises a Gaussian mixture model, and is configured to perform, on an audio frame by audio frame basis, at least one of:

an on-line expectation maximization algorithm; or an on-line maximum a posteriori algorithm.

12. The system of claim 8, wherein the system further comprises:

an acoustic model component configured to store, generate, and/or update one or more acoustic models associated with at least one of a desired source or one or more interfering sources;

a source identification (SID) scoring component configured to generate a statistical representation of a probability that a first source in an audio frame is the desired source based on a comparison of one or more audio sources in an audio frame to the one or more acoustic models; and a source tracker component configured to determine an identity-based TDOA and an identity-based SID probability based on the statistical representation of the probability and to provide the identity-based TDOA to a beamformer.

13. The system of claim 8, wherein the system further comprises:

an automatic mode detector configured to determine whether the system is operating in a single-user speakerphone mode or a conference speakerphone mode based at least on patterns of one or more audio sources over a period of time.

14. A system that comprises:

an adaptive blocking matrix component; and an adaptive noise canceller;

the adaptive blocking matrix component being configured to:

receive a plurality of microphone signals corresponding to one or more microphone pairs;

suppress an audio source in at least one microphone signal to generate at least one audio source suppressed microphone signal; and provide the at least one audio source suppressed microphone signal to the adaptive noise canceller;

the adaptive noise canceller being configured to:

receive a single output from a beamformer;

estimate at least one spatial statistic associated with the at least one audio source suppressed microphone signal; and perform a closed-form noise cancellation for the single output based on the estimate of the at least one spatial statistic and the at least one audio source suppressed microphone signal.

15. The system of claim 14, wherein the system further comprises the beamformer; and wherein the beamformer is a switched super-directive beamformer (SSDB) configured to:

receive the plurality of microphone signals;

select the single output based on the plurality of microphone signals and on a time delay of arrival (TDOA) for the audio source; and provide the single output to the adaptive noise canceller.

16. The system of claim 15, wherein the SSDB is configured to:

determine a respective weighting value for one or more of a plurality of beams, each respective weighting value based on a covariance matrix inversion associated with the plurality of microphone signals from which each beam of the plurality of beams is formed; and select the single output based on the respective weighting values.

17. The system of claim 16, wherein the SSDB is configured to:

determine that a noise model associated with the plurality of microphone signals has changed; and recursively update the respective weighting values in response to determining that the noise model has changed.

18. The system of claim 14, wherein the adaptive noise canceller is configured to estimate the at least one spatial statistic by determining a running mean of the at least one spatial statistic.

19. The system of claim 14, wherein the adaptive noise canceller is configured to:

perform the closed-form noise cancellation by minimizing output power of one or more additional audio sources other than the audio source; and/or update the estimation of the at least one spatial statistic based on a determined change associated with the audio source.

20. The system of claim 14, wherein the adaptive blocking matrix component comprises a delay-and-difference beamformer that is configured to:

reinforce one or more additional audio sources other than the audio source in the at least one audio source suppressed microphone signals.

* * * * *

UNITED STATES PATENT AND TRADEMARK OFFICE

CERTIFICATE OF CORRECTION

PATENT NO. : 9,338,551 B2
APPLICATION NO. : 14/216769
DATED : May 10, 2016
INVENTOR(S) : Thyssen et al.

It is certified that error appears in the above-identified patent and that said Letters Patent is hereby corrected as shown below:

In the claims,

In column 56, line 60, in claim 5, after "2," delete "wherein".

Signed and Sealed this
Nineteenth Day of July, 2016

Michelle K. Lee

Michelle K. Lee
*Director of the United States Patent and Trademark Office*